US007467792B2

(12) United States Patent
Bittenbender et al.

(10) Patent No.: US 7,467,792 B2
(45) Date of Patent: Dec. 23, 2008

(54) ANTI-TOPPLING DEVICE FOR MAIL WITH RETRACTABLE PROTRUSION

(75) Inventors: Mark David Bittenbender, Columbia, MD (US); Benjamin C. Liu, Silver Spring, MD (US); Kevin D. Bruner, Canonsburg, PA (US)

(73) Assignee: Northrop Grumman Corporation, Los Angeles, CA (US)

( * ) Notice: Subject to any disclaimer, the term of this patent is extended or adjusted under 35 U.S.C. 154(b) by 201 days.

(21) Appl. No.: 11/233,360

(22) Filed: Sep. 23, 2005

(65) Prior Publication Data

US 2006/0087068 A1 Apr. 27, 2006

Related U.S. Application Data

(60) Provisional application No. 60/612,654, filed on Sep. 24, 2004.

(51) Int. Cl.
*B65H 1/18* (2006.01)

(52) U.S. Cl. ..... 271/149; 271/2; 271/31.1; 271/105; 271/150

(58) Field of Classification Search ..... 271/2, 271/105, 31.1, 145, 149, 150, 152; 198/418.7, 198/419.1, 419.3, 432
See application file for complete search history.

(56) References Cited

U.S. PATENT DOCUMENTS 4,446,962 A 5/1984 Burkhardt
4,509,635 A 4/1985 Emsley et al.
4,699,277 A 10/1987 Baxter
4,725,182 A 2/1988 Sakamoto et al.
4,730,730 A 3/1988 Clarkson
4,757,985 A 7/1988 Hamant et al.
4,863,037 A 9/1989 Stevens et al.
4,895,242 A 1/1990 Michel
5,044,877 A 9/1991 Constant et al.
5,054,992 A 10/1991 Hognestad et al.
5,104,109 A 4/1992 Kubo
5,106,254 A 4/1992 Tolasch et al.
5,119,954 A 6/1992 Svyatsky et al.
5,183,378 A 2/1993 Asano et al.
5,239,182 A 8/1993 Tateyama et al.
5,244,199 A 9/1993 Wood
5,266,812 A 11/1993 Mokuo
5,273,392 A 12/1993 Bernard, II et al.
5,360,316 A 11/1994 O'Mara et al.
5,364,592 A 11/1994 Lewis et al.
5,379,992 A 1/1995 Holmes et al.
5,419,457 A 5/1995 Ross et al.
5,535,874 A 7/1996 Ross et al.
5,593,269 A 1/1997 Bernard, II
5,692,867 A 12/1997 Kondo et al.
5,695,071 A 12/1997 Ross et al.
5,713,713 A 2/1998 Syde et al.
5,733,093 A 3/1998 Palm et al.
5,826,744 A 10/1998 Kwasniewski et al.
5,829,742 A 11/1998 Rabindran et al.
5,833,076 A 11/1998 Harres et al.
5,857,830 A 1/1999 Harres et al.

(Continued)

*Primary Examiner*—Patrick Mackey
*Assistant Examiner*—Gerald W McClain
(74) *Attorney, Agent, or Firm*—Rothwell, Figg, Ernst & Manbeck

(57) ABSTRACT

A mail destacker is provided that includes a destacker plate and a retractable protrusion that can move between an article erecting position and a retracted position.

8 Claims, 43 Drawing Sheets

U.S. PATENT DOCUMENTS 5,897,290 A 4/1999 Lu et al.
5,906,468 A 5/1999 Vander Syde et al.
5,934,666 A 8/1999 Rabindran et al.
5,934,866 A 8/1999 Redden
5,947,468 A 9/1999 McKee et al.
5,957,448 A 9/1999 Frank et al.
5,964,564 A 10/1999 Hanon et al.
5,971,391 A 10/1999 Salomon et al.
5,980,188 A 11/1999 Ko et al.
5,993,132 A 11/1999 Harres et al.
6,024,533 A 2/2000 Redden
6,026,967 A 2/2000 Isaacs et al.
6,032,946 A * 3/2000 Marshall et al. ..... 271/152
6,095,316 A 8/2000 Redden
6,135,697 A 10/2000 Isaacs et al.
6,142,723 A 11/2000 Kang
6,172,355 B1 1/2001 Gast et al.
6,179,283 B1 1/2001 Gerstenberg et al.
6,183,191 B1 2/2001 Mondie et al.
6,217,020 B1 4/2001 Supron et al.
6,234,737 B1 5/2001 Young et al.
6,238,164 B1 5/2001 Isaacs
6,257,821 B1 7/2001 Ward et al.
6,270,070 B1 8/2001 Salomon et al.
6,276,509 B1 8/2001 Schuster et al.
6,354,587 B1 3/2002 Engarto
6,390,756 B1 5/2002 Isaacs et al.
6,431,369 B1 8/2002 Boller et al.
6,454,253 B1 9/2002 Tranquilla
6,503,044 B1 1/2003 Enenkel
6,511,062 B1 * 1/2003 Blackwell et al. ..... 271/153
6,561,339 B1 5/2003 Olson et al.
6,575,306 B1 6/2003 Schuster et al.
6,585,256 B2 7/2003 Blackwell et al.
6,612,565 B2 9/2003 Blackwell et al.
6,618,645 B2 9/2003 Bacchi et al.
6,619,647 B2 9/2003 Post et al.
6,629,691 B2 10/2003 Niiyama et al.
6,634,639 B2 10/2003 Kuroda et al.
6,679,491 B2 1/2004 Luebben et al.
6,702,281 B2 3/2004 Post et al.
6,719,519 B2 4/2004 Liehs
2002/0003330 A1 1/2002 Neri et al.
2002/0053768 A1 5/2002 Blackwell et al.
2002/0067981 A1 6/2002 Bonora et al.
2002/0079254 A1 6/2002 Soldavini et al.
2002/0125177 A1 9/2002 Burns et al.
2002/0153654 A1 10/2002 Blackwell et al.
2003/0012637 A1 1/2003 Sperger
2003/0015834 A1 1/2003 Post et al.
2003/0015835 A1 1/2003 Post et al.
2003/0103838 A1 6/2003 Liehs
2003/0141651 A1 7/2003 Berdelle-Hilge et al.
2004/0065596 A1 4/2004 Hanson
2004/0065597 A1 4/2004 Hanson

* cited by examiner

ANTI-TOPPLING DEVICE FOR MAIL WITH RETRACTABLE PROTRUSION

The present application claims the benefit of U.S. Provisional Patent Application No. 60/612,654, filed on Sep. 24, 2004, the contents of which are incorporated herein by this reference.

The present application is related to U.S. patent application Ser. No. 10/927,542, filed on Aug. 27, 2004, the entire disclosure of which is incorporated herein by reference and to U.S. patent application Ser. No. 10/649,337, filed on Aug. 27, 2003, the entire disclosure of which is incorporated herein by reference.

BACKGROUND

1. Field of the Invention

The present invention relates generally to, among other things, systems for handling mail (including, e.g., flats, envelopes, letters, postcards and/or other mail) and/or other objects, and certain preferred embodiments relate, more particularly, to an anti-toppling device for mail and/or the like thin objects which can, preferably, be used in automated systems for processing mail handled by mail sorting systems, such as, e.g., at the input of a feeder.

2. Background Discussion

Currently, a variety of systems are used for the handling of objects, such as, e.g., thin objects like mail flats and/or other mail. For example, the United States Postal Service (U.S.P.S.) uses various systems to facilitate and enhance the handling of mail flats. Some illustrative mail processing systems are described in U.S. Pat. No. 6,443,311 (the '311 patent), assigned to Northrop Grumman Corporation, entitled Flats Bundle Collator, the disclosure of which is incorporated herein by reference in its entirety as though recited herein in full.

As another example, one illustrative mail processing system is the AFSM100™ flats sorting system built by Northrop Grumman Corporation and Rapistan Systems and used by the U.S.P.S. The AFSM100 flats sorting machine is a mail sorting system that can process, e.g., large pieces of flat mail, such as for example magazines, in large volumes. Each AFSM100 system has three mail-feeding units.

In some of these existing mail processing systems, feeders are used to deliver mail into the systems for processing. In some illustrative and non-limiting examples, these feeders include a delivery portion and a destacking (e.g., singulating) portion. In such systems, mail is typically placed onto the delivery portion and delivered to the destacking portion. In these example systems, the mail pieces are usually delivered to a sorting section in pieces (e.g., usually having a fixed gap and/or a fixed pitch).

In such systems, operators typically load (such as, e.g., manually from mail storage hampers) the mail to be processed onto the delivery portion at the beginning of the operation. The operators usually continue to load the mail while the system processes the mail.

While the U.S.P.S. processes approximately 200 billion pieces of mail per year, the mail that is processed requires substantial manual loading and tending by operators. With reference to FIGS. 1(A)-1(B), an operator typically loads mail in existing systems as follows: a) mail is brought toward the feeder in trays, tubs, carts or hampers; b) with reference to arrows A in FIGS. 1(A)-1(B), the operator manually moves handfuls of mail from the tray, tub, etc., and places it onto a surface of the system; c) the operator then integrates a new handful of mail into the stack of mail in process by moving the paddle as depicted by the arrows B shown in FIGS. 1(A)-1(B) such that new mail is captured in the stack of mail in process (the paddle then moves synchronously with a conveyor surface); d) the process is repeated.

This manual process involves a substantial amount of demanding labor and imposes a set of repetitive motions on the operators performing the loading. For letter mail, processing systems may demand about 40,000 pieces an hour. For flats mail, systems may require between about 20,000 and 40,000 pieces per hour distributed over a number of loading consoles (usually, three or four). In such cases, operators may be required to load between about 7,000 and 10,000 flats per hour. With reference to flats, by way of example, these consumption rates can require the operators to lift, transfer and groom approximately 5000 pounds of mail per hour.

In modern-day mail processing environments, sorting and other systems are continuing to run faster and longer than that in the past. The burden placed upon the operators who feed and/or operate the systems, thus, continues to increase. In many instances, the performance of mail processing equipment is increasingly dependant upon an operator's capacity to support the system.

As described above with reference to FIGS. 1(A)-1(B), mail processing delivery systems typically include both a transport system (e.g., a belt or magazine conveyor) and a pusher (e.g., paddle) system that work in tandem to deliver mail to the destacking system. In such systems, the transport system defines the rate at which the mail is delivered to the destacking system. In addition, the pusher system defines the orientation angle at which the mail is presented to the destacking system. In such systems, the transport system and the pusher system move together synchronously and are physically coupled to the same drive chain. In this manner, the pusher system acts as a "bookend" for the stack of mail as the mail is transported via the transport system.

Among other things, the elevated demands placed upon the operators who feed the systems, requires that operators present more mail and/or present mail at a faster rate. This can, e.g., reduce the amount of time available for operators to adjust, groom and/or otherwise manipulate the mail on the delivery system (e.g., to ensure that it is properly oriented for, for instance, efficient destacking).

With existing mail feeding systems that have a transport system and a pusher system that are tied together through a single drive mechanism, the synchronous nature of these systems inhibits them from being able to automatically compensate for poorly stacked mail (e.g., leaning too far forward [such as, e.g., in a manner similar to that denoted by dashed lines B shown in FIG. 2(A)] and/or too far backward [such as, e.g., in a manner similar to that denoted by dashed lines A shown in FIG. 2(A)]). These existing systems rely on the operator to correct stacking problems on the delivery system. FIG. 2(A) illustrates, among other things, several states of how the mail can be presented to the destacking unit, with an illustrative preferred state shown in solid lines.

The stack of flats depicted in solid lines in FIG. 2(A) depicts one optimal condition for presenting the flats (e.g., mail) to a destacking system in preferred embodiments. With systems as described above, an operator typically needs to repeatedly groom (e.g., manually handle and/or manipulate) the mail as it is fed into the destacking section. Otherwise, the angle of orientation relative to the paddle may vary too substantially. As a result, the variation in orientation angle will likely cause a decrease in throughput, an increase in multi-feeds, an increase in damage and/or other problems.

Therefore, a need exists for a systems and methods that can overcome, among other things, the above and/or other problems with existing systems.

SUMMARY OF THE INVENTION

Various embodiments of the present invention can significantly improve upon existing systems and methods. In some preferred embodiments of the present invention, one or more of the above and/or other problems with existing systems can be overcome.

The preferred embodiments involve a novel anti-toppling device for mail and/or the like.

The above and/or other aspects, features and/or advantages of various embodiments will be further appreciated in view of the following description in conjunction with the accompanying figures. Various embodiments can include and/or exclude different aspects, features and/or advantages. In addition, various embodiments can combine one or more aspect or feature from other embodiments. The descriptions of aspects, features and/or advantages of particular embodiments should not be construed as limiting other embodiments or the claims.

BRIEF DESCRIPTION OF THE DRAWINGS

The accompanying figures are provided by way of example, without limiting the broad scope of the invention or various other embodiments, wherein.

DETAILED DESCRIPTION OF PREFERRED EMBODIMENTS

Figures 1A, 1B:
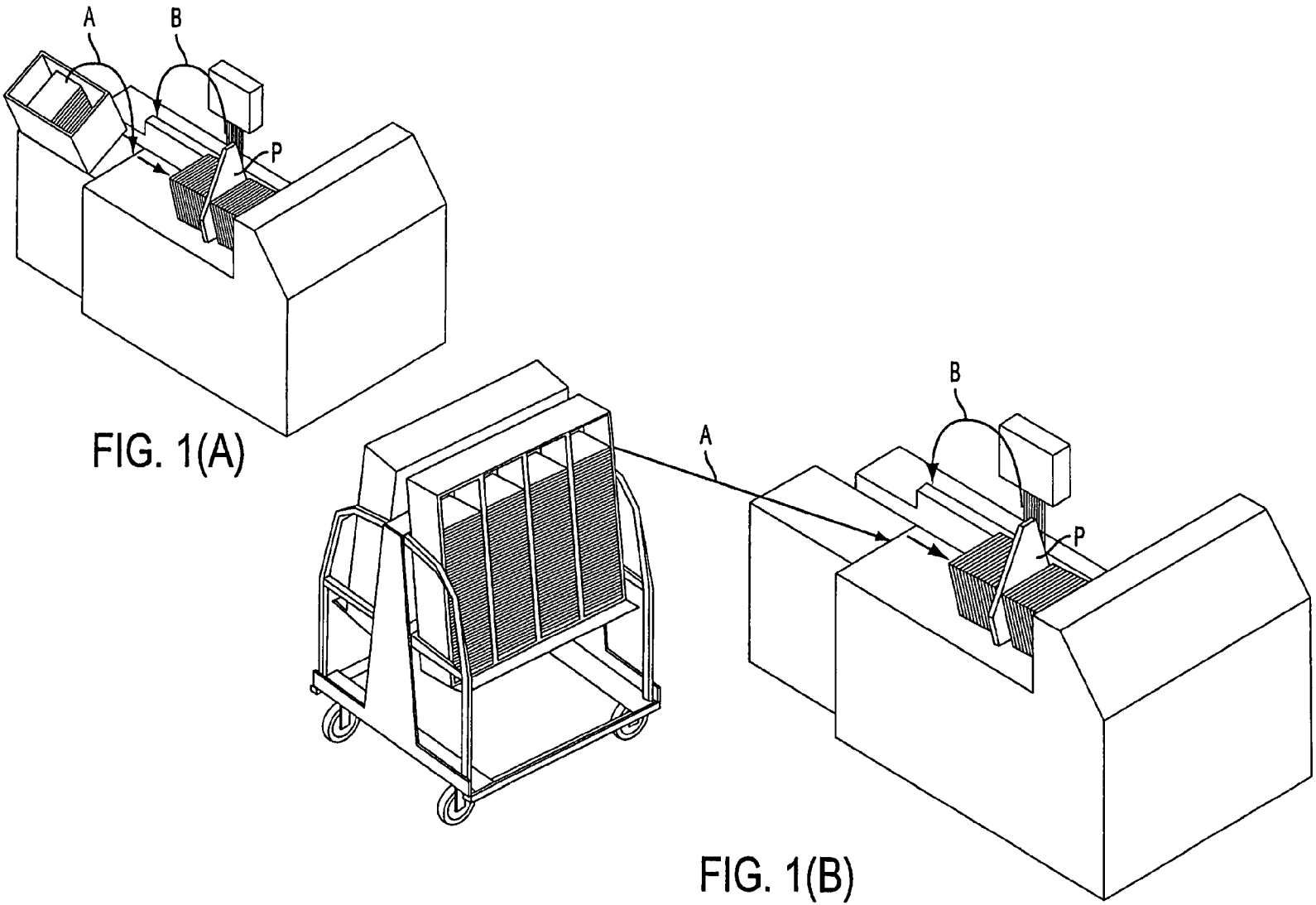
FIG. 1(A) is a schematic diagram illustrating existing manual loading processes for mail feeding systems.
FIG. 1(B) is another schematic diagram illustrating existing manual loading processes for mail feeding systems.

While the present invention may be embodied in many different environments, a number of illustrative embodiments of such environments are described herein with the understanding that the present disclosure is to be considered as providing examples of various principles of the invention and such examples are not intended to limit the invention to preferred embodiments described herein and/or illustrated herein.

The preferred environments involve novel carriers that can be used in a variety of mail applications, such as, e.g., in the automatic loading of prepared mail onto mail processing systems. The following description includes, among other things, descriptions of a) some preferred embodiments of carriers according to the present invention and b) some preferred embodiments of systems and methods in which carriers can be employed.

The preferred carrier embodiments can be employed in mail applications that provide, among other things, a substantially or entirely automated system for use in the processing of thin objects (including, e.g., three-dimensional objects having a size in first dimension that is substantially smaller than sizes in second and third dimensions). While preferred embodiments can be used to process mail (including, for example, flats, envelopes, letters, postcards and/or other mail), and the most preferred embodiments can be used to process mail flats, various embodiments can also or can alternatively be used to process other thin objects, such as, e.g., sheets, boards, panels, planar materials, paper goods and/or other thin objects.

Various embodiments can be employed in a variety of systems and devices. In some non-limiting examples, embodiments can be employed within systems similar to that shown in U.S. Pat. No. 6,443,311 (the '311 patent), assigned to Northrop Grumman Corporation, entitled Flats Bundle Collator, the disclosure of which is incorporated herein by reference in its entirety as though recited herein in full, such as, e.g., to upgrade the feeder 10 shown in FIG. 1 of the '311 patent.

Additionally, various embodiments can be employed, in other non-limiting examples, within an AFSM100™ flats sorting machine built by Northrop Grumman Corporation and Rapistan Systems and used by the United States Postal Service (U.S.P.S.). The AFSM100 flats sorting machine is a mail sorting system that can process, e.g., large pieces of flat mail, such as for example magazines, in large volumes. Each AFSM100 system has three mail-feeding units and embodiments of the present invention can be utilized to improve one or more, preferably all, of these mail-feeding units. In some preferred embodiments, an AFSM100 system is adapted to employ automatic flats stack correction by, e.g., splitting a mail delivery system into two separately controlled components such that, e.g., the machine can deliver mail more efficiently to a sorting unit. Preferably, this is accomplished substantially independently of an operator.

While some embodiments can be used, e.g., with feeders that feed mail, such as that of the AFSM100 system, various other embodiments can be used with feeders that feed other objects or materials. The terminology feeder includes, as per Webster's II New Riverside Dictionary, "[a] device that supplies . . . material" and is not limited to any particular form of feeding or to any particular object fed.

In some embodiments, a delivery system that delivers carriers to a feeder can include one or more transporter and/or one or more conveyor (such as, e.g., supply conveyor 110 described below). The terminology delivery system includes any system that delivers objects and encompasses one or more, e.g., transporter(s), conveyor(s) and/or the like.

Figure 2A:
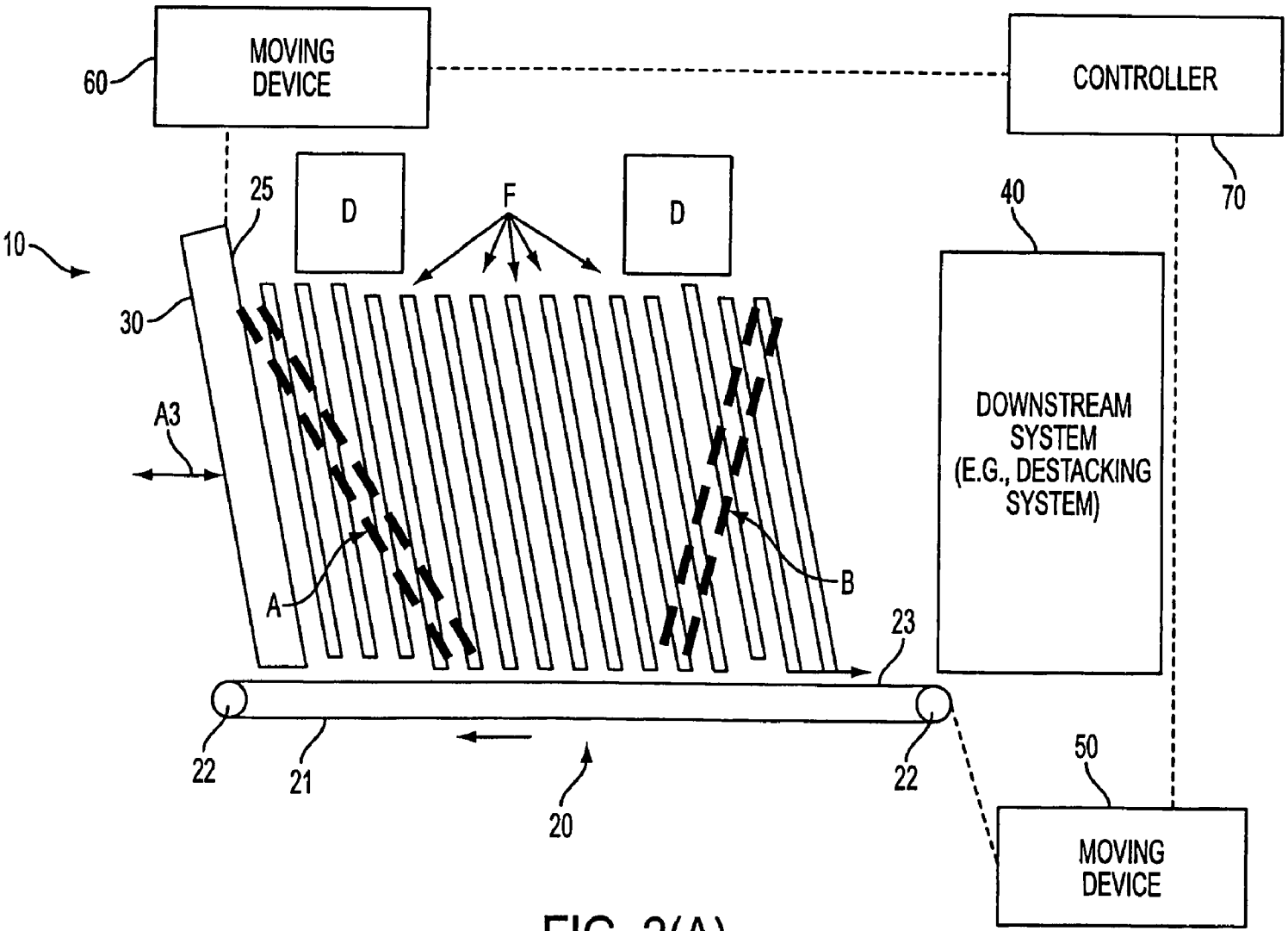
FIG. 2(A) is a schematic side view of a system according to some embodiments of the invention.

FIG. 2(A) shows an illustrative stack induction and correction apparatus 10 that can be employed in some preferred embodiments. In these preferred embodiments, the stack induction and correction device includes a transporter 20 and a pusher 30 as shown in FIG. 2(A). As described below, the stack induction and correction device can preferably a) automatically induct mail to create a mail stack and b) automatically correct the stack during operation. With respect to this stack correction, a system's performance can be enhanced or degraded by the "quality" of a stack as it is presented to a downstream system, such as a destacking system. For example, mail that is either too loose or that is too tight can cause problems, such as for example, system jams, multi-feeds (where, e.g., more than one piece is inducted into the system), system and/or mail damage, adverse effects on the system throughput and/or other problems. In many cases, the orientation angle of the mail (e.g., relative to the face of the pusher) can significantly affect the system. For example, if the mail is slumped (such as, e.g., in a manner similar to that denoted by dashed lines A shown in FIG. 2(A)) the system's performance can substantially degrade. In some instances, it can be helpful to present the mail to the destacking system such that it is generally uniformly aligned with an angle of the pusher system (such as, e.g., in a manner similar to that shown in FIG. 2(A)).

Pusher

While in some illustrative embodiments, the pusher includes a paddle as shown in FIG. 1, the pusher can have a variety of configurations and can, for example, be made with at least one block-shaped member, at least one wedge-shaped member, a plurality of sub-members (such as, e.g., cross-bars, fingers, tines, etc.), at least one blade member and/or any other appropriate structure capable of defining an object holding surface 25. In some preferred embodiments, the object holding surface 25 can have a single contact section, while in other preferred embodiments it can have a plurality of contact sections. In some preferred embodiments, the object holding surface 25 can be generally planar, while in other preferred embodiments it can be substantially non-planar. It should also be noted that the pusher itself need not be tilted so long as it is configured to define a mail holding surface 25 having an appropriate orientation. In some preferred embodiments, the surface 25 is oriented at a non-perpendicular angle relative to a transport surface 23 of the transporter 20. In various embodiments, any appropriate angular orientation can be selected based on circumstances and may involve an recline, no angle, a forward tilt or any other angle.

In some embodiments, the pusher is adapted to move fore-and-aft in the direction of the arrows A3, while retaining a substantially non-perpendicular or reclined orientation as shown in FIG. 2(A). In some preferred embodiments, the angle of recline can vary from about 10° from perpendicular to about 20° from perpendicular; however, the angle of recline can vary from 0° (i.e., perpendicular) to over 20° based on circumstances.

In some embodiments, the pusher can be mounted such that, when desired, it can be raised upward and moved back to a left side of the transporter 20 to support additional mail or the like.

Transporter

With respect to the transporter 20, various embodiments can employ any appropriate structure that is known or available. The terminology transporter includes any device that transports or conveys from one place to another. In some embodiments, the transporter 20 can include a conveyor, a sliding plate, a laterally moved support, a trolley, a plurality of rollers, an inclined plate (such as, e.g., an inclined plate having a low friction surface along which objects can slide due to gravitational or other forces) and/or any other appropriate transporter mechanism known or available having, e.g., a transport surface 23 with which objects may be transported. In that regard, the transport surface 23 can include, e.g., one or more conveyor belt surface(s), one or more sliding plate surface(s), one or more laterally moved support surface(s), one or more trolley surface(s), one or more roller surface(s), one or more inclined plate surface(s) and/or other appropriate surfaces. In some preferred embodiments, the surface 23 can include a single section (such as, e.g., an outer surface of a single conveyor belt as shown), while in other preferred embodiments it can have a plurality of sections (such as, e.g., outer surfaces of a plurality of separate conveyors, rollers or the like). In some preferred embodiments, the surface 23 can be generally planar and generally horizontal (see, e.g., FIG. 2(A)), while in other preferred embodiments it can be substantially non-planar and/or substantially non-horizontal.

In the embodiment shown in FIG. 2(A), the transporter 20 can be configured to transport mail, such as, e.g., flats F towards a downstream system 40. The system 40 can include any appropriate system, and, in some preferred embodiments, the system 40 is a destacking system. A destacking system can, e.g., singulate and/or feed flats to other systems or devices. In some preferred embodiments, the transporter 20 can include a conveyor belt 21 that is rotatably supported on rollers or pulleys 22 in a continuous manner to define an upper run or surface 23 upon which a stack of mail can be placed. The mail transport surface 23 is preferably parallel to a direction of travel of the pusher 30 as indicated by arrows A3 but may be otherwise oriented (such as, e.g., at a slight angle) relative to the direction of pusher travel based on circumstances.

As shown in FIG. 2(A), a moving device 50 (such as, e.g., a motor and/or another mechanism for effecting movement of the transporter 20) is preferably included. In one illustrative example, the moving device 50 can include a motor that is connected so as to rotate the pulley(s) 22. In addition, a second moving device 60 (e.g., at least one motor and/or another mechanism for effecting movement of the pusher) is also preferably included. The pusher can be, for example, supported on a support block that is mounted so as to laterally move along a generally horizontal track (such as, e.g., via roller bearings or the like) and so as to upwardly move along a generally vertical track (see, e.g., embodiments described below). In some embodiments, track(s) and/or a support block can be located adjacent the transporter surface and behind a retaining wall 30R that helps maintain flats upon the transporter (such as, e.g., shown in FIG. 2(B)). In other embodiments, various other mechanisms can be used to move the pusher fore-and-aft and/or up-and-down to follows a desired path, such as screw shafts, hydraulic cylinders, robotic mechanisms, reciprocating arms, mechanical linkages and/or various other mechanisms.

Non-Synchronous

In preferred embodiments, the pusher and transporter systems are adapted to be capable of moving non-synchronously and/or independently from one another in a manner to correct for poor stack angle and to allow the pusher to be independently directed to assist in the automatic loading of mail or the like from carriers. In preferred embodiments, the moving devices 50 and 60 include independent devices, such as, e.g., independent servomotors. As discussed above, a variety of mechanisms can be used to effect movement of the transporter and the pusher.

In the embodiment shown in FIG. 2(A), the moving devices 50 and 60 are both operated via a common controller 70. The controller can include, for example, an electronic control means, such as a computer (e.g., a personal computer [PC], a network computer, a server and/or any other computer device, such as any device that accepts information [e.g., in the form of, e.g., digital data] and processes it based on programming or a sequence of instructions), a processor (e.g., a microprocessor), an integrated circuit, or the like. In some embodiments, separate controllers can be employed to operate each respective moving device 50 and 60 and/or components thereof. In some embodiments, the controller 70 can include a plurality of controllers.

In some embodiments, the controller 70 can include software to control separated pusher and transporter mechanisms using, for example, programmable logic controllers (PLCs), one or more external personal computer (PC) or the like, one or more programmable servo drive and/or other devices. In addition, in preferred embodiments, control is carried out based on input from one or more sensor device(s) D. The sensor device(s) D can be used to sense, detect, estimate and/or otherwise evaluate the condition of the flats (such as, e.g., flat orientation). In some embodiments, the sensor device(s) D can sense flat orientation at a plurality of positions along the transporter 20, or along substantially the entire length of the transporter 20, or along the entire length of the transporter 20. In the illustrated embodiment, two sensor devices D are depicted. However, any appropriate number of sensor device(s) D can be selected depending on circumstances. In some embodiments, the sensor device(s) D can include one or more photo-light beam sensor, one or more photo-light sensor array, one or more pressure sensor, one or more camera and/or one or more appropriate sensor device to, e.g., detect when the flats (e.g., mail flats) are not being presented or delivered properly (e.g., to a sorting unit or the like).

When certain conditions are detected by these sensors, separate drive systems on the delivery system can be adapted to correct for, e.g., poorly loaded mail. For example, the moving devices 50 and 60 can be adapted to alter respective speeds, accelerations, relative positions and/or the like. In this manner, an improved efficiency can be achieved. This can also enable a higher throughput, a reduction in damage to mail, such as, e.g., flats and/or to the system, a reduction in the amount of multi-fed pieces of mail and/or various other advantages.

Figure 10A:
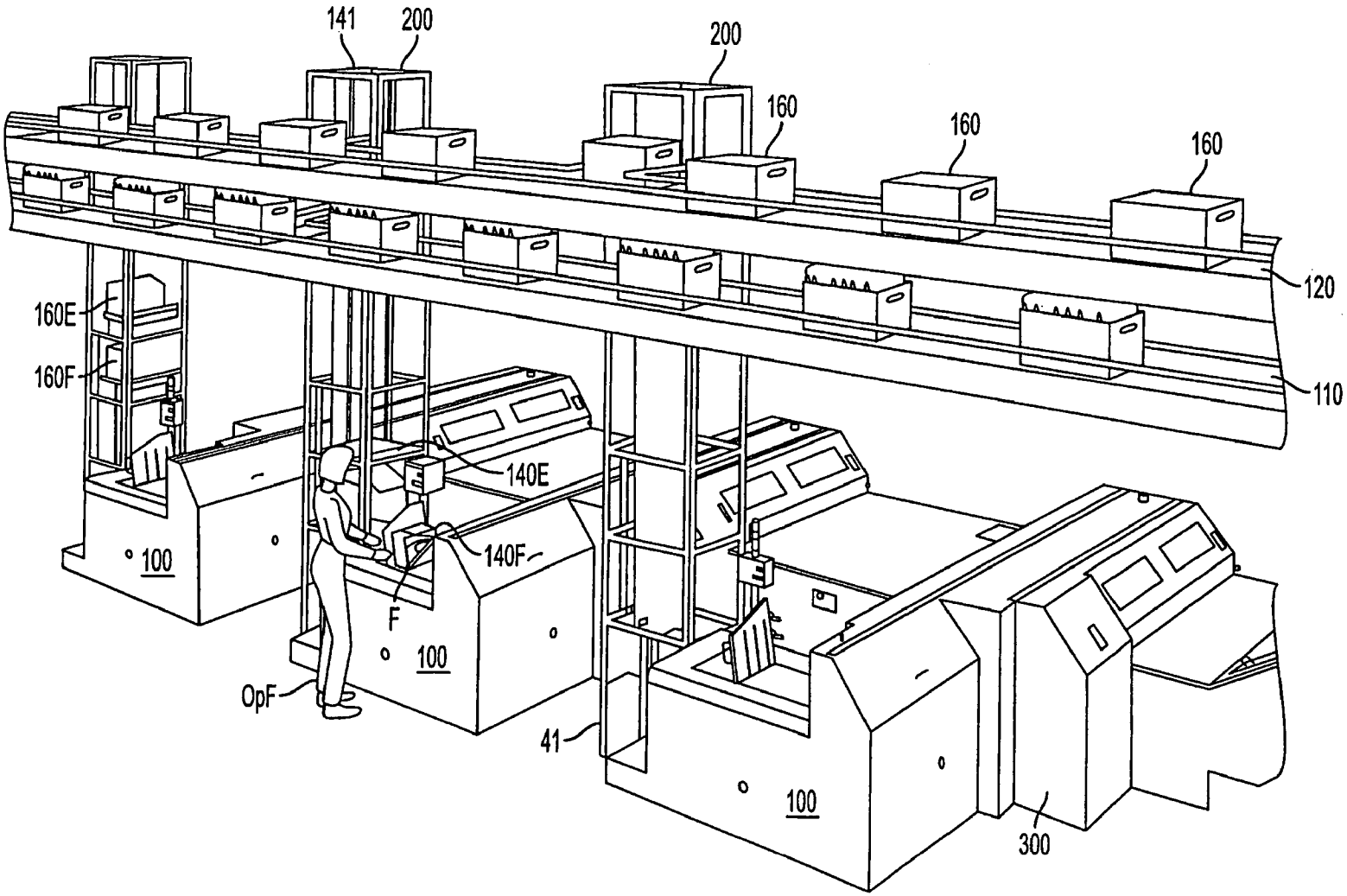
FIG. 10(A) is an elevational view of a system wherein carriers are moved generally vertically to-and/or-from a feeder or other system.
Figure 10B:
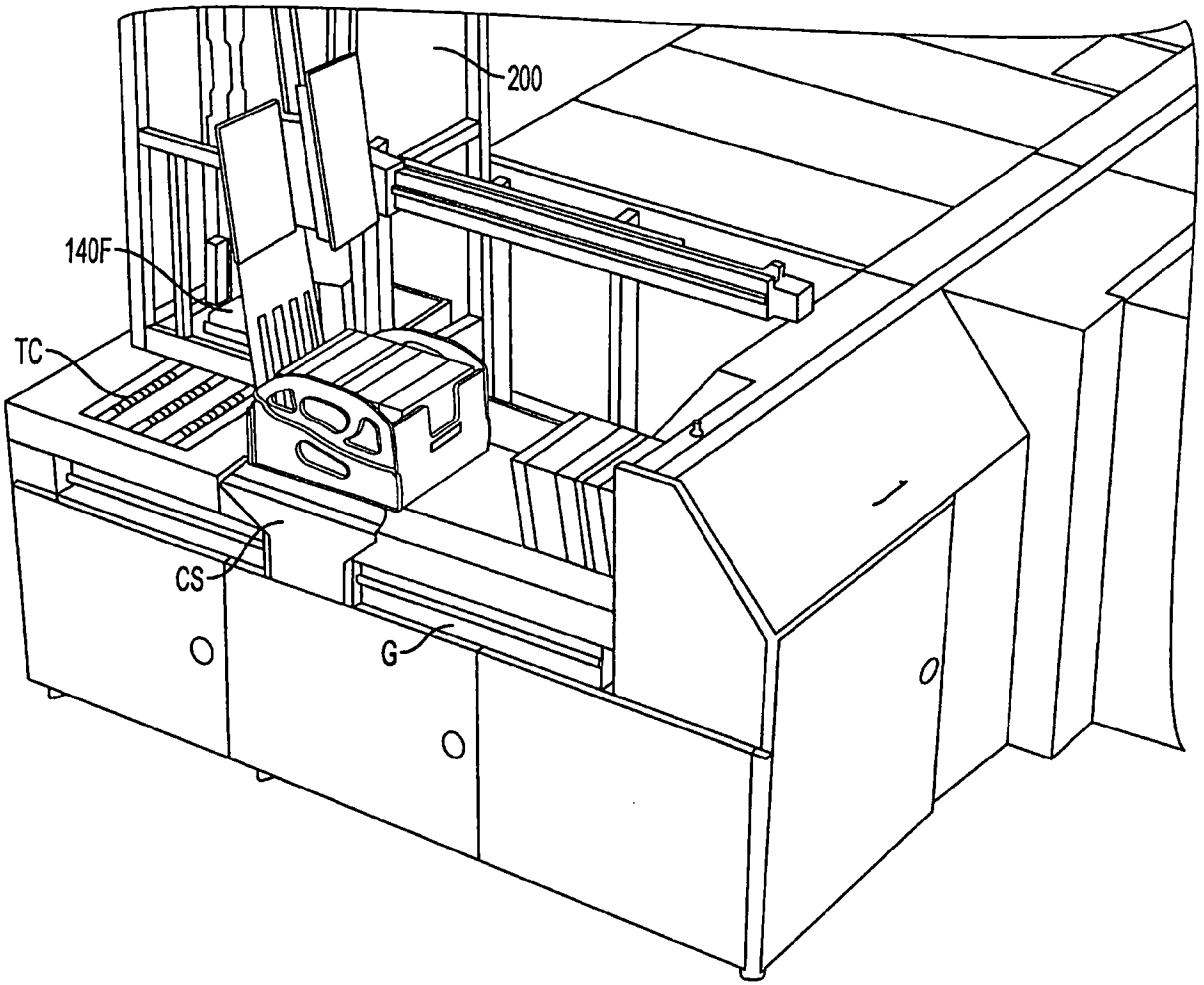
FIG. 10(B) is a perspective view of a mail automatic induction system according to some other preferred embodiments of the invention.
Figure 10C:
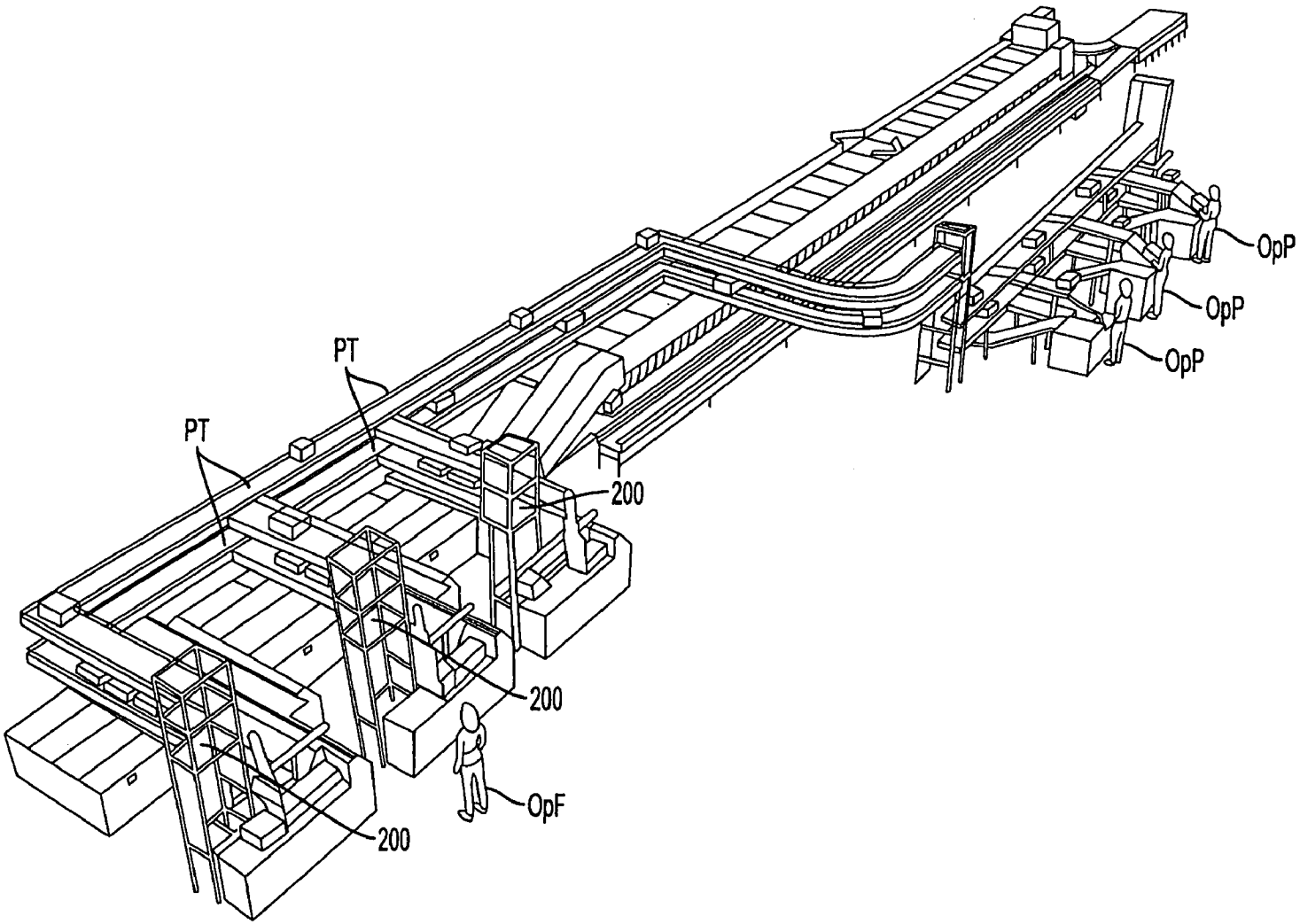
FIG. 10(C) shows one illustrative and non-limiting mail processing system in which embodiments of the present invention can be implemented.

In some embodiments, an operator (such as, e.g., an operator OpF shown in FIGS. 10(A) and 10(C)) can affect or can partly control corrections (such as, e.g., via operator interfaces and/or by manually moving the pusher, etc.), such as by receiving operator input to control the manner of correction, to control the extent of correction, to override operation and/or the like. However, substantial advantages can be obtained, in some preferred embodiments, by substantially or entirely eliminating the dependency of a machine's performance on an operator's ability to groom the mail while the system is loaded. In some preferred embodiments, a substantially automatic or entirely automatic stack correction is provided, as well as a substantially automatic or entirely automatic induction of mail or the like (discussed below).

In some preferred embodiments, a "decoupled" delivery system can thus be provided in which a pusher (e.g., a paddle) and a transporter (e.g., a transport system) can be moved independently to, e.g., correct against stacking errors and to effect automatic induction of mail. With respect to stacking errors, in some illustrative cases, stacking errors can include one or more of the following: a) excessive forward lean of one or more flat (such as, e.g., illustratively depicted in dashed lines at B in FIG. 2(A)); b) excessive rearward lean of one or more flat (such as, e.g., illustratively depicted in dashed lines at A in FIG. 2(A)); c) excessive spacing between flats; d) excessive movement of flats independent of transporter movement (such as, e.g., shifting or the like); e) variation in flat height (such as, e.g., variation of height between adjacent flats and/or variation of height of a specific flat); f) variation in pressure (such as, e.g., lateral pressure upon a pusher and/or upon a system downstream of the pusher, such as a destacking unit); g) slippage or movement of flats during transport; and/or h) other conditions as would be now or later apparent to those in the art based on this disclosure. These and/or other error conditions can be sensed by a number of different methods including, e.g., that described above, such as, e.g., pressure sensors (which can be used, e.g., to sense lateral stack pressure at a destacker system and/or at a pusher system), cameras and/or photo arrays (which can be used, e.g., to sense the stack angle or the like), electromagnet wave or light beam sensors (which can include, e.g., sensing via through beams, reflective beams and/or a combination of thereof for detecting stack angle or the like). As discussed above, the system can further include PLCs, external PCs, programmable servo drives and/or other devices that can be used to control and adjust a stack of flats (e.g., mail flats) on the transporter.

Among other things, as discussed above, decoupling the transporter and pusher components and placing them on separate drive systems can enable movement the pusher system independently of the transporter system and vice versa. In some embodiments, if the system sensors detect that the mail is stacked too loosely (e.g., leaning away from the destacking surface), the pusher can be actuated to "tighten" the stack by moving toward the destacking system at a greater velocity than the transporter. In some embodiments, if the system sensors detect that the stack is "over tilted" (e.g., leaning towards the destacking system), the transporter can also be moved forward at a greater rate than the pusher. For example, when a stack of mail has been poorly loaded, since the pusher system is uncoupled from the transporter system, a sensing mechanism (e.g., located, for instance, at or proximate a downstream end of the transporter [e.g., at a destacking system]) can send a signal causing, e.g., the pusher to move forward until a good mail stack condition is achieved (e.g., is sensed).

Preferably, the transporter and the pusher can continue to move at a generally consistent velocity (such as, e.g., at a "normal" velocity corresponding to a particular apparatus "feed" rate) and the relative velocity there-between can be increased and/or decreased during such movement (e.g., via respective corrections). In this manner, the preferred embodiments should be able to increase throughput of the system and avoid errors that may decrease throughput. In less preferred embodiments, stack correction can include stopping the transport system as the pusher is moved forward and/or stopping the pusher as the transport system is moved forward. While these latter embodiments may be readily programmed and implemented, in some circumstances, these can be less preferable because, e.g., there may be a slight decrease in throughput of the system due to stoppage of respective devices.

Figure 2B:
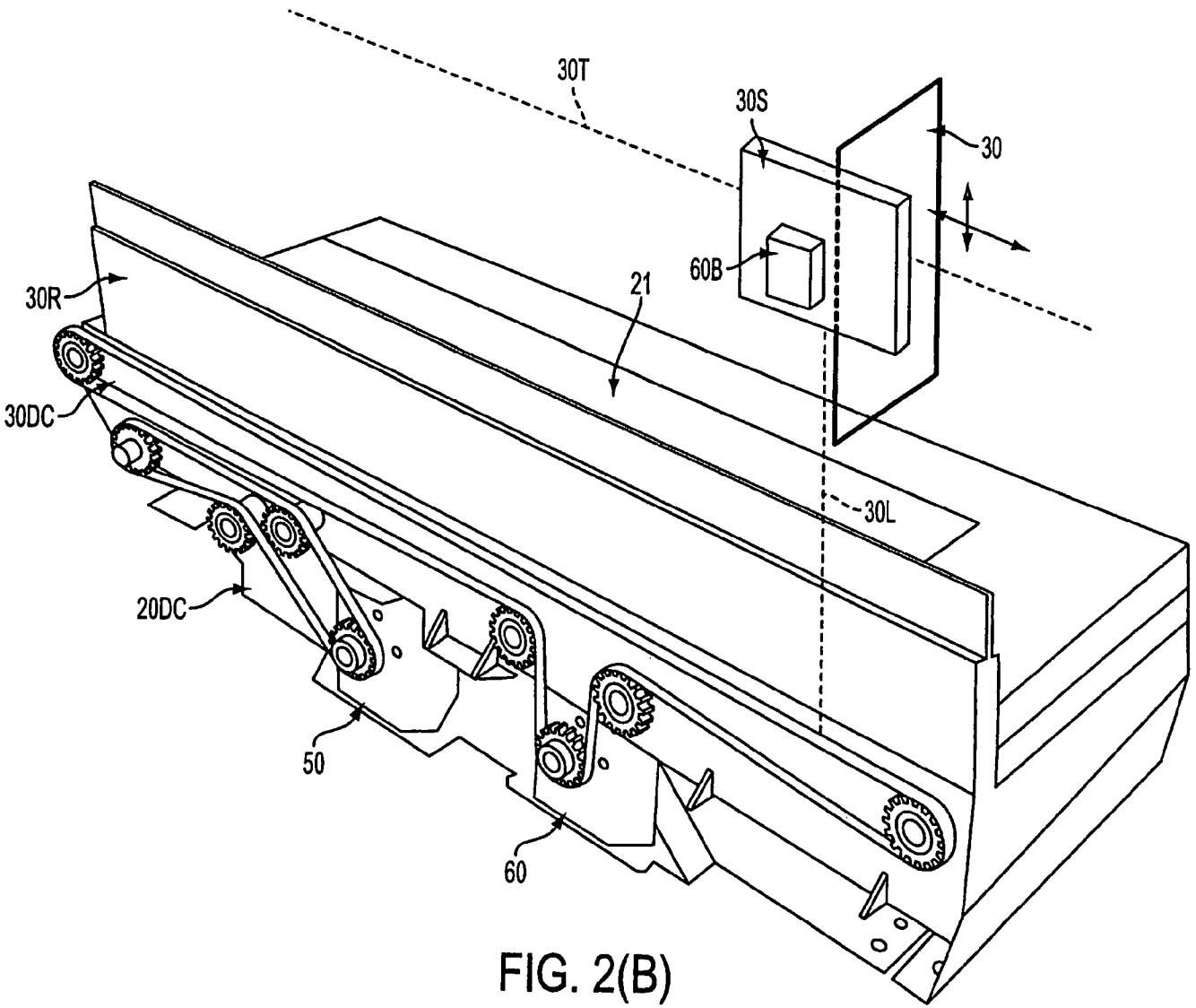
FIG. 2(B) is a rear-side elevational view of portions of some preferred embodiments of the invention demonstrating independent drive mechanisms.

FIG. 2(B) illustrates some components of an automatic stack induction and correction system in some illustrative embodiments. In these illustrative embodiments, portions of the apparatus (e.g., enclosure walls and the like) are omitted to reveal internal structure. These illustrative, and non-limiting, embodiments can include: asynchronously geared motors 60 and 50 with separate drive chains 30DC and 20DC, respectively, that drive the pusher and transporter systems independently; photo-light sensors (not shown) that signal when conditions exist for the systems to correct the stack angle; and a stand-alone computer (not shown) with software that controls the two independent systems.

As depicted in FIG. 2(B), in some preferred embodiments, the moving device 60 can include a motor 60 that drives a drive chain 30DC or the like to effect fore-and-aft movement of a block 30S (e.g., via a link or the like 30L), the block preferably being mounted for reciprocating movement along a generally horizontal track 30T (shown in dashed lines), and an elevating mechanism (such as, e.g., a second motor 60B and a generally vertical track [not shown] guiding the pusher 30 upon the support block 30S) to effect generally up-and-down movement of the pusher 30 with respect to, e.g., the support block 30S, which together effect desired movement of the pusher.

Method of Upgrading

According to some preferred embodiments, a method of upgrading an existing system (such as, e.g., an existing AFSM100 system) having synchronously coupled transporter and a pusher mechanisms can include modifying the existing system to include independently controlled drives for the transporter and the pusher mechanisms, such as discussed above. In this manner, an advantageous upgrade can be effectively and efficiently implemented. For example, a method of upgrading can include modifying an existing feeder 100 so as to replace the drive mechanisms with features depicted in, e.g., FIG. 2(B). Additionally, the method of upgrading can also include modifying a path followed by a pusher to enable the pusher to be automatically moved to a position to facilitate transfer of objects, such as, e.g., flats out of a carrier (e.g., to laterally slide the flats out of a carrier positioned proximate the feeder as described below).

Implementation In Illustrative Mail Processing Systems

FIG. 10(C) shows an illustrative and non-limiting mail processing system in which embodiments can be implemented. Embodiments can be employed in a variety of systems, such as, e.g., within systems disclosed in the above-noted co-pending application 60/469,828 (see, e.g., by way of example FIGS. 9-10, etc.).

In the illustrative system shown in FIG. 10(C), one or more preparation operator OpP can fill empty carriers 160 at an upstream loading zone. Among other things, the preparation operator can facilitate efforts of a feed operator OpF by preparing flats for processing. In some embodiments, the preparation operator can, e.g., de-bundle bundled flats fed to the preparation operator along a conveyor (such as, e.g., feeding bundled flats conveyed from a hamper under the lower supply conveyor 110 shown in FIG. 10(C)) and can re-orient and place them inside a carrier (e.g., the preparation operator can start with, e.g., bundles laying flat, debundle the same and place the debundled mail in a generally vertical orientation on a carrier).

It is contemplated that in some embodiments, some or all of the preparation operator's manual tasks may be automated. For example, a substantially and/or entirely automatically controlled mechanism could be provided to cut bundles and/or to reorient mail from a horizontal orientation to vertical orientations inside carriers.

Thus, the system preferably eliminates the need for feed operators OpF to 'face' and 'orient' the mail during the loading process into the feeder. In some mail handling systems, orienting and facing is desirable because, e.g., mail-processing equipment typically processes mail in specific orientations (such as, e.g., with bindings down and addresses to the right or bindings forward and addresses to the left, etc.). Among other things, orienting and facing can be desirable due to, e.g., the particular nature of how a particular system transports mail in process and, e.g., the location of any automatic address reading equipment relative to the mail in transport (since, e.g., reading is performed as the mail is moving).

FIG. 10(A) illustrates some aspects and features of mail processing systems in which some preferred embodiments can be implemented. While FIG. 10(A) does not show a pusher that pushes flats or the like off of carriers, FIG. 10(A) does show various other features, such as, e.g., supply and return conveyor systems, that can be employed in some illustrative embodiments. Various features shown in FIG. 10(A) can be employed in embodiments in which, e.g., a pusher is used to push or slide flats or the like off of carriers (as discussed further below).

In the embodiments shown in FIG. 10(A), a generally vertical elevator 200 is provided. In preferred embodiments, the elevator 200 includes a conveyor system for moving carriers up-and-down between a supply conveyor 110 and a return conveyor 120. In this disclosure, the terminology elevator can include any system or device that can move an object upward and/or downward. Elevators can include a) supports (such as, e.g., platforms or the like that are used to support the object(s) to be moved and/or any other support structure), b) any form of power, such as, e.g., fuel powered motors, electronic motors, hydraulic motors and/or the like and c) any type of drive mechanisms, such as, e.g. extendable cylinders, rotated screw shafts, conveyor belts or chains and/or the like. In some illustrative embodiments, a full carrier supply conveyor 110 can include a powered-roller, zone-accumulation conveyor to queue and transport full carriers from a preparation operator OpP loading zone to a feeder 100 or the like. The conveyor 110 can include, e.g., a plurality of powered rollers 111. In other embodiments, any other conveyor(s) can be employed, such as, e.g., one or more rotary belt(s), one or more pusher(s), one or more moving platform (s) and/or any other appropriate conveyor(s). In preferred embodiments, the return conveyor 120 can be substantially similar to the supply conveyor 110, but usable to return empty carriers. While the conveyors include powered rollers in some illustrative embodiments, one or more other conveyor(s) could be employed in various other embodiments. For example, one or more conveyor belt(s) and/or other conveyor can be included. The terminology "conveyor" used in this application includes any mechanism by which carriers or other items can be moved, such as, e.g., one or more rotary belt(s), one or more pusher(s), one or more moving platform (s) and/or any other appropriate conveyor(s). In preferred embodiments, the conveyors are configured to have differentiated carrier movement between a plurality of zones along the conveyors.

In some preferred embodiments, the elevator conveyor system includes two platforms, including an upper platform 140E for conveying empty carriers 160E and a lower platform 140F for conveying full carriers 160F. In some illustrative embodiments, the platforms 140E and 140F can be mounted together so as to remain a fixed distance from one another (e.g., a distance substantially equal to the distance between the conveyors 110 and 120). In FIG. 10(A), the leftmost elevator shows an empty carrier 160E and a full carrier 160F in transport together. In some instances, however, the platform 140E may be without another carrier during transport of a full carrier 160F to the feeder 100. Then, upon transfer of the objects to the feeder, the emptied carrier can be transferred to the platform 140E. The elevator can then raise the platforms such that the empty carrier 160E is laterally discharged to the conveyor 120, and, such that a full carrier is laterally moved to the platform 140F. Then, the elevator can lower the new full carrier to continue the process. In other embodiments, the platforms 140E and 140F can be controlled so as to move independently from one another. In other embodiments, the platforms could be located adjacent one another (e.g., with a modified elevator 200 having, e.g., plural elevator shafts) so that upward and/or downward movement may occur independently of one another. However, mounting both platforms to move along a path having a common axis can, e.g., enhance space saving characteristics and improve egress around the feeder 100.

In the illustrative embodiment shown in FIG. 10(A), the elevator 200 includes a support frame 141. Preferably, the elevator has transparent and/or translucent walls or windows (such as, e.g., made of glass, plexiglass, plastic or the like) to enable the interior to be viewed during operation. Preferably, the conveyors 110 and 120 include lateral guide rails (as shown), support edges or the like to help retain the carriers thereon. Preferably, carriers 160E and/or 160F are delivered between the conveyors 110 and/or 120 via pop-up lateral transfer mechanisms (such as discussed below with reference to FIG. 10(C)). Additionally, in some preferred embodiments, sensors or detectors can be used to facilitate control of the system based on carrier positioning. For instance, the lateral transfer mechanisms can be controlled based on carrier presence within the elevators 200 and the like in some embodiments.

In some illustrative embodiments, the platforms 140E and 140F can include mechanisms to facilitate transfer to and/or from the platform(s). For instance, in some embodiments, the platforms can include powered rollers or powered casters to facilitate movement along one or two axes (e.g., parallel to the platform). In this manner, the carriers can easily be transferred to and/or from the platforms (such as, e.g., at their upper positions proximate the conveyors 110 and 120 and/or at their lower positions proximate the feeder operator OpF). In some preferred embodiments, the front of the elevators 200 in front of the operator OpF will include openings, doors, gates or the like to enable access to the platforms 140E and/or 140F. In some preferred embodiments, fixed and/or pop-up stops can be used to limit movement of the carriers from the elevator until desired.

With reference to the system shown in FIG. 10(C), pop-up transfers PT can be used, for example, to transfer carriers to and/or from supply and return conveyors 110 and 120, respectively. FIG. 10(C) shows an illustrative system in which full conveyors are conveyed from the preparation operator OpP location(s) via the supply conveyor 110 to the feeders and in which empty carriers are returned to preparation operator OpP location(s). In the embodiment shown in FIG. 10(C), the elevators 200 can operate substantially like that described above with reference to FIG. 10(A). In some embodiments, elevators 200 may be located substantially over the feeder console. In other embodiments, elevators 200 may be located adjacent, such as, e.g., directly behind the feeder console as shown in FIGS. 10(B) and 10(C). In the latter cases, a mechanism is preferably used to laterally transfer the carriers onto reciprocated carrier supports CS on the feeder console. For example, as shown in FIG. 10(B), the feeder console can include a pop-up transfer conveyor TC that can be moved upward to engage a bottom of the carrier for lateral transfer and that can be lowered to enable reciprocation of the carrier support. In this regard, the carrier support can, e.g., include a generally rectangular frame (such as, e.g., generally similar to a picture frame) with an open interior to allow the transfer conveyor to pop-up there-through to engage the carrier while securely supporting the carrier around the perimeter thereof upon the generally rectangular frame.

Preferred Automatic Induction Embodiments

According to some preferred embodiments, existing equipment can be modified and/or new processing equipment can be developed that provides the capability for that system to automatically load mail or the like from material handling equipment directly onto, e.g., systems (e.g., consoles of feeders) for processing. The preferred embodiments enable the processing equipment (e.g., feeders) to, for example, run more mail, at higher rates, with fewer operators, and without degrading system performance.

According to preferred embodiments, the system(s) can be run with operators functioning in manual-loading modes to, for example, facilitate current operations and/or delivery and/or to facilitate handling mail pieces that cannot be pre-packaged into carriers and/or the like.

FIGS. 3-10 show an illustrative automatic induction system embodiment that includes a retractable paddle and delivery apparatus that can preferably perform some or all of the following tasks: a) automatically present and/or integrate new mail on a carrier to a mail stack being processed; b) automatically remove an empty mail carrier; c) automatically process the mail from the feeder or destacking system while the automatic induction system is in operation (in some cases, however, mail can be pre-loaded at a time when the feeder system is not operated and the mail can simply be loaded onto the console and remain there until the feeder system is started).

Figure 3:
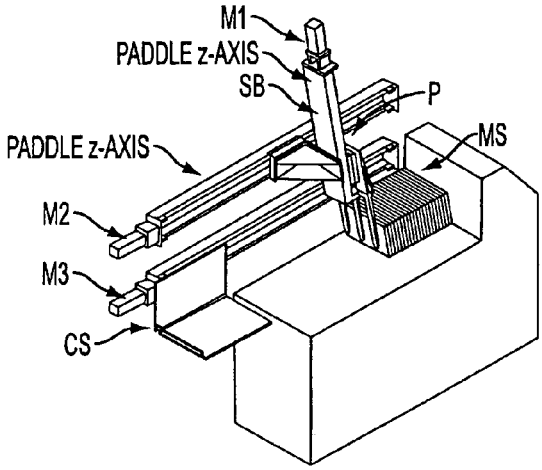
FIG. 3 is a perspective view of a mail automatic induction system according to some preferred embodiments of the invention.

FIG. 3 shows elements of an illustrative automatic feed system implemented in, by way of example, a standard feeder (e.g., a standard flats feeder). As shown, a modified automatic feed pusher, or paddle P, is provided. As shown, the paddle is preferably movably supported upon the support block SB via a generally vertical guide so as to move up-and-down along a z-axis via operation of a motor M1. As shown, the support block SB is preferably movably supported via a generally horizontal guide so as to move fore-and-aft generally along an x-axis via operation of a motor M2. In addition, a carrier support CS is provided that receives carriers C of mail from an outside delivery system and that moves the carriers toward the stack of mail MS for unloading against the stack. As shown, the carrier support CS is similarly supported along a generally horizontal guide for fore-and-aft movement along a delivery axis generally parallel to the x-axis via operation of a motor M3. In preferred embodiments, the motors M1, M2 and M3, the transfer conveyor TC and/or various other elements can be controlled via a controller or the like, such as, e.g., similar to the controller 70 in FIG. 2(A).

In various embodiments, the delivery of the carriers C to the carrier support CS can be effected using a variety of mechanisms, such as, e.g., using: manual delivery, conveyor delivery, elevator delivery, robotic delivery, transfer roller delivery and/or other appropriate mechanisms. In various embodiments, the system can be configured to accept carriers (e.g., to receive carriers upon a carrier support) from any direction (e.g., from a front side, from a back side, from above and/or from below the processing system) to minimize encroachment into the available space around or near the processing system.

FIGS. 4-9 show an illustrative operation of an automatic feed system shown in FIG. 3. In the event that there is no mail on the feeder (such as, e.g., at a start of a run or after the feeder has run dry during processing), the carrier support CS will preferably laterally deliver the mail to adjacent the pickoff of the destacking area (such as, e.g., to accommodate a position similar to that of the mail stack MS in process shown in FIG. 3).

Figure 4:
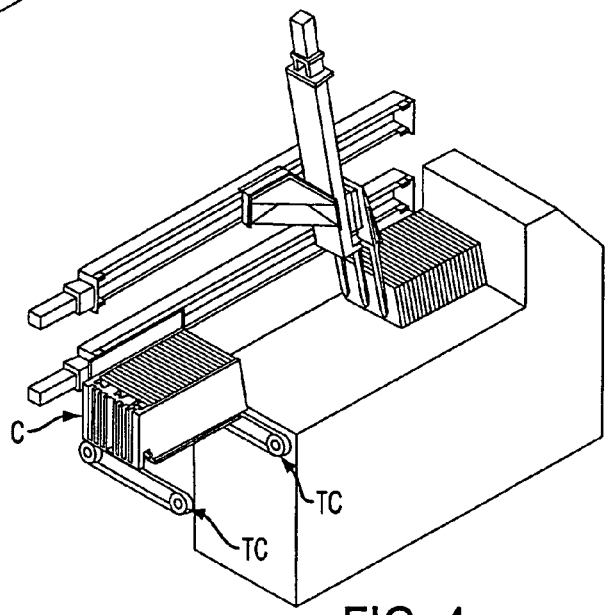
FIGS. 4-9 show an illustrative operation of an automatic feed system shown in FIG. 3.
Figure 5:
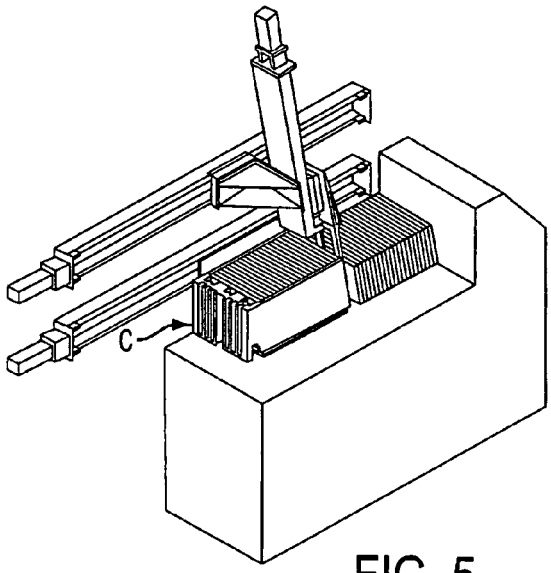
Figure 6:
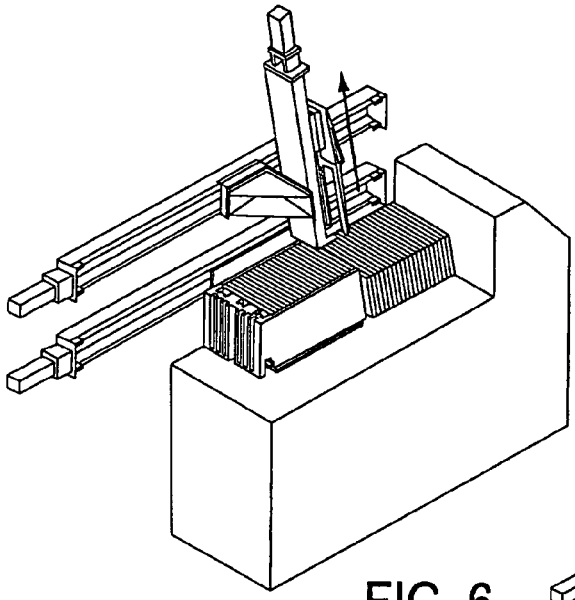
Figure 7:
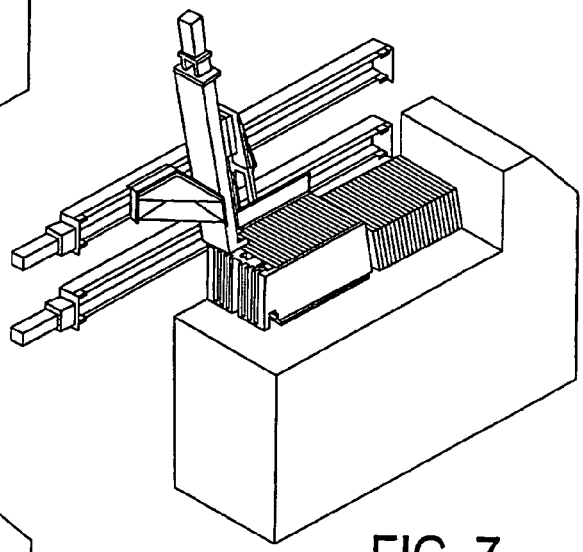
Figure 8:
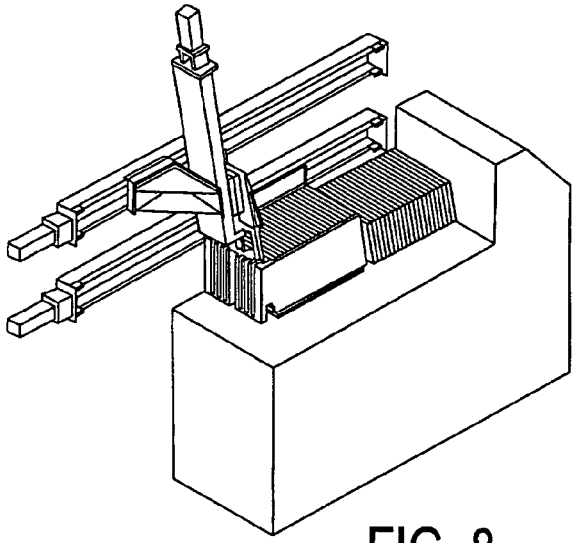
Figure 9:
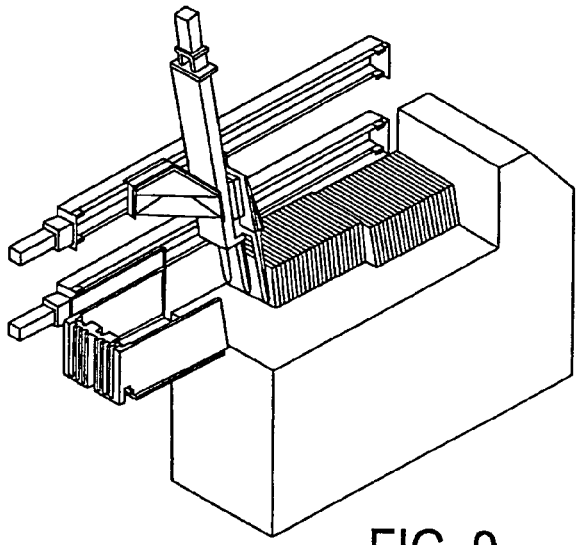

First, as shown in FIG. 4, a full carrier C is positioned on the carrier support CS (shown in FIG. 3 without a carrier loaded thereon). As described below, various carrier designs can be employed. In some preferred embodiments, carriers are configured to enable a) mail to be supported thereon and b) mail to be laterally slid off of the carrier in the direction of the destacking area. In some examples, carrier designs may or may not include covers, one or more side wall(s) and/or one or more movable side support member(s) (e.g., walls, doors, retaining members or the like) to retain the mail in a carrier C until it is unloaded onto the feeder console (e.g., proximate a back of the mail stack in process). Then, as shown in FIG. 5, the full carrier CS is conveyed to a position proximate the back of the mail stack where it is ready to be unloaded. Then, as shown in FIG. 6, the paddle is raised or retracted (i.e., in the direction of the z-axis shown in FIG. 3) from the back of the mail stack MS (i.e., so as to disengage the mail stack). Then, as shown in FIG. 7, the paddle is moved rearwardly (i.e., in the direction of the paddle x-axis shown in FIG. 3) to adjacent the rear of the mail on the carrier. During the time that the paddle moves laterally to the rear of the mail on the carrier, the carrier helps to support and maintain the orientation of the mail stack and the mail can continue to be processed. Then, as shown in FIG. 8, the paddle is lowered into the carrier to a position behind the mail thereon. In this regard, in the illustrated embodiment, the carrier preferably includes a plurality of generally vertical grooves that receive a plurality of depending fingers or tines of the paddle (e.g., providing a generally fork-shape paddle). In this manner, support of the mail can be readily transferred between the carriers and the paddle during operation. Then, as shown in FIG. 9, the carrier is moved rearwardly away from the mail stack by retracting the carrier support in the direction of the delivery axis of the carrier support shown in FIG. 3. At this time, the empty carrier can be removed and a full carrier can be loaded thereon to continue processing. For example, a transfer conveyor TC (such as, e.g., shown in FIG. 4) can laterally transfer the empty carrier C to an elevator for discharge along a return conveyor path. Then, a new full carrier C can be supplied from a supply conveyor path and can be laterally supplied to the support CS via the transfer conveyor TC.

FIG. 10(B) shows one preferred embodiment employing an elevator delivery system (which can, e.g., operate similar to the elevator delivery system shown and described with reference to FIG. 10(A)). In this illustrative embodiment, the elevator delivery system lowers a full carrier to a position proximate a rear side of the feeder. At this position, rollers upon the support 140F can move the carrier C laterally to the carrier support CS. In this embodiment, the carrier support CS is mounted so as to reciprocate along a guide G having a delivery axis in an x-direction similar to that shown in FIG. 3. In addition, as shown, if desired, a lateral conveyor mechanism TC can be integrated in the feeder console to assist in supply of full carriers upon the feeder and/or the return of empty carriers from the feeder.

Carriers

In various embodiments, the carriers 160 can have a variety of constructions (e.g., depending on the characteristics of the objects, such as, e.g., mail, to be carried). In some preferred embodiments, the carriers are made with plastic material. In some preferred embodiments, the carriers are formed by a molding process, such as, e.g., by injection molding. In some preferred embodiments, the carrier size is preferably selected so as to fit a single carrier upon the feeder console.

As described above, in some preferred embodiments, carriers are configured to enable a) mail to be supported thereon and b) mail to laterally slide off of the carrier in the direction of the destacking area. For example, some carrier designs may or may not include covers, one or more side walls and/or one or more movable side support members (e.g., walls, doors, retaining members or the like) to retain the mail in the carrier until it is unloaded onto the feeder console (e.g., proximate a back of the mail stack in process). For example, carriers can have an omitted front wall, such as, e.g., certain carriers described in the above co-pending patent applications or can include a movable front wall. In some embodiments, mail can be automatically and/or manually slid off of the carriers and onto the feeder (preferably, the mail is automatically slid off the carrier as described herein by relative movements of a paddle and a carrier support during processing, while a user can, in some instances, still manually effect such sliding)(although not detailed herein, in some embodiments, a lateral transfer slide, such as, e.g., described in the above co-pending applications can be included and/or the feeder console itself can be inclined to facilitate manual and/or automatic sliding of the mail with respect to the carrier).

While some illustrative carrier designs have been depicted and described, various embodiments of systems and methods can accommodate various embodiments of carrier designs. For example, various systems may operate with a variety of carrier types and designs.

FIGS. 11-15 show some carrier designs according to some illustrative and non-limiting embodiments. While, in some examples, carriers shown in these figures can be made with either natural or non-synthetic materials (such as, e.g., wood) or synthetic materials, in preferred embodiments, the carriers are made with molded plastics.

Figure 11A:
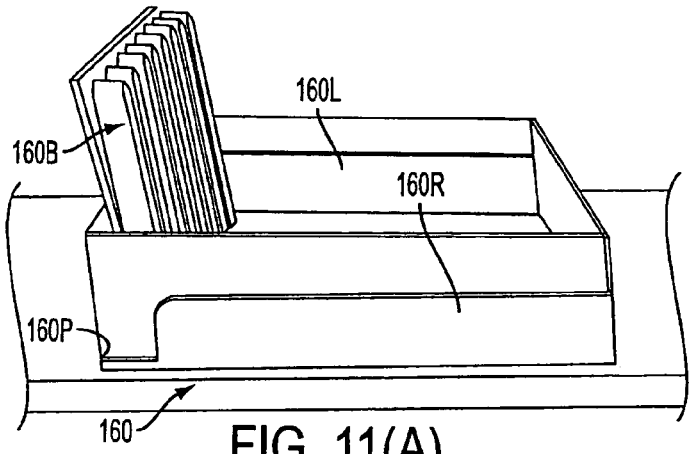
FIGS. 11(A)-11(C) show one embodiment of a carrier having a pivotally mounted front wall.
Figure 11B:
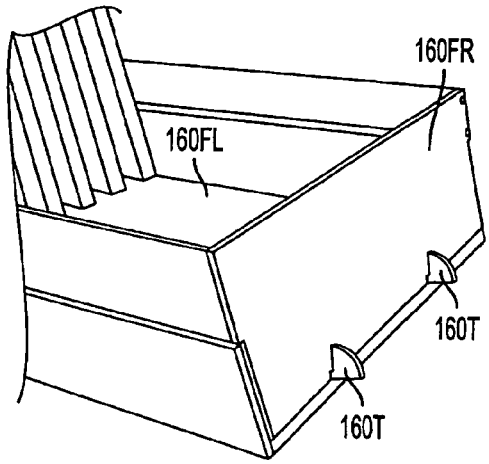
Figure 11C:
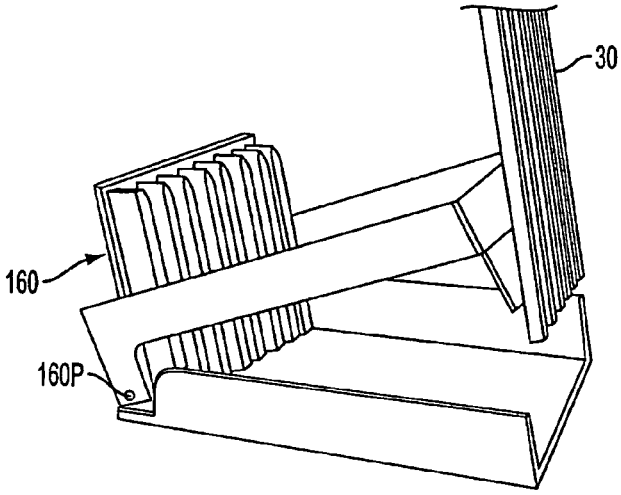

In the embodiment shown in FIGS. 11(A)-11(C), the carrier 160 includes a floor 160FL, a back wall 160B, a left wall 160L, a right wall 160R and a front wall 160FR. In this embodiment, the front wall 160FR is adapted to provide support of mail or the like contained within the carrier during handling but to be moved out of the way to facilitate removal of mail or the like (such as, e.g., removal by sliding the carrier and the mail relative to one another such that the mail is relatively moved laterally past the front of the carrier). In this illustrative embodiment, the front wall 160FR is supported so as to pivot about left-side and right-side pivots 160P. In this illustrative embodiment, the left and right walls 160L and 160R include upper portions that separate from lower portions as shown in FIG. 11(C) when pivoted.

In order to effect pivotal movement of the carrier, a variety of mechanisms can be employed. In some illustrative embodiments, the front wall 160FR of the carrier can be moved via the pusher 30. In this regard, the front wall 160FR and the pusher 30 can be adapted to include engagement members that engage together upon being brought against one another. By way of example, as shown in FIG. 11(B), one or more male protrusion can be supported along the front wall 160FR that engages with one or more respective female receptacle (such as, e.g., formed proximate the lower end of the pusher and sized to engage the male protrusions as shown in FIG. 11(C)). In various embodiments, male and female portions can be provided on either the front wall 160FR or the pusher or vise-versa. Additionally, it should be understood based on this disclosure that any other appropriate form of engagement members can be used in various other embodiments.

Figure 12:
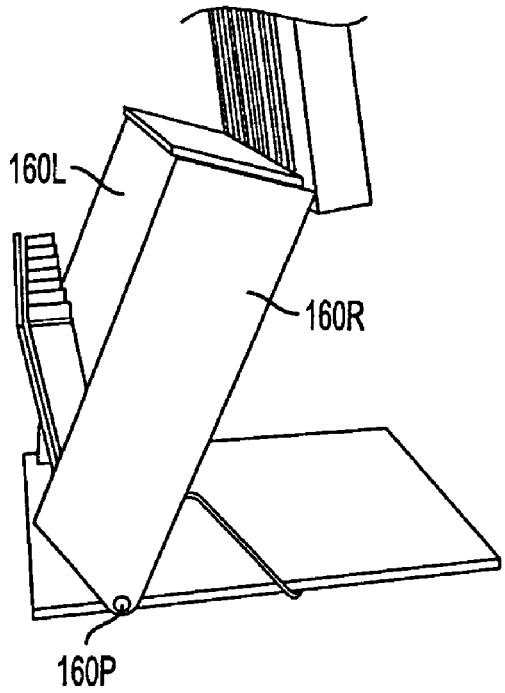
FIG. 12 shows another embodiment of a carrier having a pivotally mounted front wall.
Figure 13:
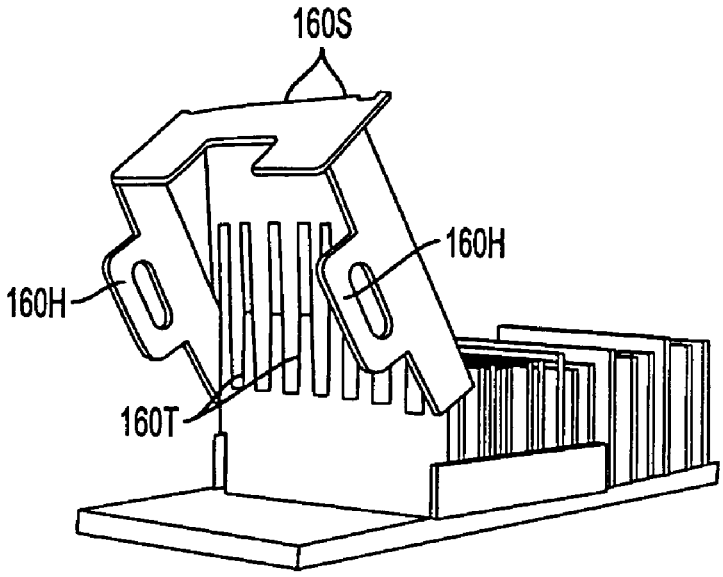
FIG. 13 shows another embodiment of a carrier having a pivotally mounted front wall.

FIGS. 12 and 13 show other illustrative carrier designs with some modifications from that shown in FIGS. 11(A)-11(C). In the embodiment shown in FIG. 12, the entire left and right sides 160L and 160R are pivoted along with the front wall 160FR. In the embodiment shown in FIG. 13, a number of modifications are employed, including: a) a plurality of handles 160H to facilitate manual handling of the carriers (in some embodiments, a latch [not shown] can be included to inhibit the front wall 160FR from pivoting to facilitate carrying—for example, the latch can be configured to release upon contact with the pusher 30); b) a plurality of upwardly extending tines 160T (rather than merely forming grooves in the rear wall); and/or c) a plurality of receptacles or recesses 160S engagable with respective protrusions on the lower end of the pusher 30. In the illustrative embodiments shown in FIGS. 11-13, the pusher 30 includes seven downwardly extending tines that fit between respective grooves and/or tines of the carriers 160. In fork-shape pusher embodiments, any number of tines can be employed, such as, by way of example, between about 3 and 10 tines in some illustrative examples.

Figure 14:
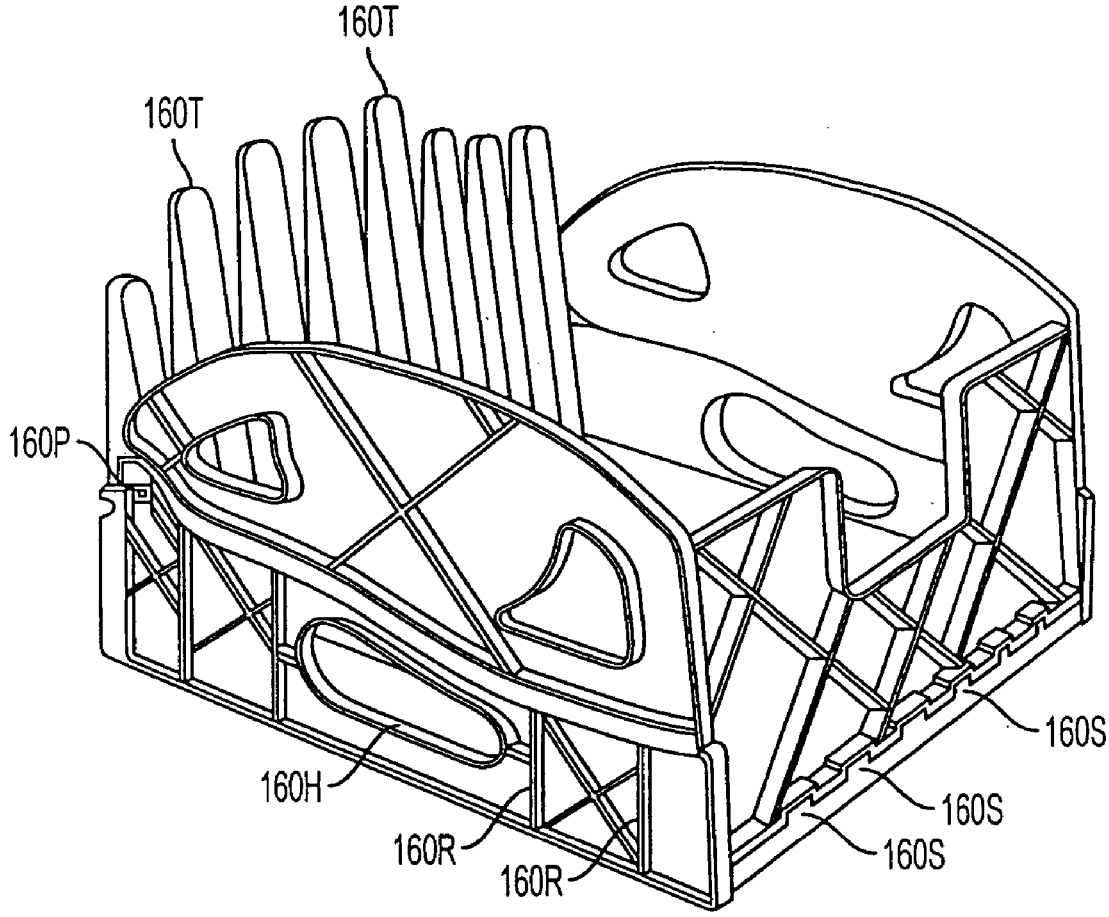
FIG. 14 is a perspective view of another embodiment of a carrier having a pivotally mounted front wall.
Figure 15:
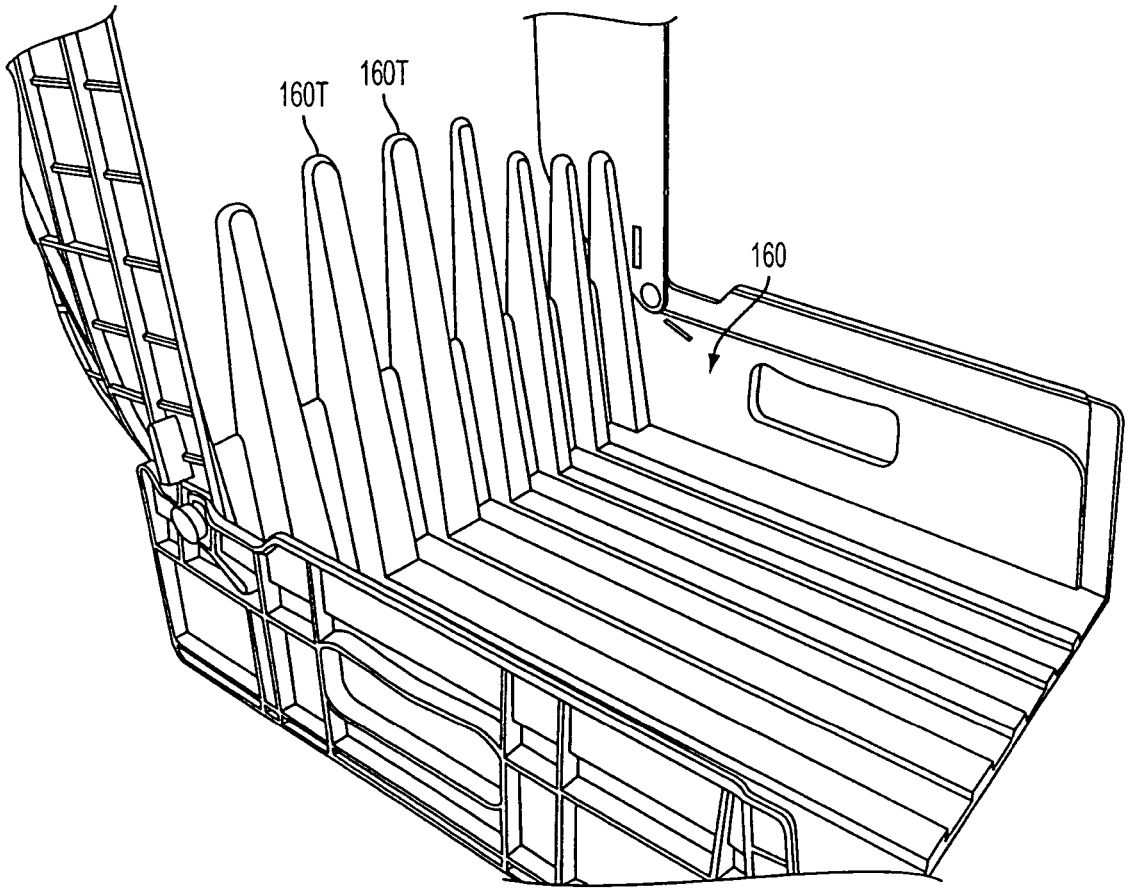
FIG. 15 is a perspective view of an embodiment of a carrier having a pivotally mounted front wall similar to that shown in FIG. 14.

FIGS. 14-15 show other illustrative carrier designs including, e.g., a plurality of upwardly extending tines 160T, a plurality of receptacles or recesses 160S engagable with respective protrusions on the lower end of the pusher 30, a plurality of handles 160H to facilitate manual handling of the carriers, an a pivotably upper section including a pivoted front wall which pivot around a pivot 160P. FIGS. 14-15 both illustrate that in some embodiments, the tines 160T may include a varied size (e.g., height). FIGS. 14-15 also both illustrate that in some embodiments, the carrier can be formed with ribs 160R to enhance strength characteristics. As shown in FIG. 15, in some embodiments, the floor of the carrier can include plurality of grooves in a fore-to-aft direction. These grooves preferably receive the ends of the tines of a pusher 30 so that the tines extend very close to or beneath a top surface of the bottom of the carrier.

The operation of the carriers 160 shown in FIGS. 11-15 can be generally alike in some embodiments, such as for example: a) first, a full carrier (note: objects within the carriers are omitted in the figures) can be in a closed state such as, e.g., shown in FIG. 11(A); b) second, the full carrier can be brought against the lower ends of the tines of the pusher so as to engage with respective engagement mechanisms (e.g. receptacles, protrusions and/or the like); c) third, the pusher can be raised such as, e.g., described above with reference to FIG. 6 (such that as shown, e.g., in FIG. 11(C) the front wall 160FR is moved away); d) fourth, the pusher continues to move the wall rearward as it traverses from a position similar to that described above with reference to FIG. 6 to a position similar to that described above with reference to FIG. 7 (see, e.g., FIG. 12 showing an approximately midway position and FIG. 13 showing a substantially fully open position); e) fifth, with the carrier fully open, the pusher descends to engage the rear of the mail, such as, e.g., shown in FIG. 13 (showing the tines in a lowered position); f) sixth, once the tines of the pusher are in a fully lowered position, the carrier can be moved laterally to the left so as to slide the mail off of the carrier; g) seventh, when the carrier and the mail is separated, the carrier is caused to pivot back to a closed position (such as, e.g., using another mechanism to cause the carrier to close [such as, e.g., an abutment mechanism and/or springs {such as, for example, using springs like that shown in FIGS. 12-13}]). Thereafter, the carriers can be returned and/or further handled, such as, e.g., returned to the system in accordance with embodiments described herein.

Bundled-Mail Embodiments

Figure 16:
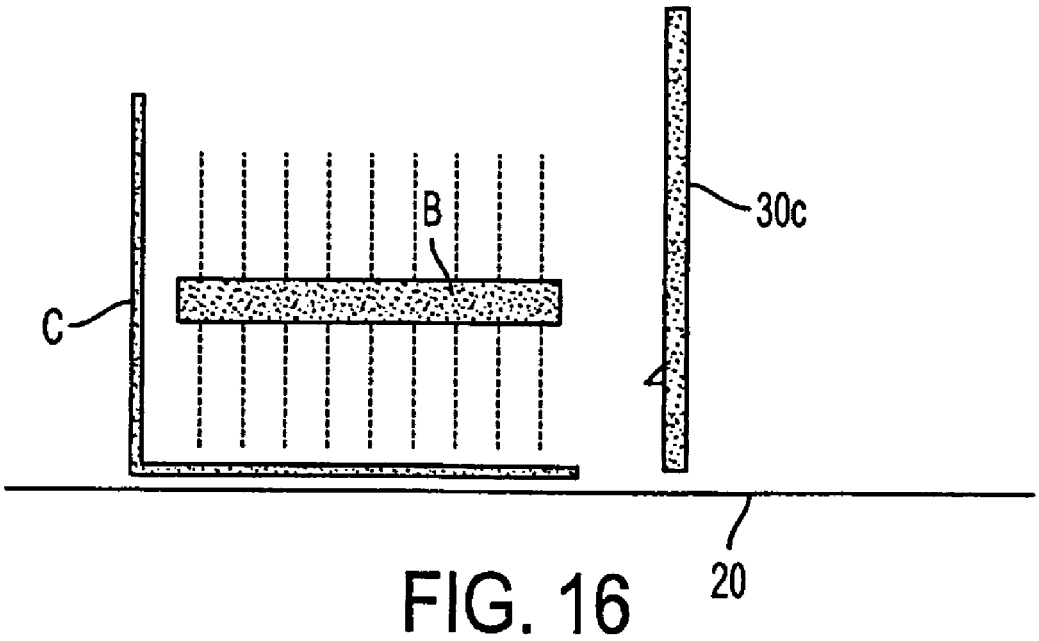
FIG. 16 is a schematic side view of an illustrative bundled mail embodiment.

While in some preferred embodiments, the mail is delivered to the feeder in a non-bundled state, in some preferred embodiments, the mail can be delivered in a bundled state, such as, e.g., as shown in FIG. 16. In this illustrative embodiment, the mail (shown in dotted lines) includes a strap B or the like wrapped around it to create a bundle of mail. In some embodiments, this strap could actually be placed on the mail by a preparation operator OpP or the like to facilitate handling of the mail being automatically fed at the feeder. In some embodiments, an automatic cutter is employed to cut the straps. In some embodiments, a modified pusher 30*c* can be provided that includes a cutter c located proximate a lower end thereof. In this manner, the pusher can preferably cut the straps during operation (such as, e.g., when removed from the mail stack). In some embodiments, the cut straps can be automatically removed and/or an operator can assist in the removal of such straps. In some embodiments, straps B could be employed instead of having carriers with front retaining walls. That is, the straps can be used to support the mail during transport in some embodiments.

Slump Inhibiting Embodiments

Figure 17:
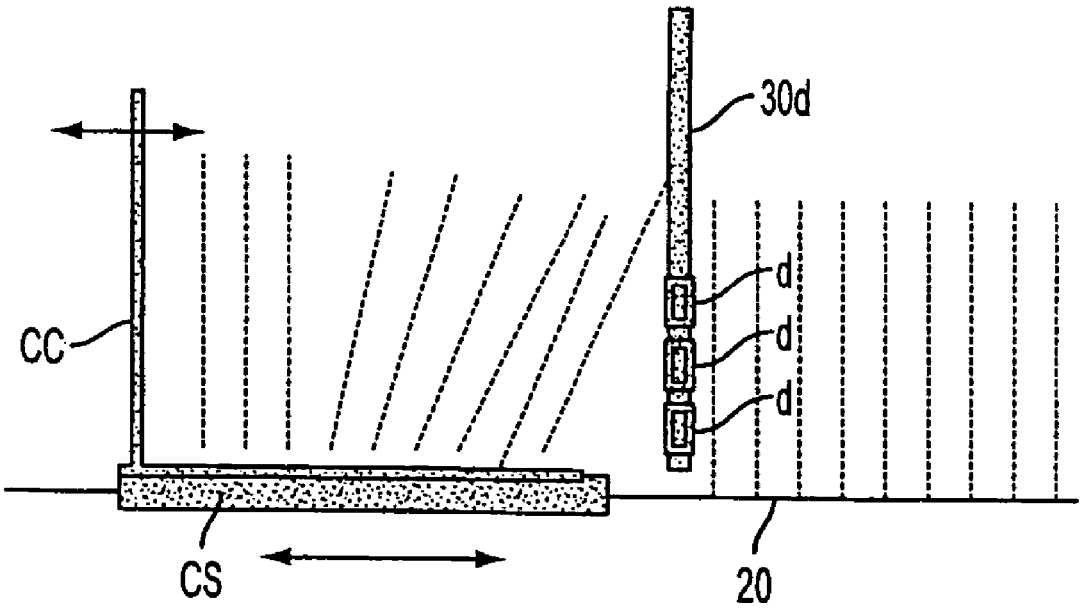
FIG. 17 is a schematic side view of some illustrative embodiments for inhibiting slump.

FIG. 17 illustrates features that can be employed in some illustrative embodiments. In this regard, a modified pusher 30*d* can be employed that includes sensors or detectors d on a rear side (e.g., facing a new stack of mail on a carrier CC to be added to the existing mail stack in process on the transporter 20). The sensors or detectors preferably include a plurality of sensors, but could potentially include a single sensor or detector. A variety of sensors or detectors could be used, such as, e.g., pressure sensors, proximity sensors and/or various other sensors or detectors.

Among other things, the detectors d can be used to help reduce forward and/or backward slump of mail that can occur in the event that excess space is present in the carrier CC. For example, upon the simultaneous removal of a carrier front wall and lifting of the pusher, excess space can result in slumped mail (see, e.g., illustrative slump shown in FIG. 17).

In some preferred embodiments, the front wall is moved, removed or not present prior to removal of the pusher. Then, when mail slumps against the pusher, the carrier C position can be adjusted (or other means can be employed, such as, e.g., another pusher [not shown]) to move the mail towards the pusher to reduce or remove the slump in the mail. In the illustrated embodiment, sensors or detectors d can be used to determine when the mail is properly positioned against the pusher (such as, e.g., when an even pressure is applied against the rear of the pusher). While detectors or the like can be provided on the pusher, it is contemplated that detectors can be located in a variety of other locations as desired. Additionally, in some embodiments, the mail can be moved forward until a particular torque or force characteristic is achieved (e.g., based on experiment or the like, a torque value, a change in torque, and/or a force value on a drive mechanism [such as, e.g., a servo-motor or the like] can be used to identify proper mail orientation). In some embodiments, as illustrated in FIG. 17, a carrier CC can include a mechanism to enable relative movement between a rear wall (e.g., to push the mail stack on the carrier) and mail supporting surface (e.g., such as a floor of the carrier) as a carrier support CS is moved towards the pusher to accommodate for excess space in the carrier. In some embodiments, another pusher (not shown) could be used to push mail out of the carrier towards the pusher 30*d*.

Removable Door Embodiments

In some embodiments, rather than pivoting away from the carrier and/or otherwise being movably attached to the carrier, a front wall of the carrier can be entirely detachable or removable. In such embodiments, a mechanism is preferably provided to a) replace the door upon the same carrier it was removed from (such as, e.g., prior to returning the empty carrier) or b) forwarding the removable door to a common return location for replacement on other carriers. In some embodiments, the doors can be manually removed and/or replaced. However, in preferred embodiments, the doors would be automatically removed and/or replaced.

In some preferred embodiments, the removable doors can have dimensions within a range of mail being processed by the feeder (such as, e.g., comparable to flats mail sizes) and/or within a range capable of being handled by the mail processing equipment. For example, in some embodiments, a substantially planar door CRD (shown in FIG. 18) can be supported in grooves on left, bottom and right sides of the carrier and a mechanism can be provided to release the door from the carrier (such as, e.g., upon contacting the pusher or other member).

Figure 18:
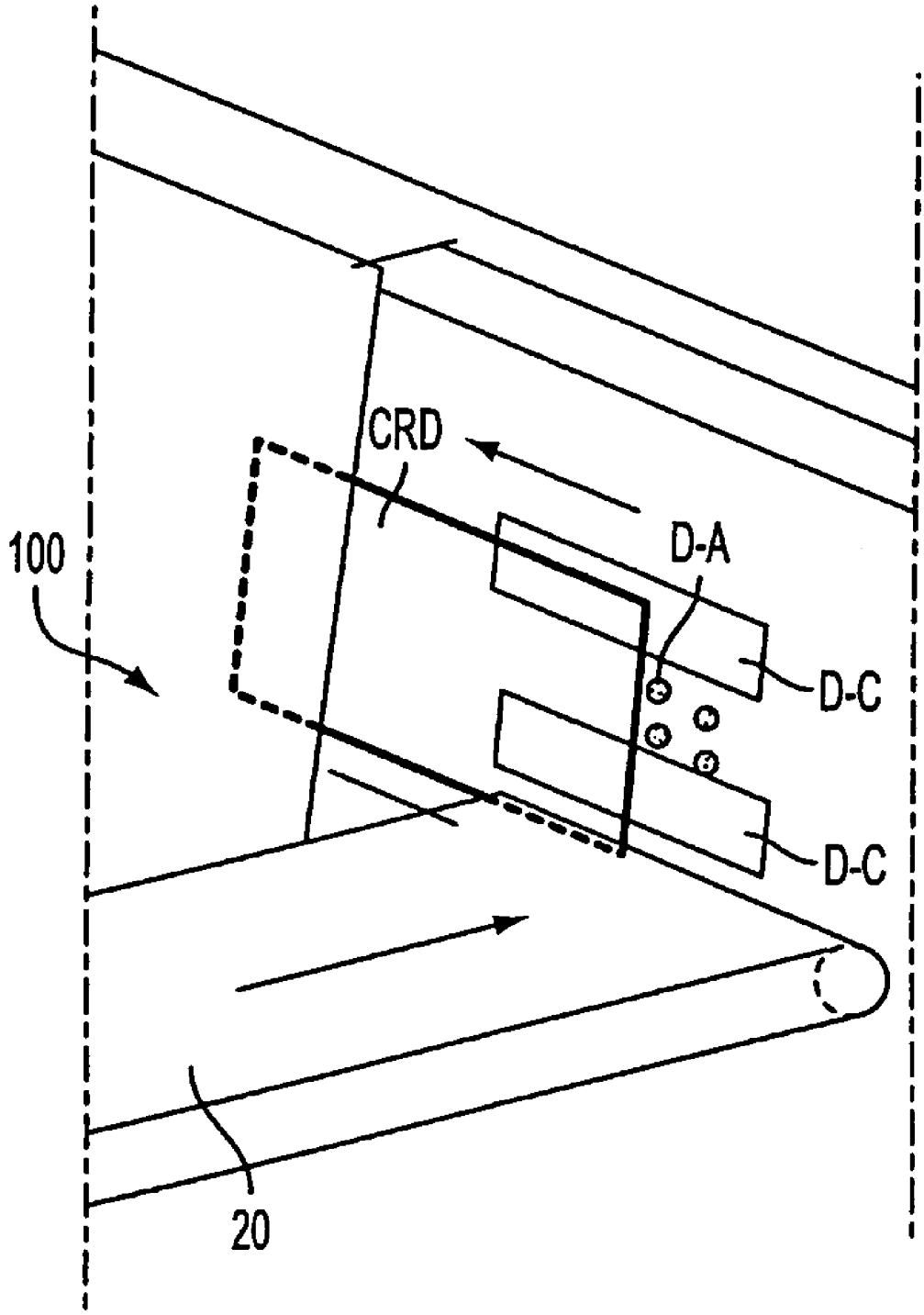
FIG. 18 is a perspective view of a portion of a system with a removable carrier door upon an illustrative destacker.

In some preferred embodiments, the released door can be supported within the side-by-side mail stack on the feeder (e.g., along with other mail in the mail stack). Then, the carrier release door CRD can preferably be singulated or destacked at a destacker. For example, FIG. 18 illustrates an illustrative carrier release door CRD after entry into an illustrative and non-limiting destacker. In this illustrative and non-limiting example, the destacker includes one or more lateral conveyors D-C and may include suction ports D-A to apply intermittent suction to items (e.g., mail) to be singulated or destacked. In this illustrative and non-limiting embodiment, the singulated items are laterally conveyed (see arrow pointing left). Once the carrier release door CRD is removed and delivered via the destacker, the door CRD can preferably be conveyed via the mail processing system to a particular location for automatic and/or manual replacement onto carriers. For example, in some embodiments, the doors can be automatically replaced onto carriers prior to a preparation operator's filling of the carriers. In some embodiments, the preparation operators can themselves manually replace the removable doors. In some embodiments, the doors can include bar coding or the like to enable scanning and/or other identification of the doors within the system (e.g., using existing address reading equipment).

Figure 19A:
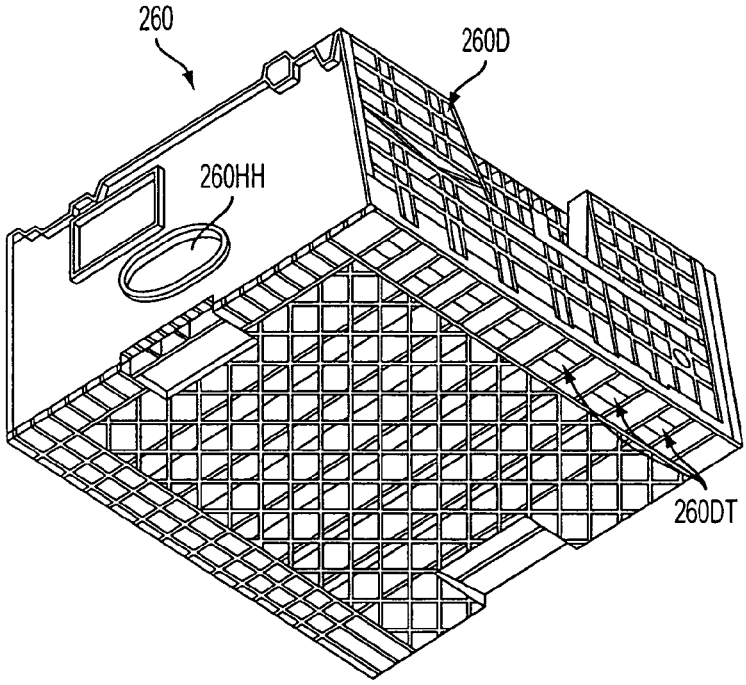
FIG. 19(A) is a bottom perspective view showing a carrier employing a removable door 260C.
Figure 19B:
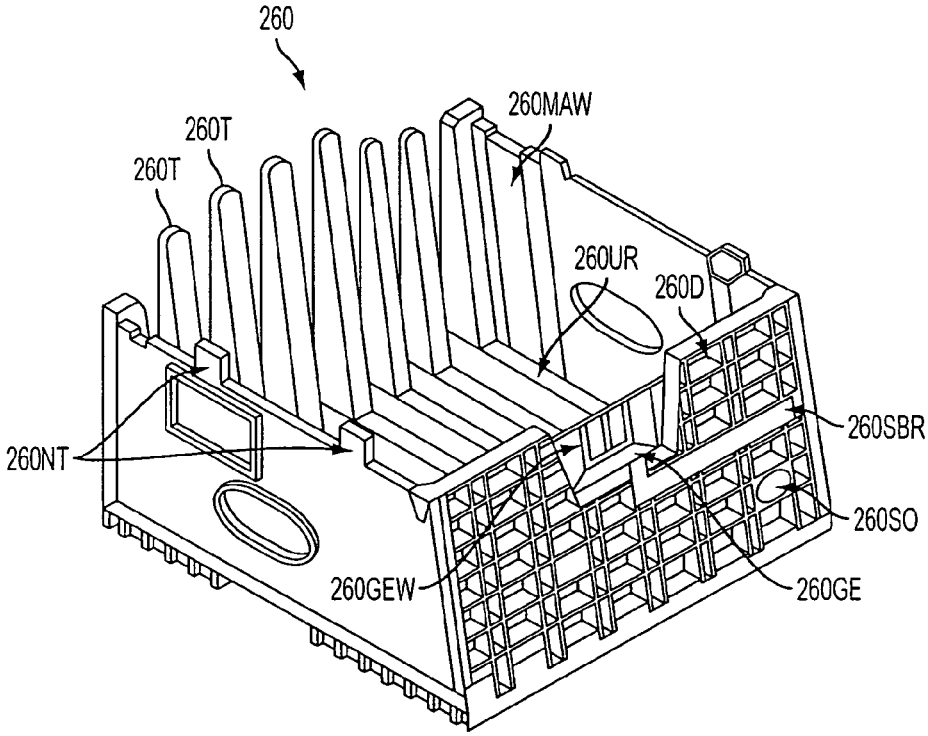
FIG. 19(B) is a top perspective view of the carrier shown in FIG. 19(A)
Figure 19C:
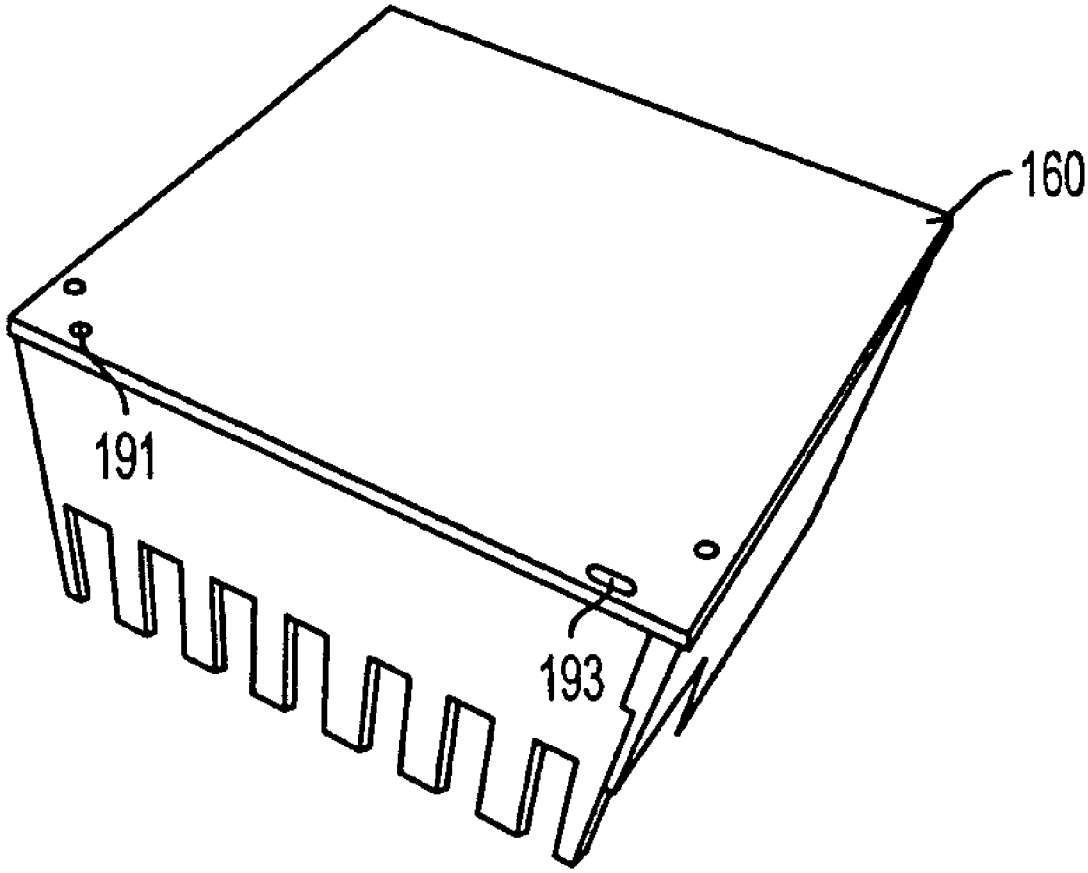
FIG. 19(C) is a bottom perspective view showing an illustrative carrier having a position registration mechanism.
Figure 20A:
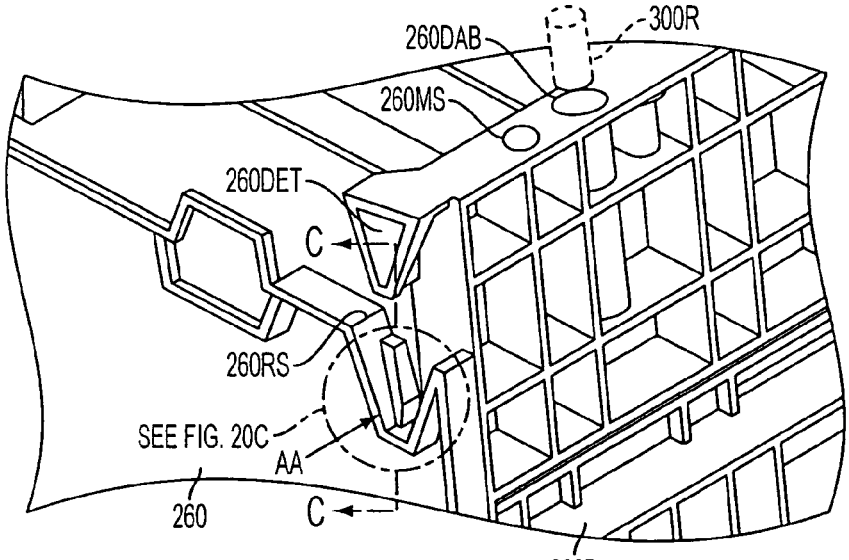
FIG. 20(A) is a top perspective view of an upper portion of the carrier shown in FIG. 19(A) with the carrier door in a partially inserted position in the carrier.
Figure 20B:
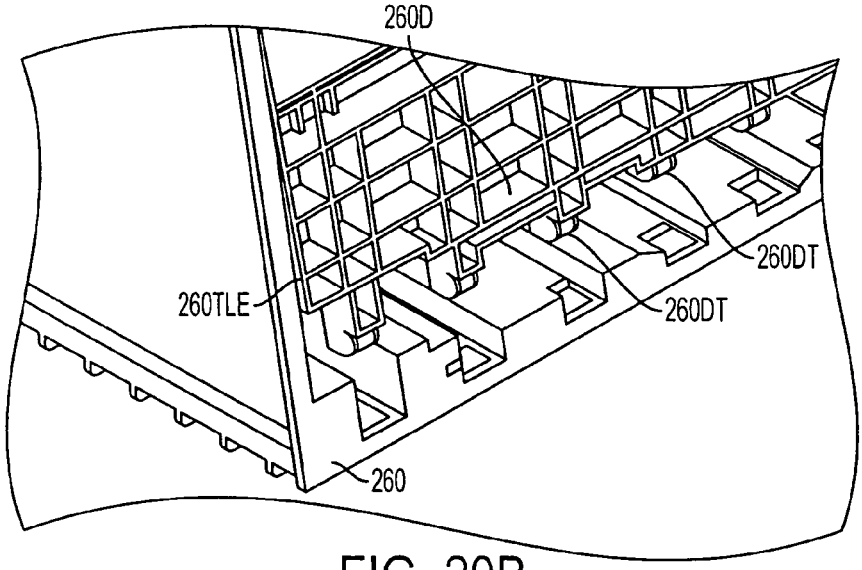
FIG. 20(B) is a top perspective view of a lower portion of the carrier shown in FIG. 19(A) with the carrier door in a partially inserted position in the carrier.
Figure 20C:
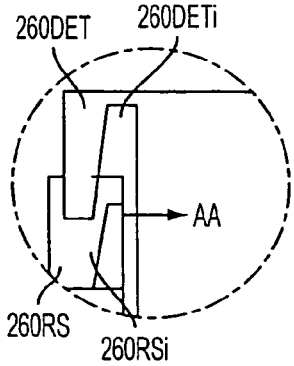
FIG. 20(C) is a schematic cross-sectional view taken in the vicinity of the arrows C-C in FIG. 20(A) depicting the interrelationship between a dog-ear-tab on the carrier door and a receiving slot in a side wall of the carrier.
Figure 21:
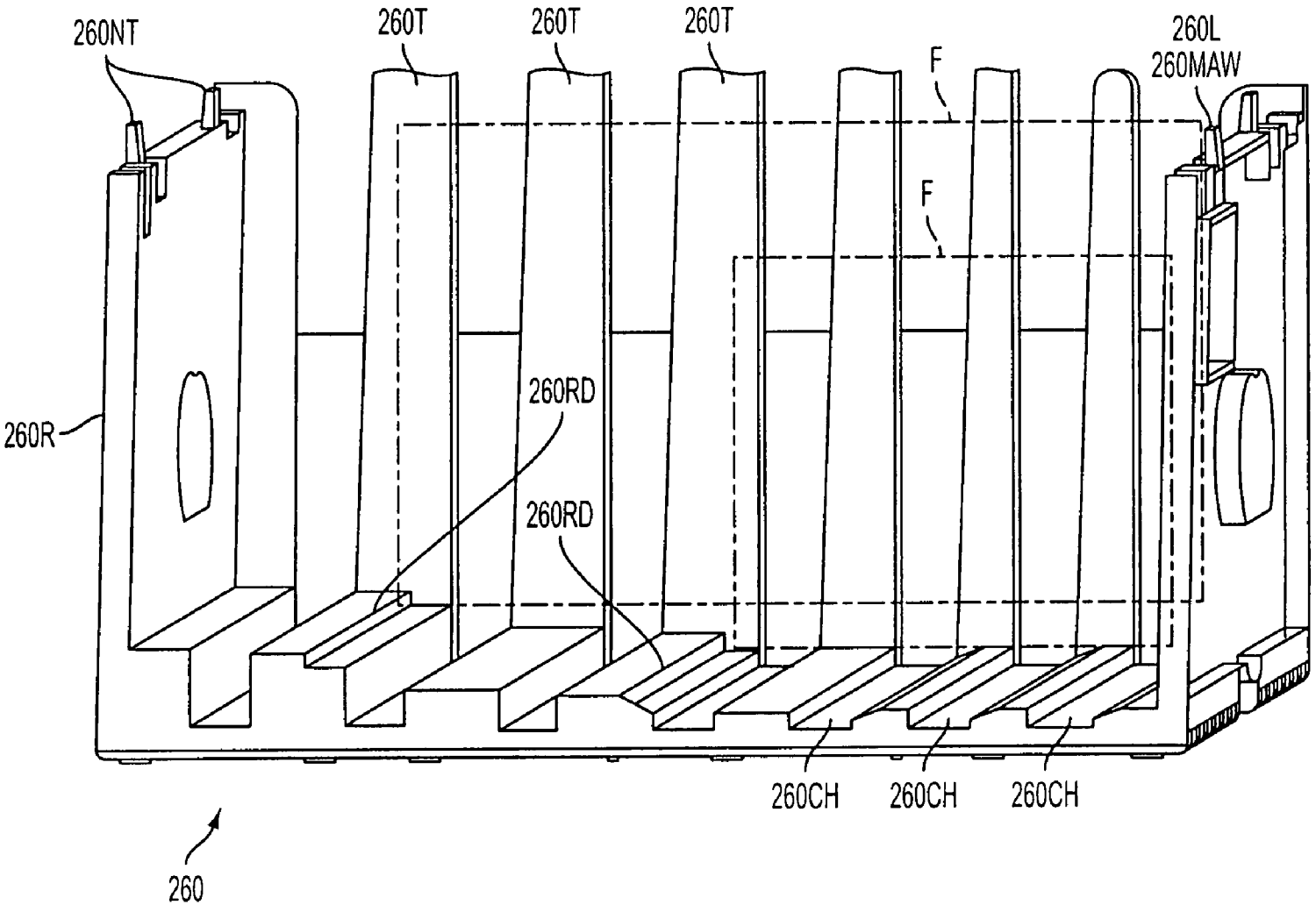
FIG. 21 is a front view of a carrier 260 that is generally similar to, but having a number of variations as shown, to the carrier shown in FIG. 19(A) with a door 260D removed.
Figure 22:
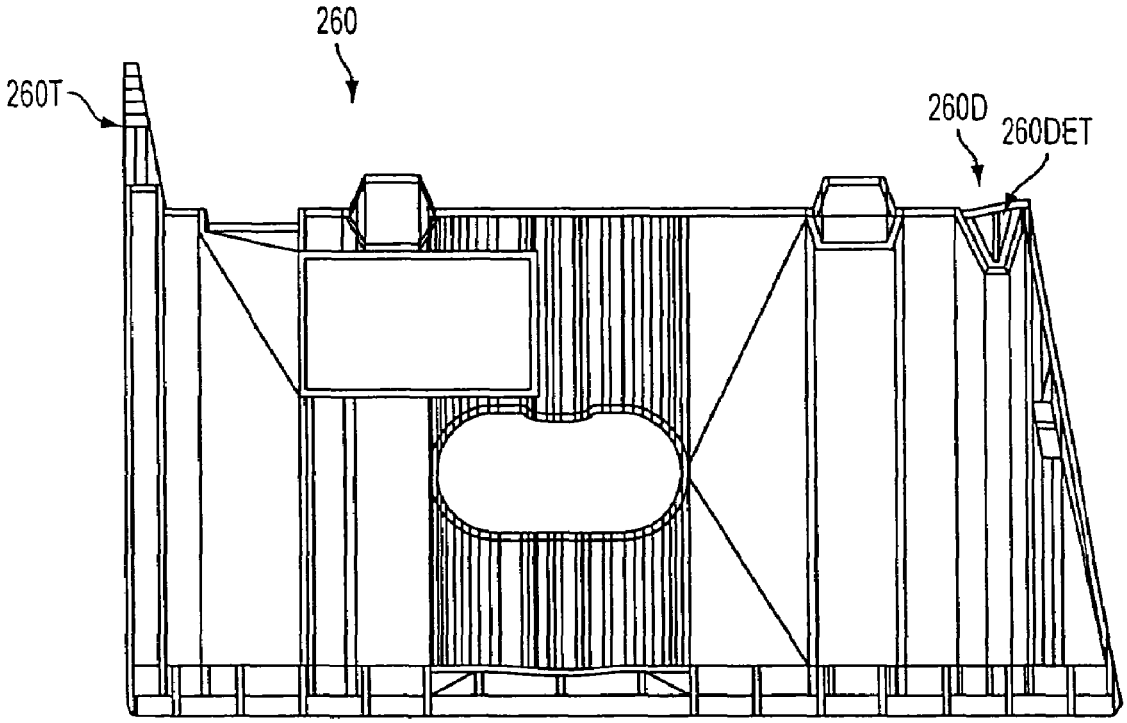
FIG. 22 is a side view of a carrier 260 that is generally similar to the carrier shown in FIG. 19(A)
Figure 23:
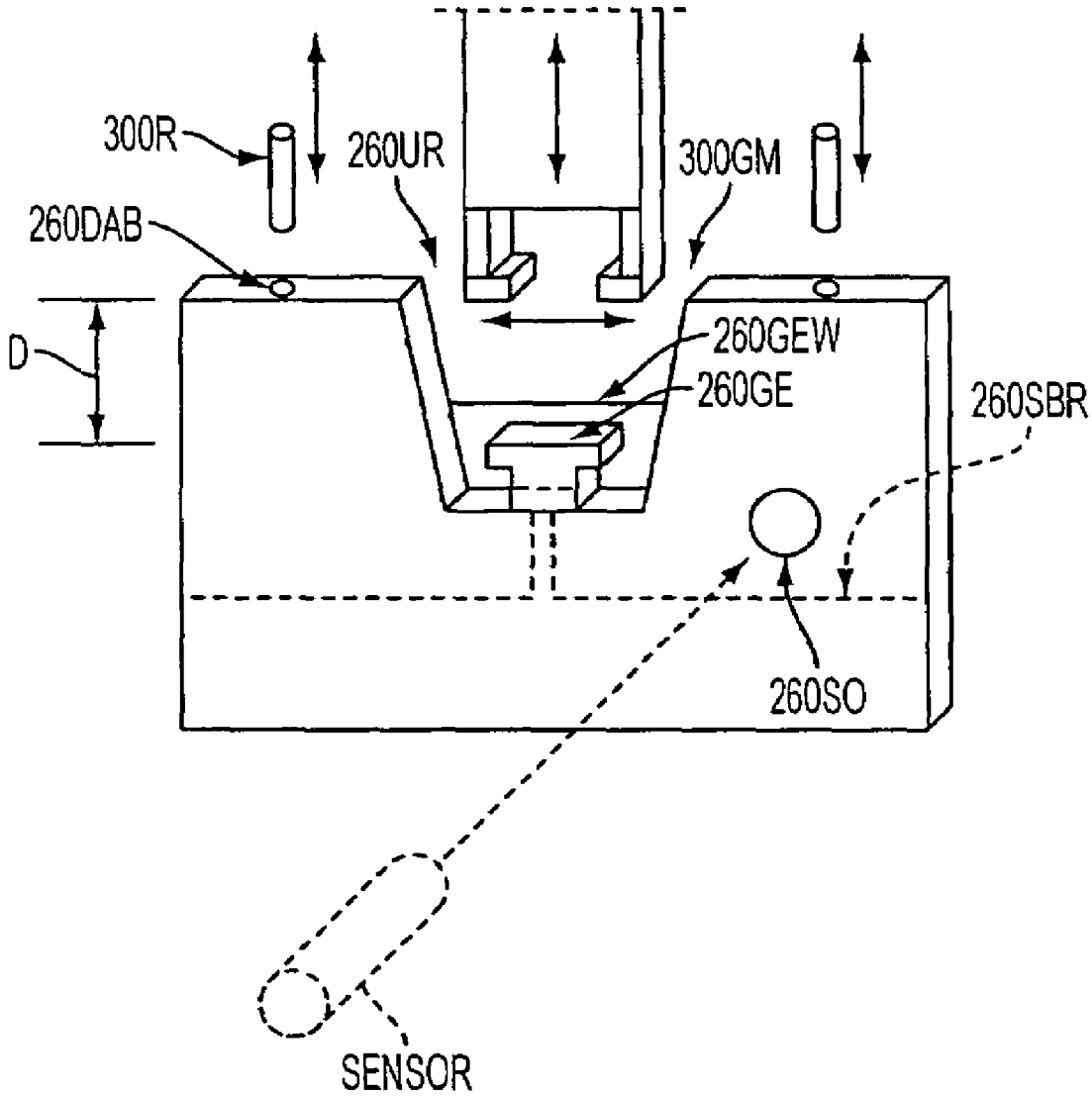
FIG. 23 is a schematic diagram depicting the operational relationship between a carrier door 260D and a reciprocating grabbing mechanism in some illustrative embodiments.

FIGS. 19-24(K) show some preferred embodiments in which a carrier employs a removable door. In this regard, FIG. 19(A) is a bottom perspective view showing a carrier employing a removable door 260C. FIG. 19(B) is a top perspective view of the carrier shown in FIG. 19(A). FIG. 19(C) is a bottom view of an illustrative embodiment of a position registration mechanism that may be employed in the embodiment shown in FIG. 19(A) and/or in various other embodiments. FIG. 20(A) is a top perspective view of an upper portion of the carrier shown in FIG. 19(A) with the carrier door 260D in a partially inserted position in the carrier 260. FIG. 20(B) is a top perspective view of a lower portion of the carrier shown in FIG. 19(A) with the carrier door 260D in a partially inserted position in the carrier 260. FIG. 20(C) is a schematic cross-sectional view taken in the vicinity of the arrows C-C in FIG. 20(A) depicting the interrelationship between a dog-ear-tab on the carrier door and a receiving slot in a side wall of the carrier. FIG. 21 is a front view of a carrier 260 that is generally similar to, but having a number of variations as shown, to the carrier shown in FIG. 19(A) with a door 260D removed. FIG. 22 is a side view of a carrier 260 that is generally similar to the carrier shown in FIG. 19(A). FIG. 23 is a schematic diagram depicting the operational relationship between a carrier door 260D and a reciprocating grabbing mechanism in some illustrative embodiments. And, FIGS. 24(A)-24(M) are a plurality of views of an automatic induction system configured to operate with a carrier 260 similar to that shown in FIG. 19(A) at various stages of operation.

With reference to FIGS. 19(A) and 19(B), the carrier 260 can be substantially similar to carriers 160 described above. In preferred embodiments, the carriers 260 include one or more, preferably all, of the following unique features.

1. Removable Door Structure a. Releasable Latch Mechanism

As shown in FIG. 19(B), in some embodiments, a releasable latch mechanism is provided that includes a spring biased rod 260SBR, as shown. Preferably, the spring biased rod is normally biased so as to have an tip end thereof extending outwardly from a side of the door 260D, such as to be receivable within a respective receiving slot (not shown) in the carrier side walls. As shown, the spring biased rod 260SBR is preferably configured to be gripped along with the gripping of the gripping element 260GE, such as, e.g., being substantially L-shaped in some embodiments as shown. Although one illustrative spring biased rod 260SBR is shown, in some embodiments two such rods can be implemented at opposite sides of the door, such as, e.g., shown in dashed lines in FIG. 23.

Preferably, the latch mechanism does not provide substantial structural support for the door 260D on the carrier 260, but merely operates to retain the door 260D thereon, such that the latch mechanism will be relatively free from external forces that may otherwise damage the latch mechanism.

b. Alignment Bores and Sensor Studs

As best shown in FIG. 20(A), the top edge of the door 260D preferably includes a plurality (such as, e.g., two in some embodiments) of alignment bores 260DAB that are adapted to receive projection rods 300R that are supported alongside the pusher 300 and/or the gripping mechanism 300GM (discussed below) so as to help maintain the orientation of the door 260D with respect to the pusher 300 and/or the gripping mechanism 300GM. Preferably, the top of the door 260D also includes at least one detection member, such as, e.g., at least one metal stud 260MS, to facilitate sensing by a sensor mechanism so as to enable the pusher 300 and/or the gripping mechanism 300GM to be located properly with respect to the door 260D.

c. Gripping Element

As shown in FIG. 19(B), the door 260D preferably includes a gripping element 260GE that is configured to be readily gripped by a gripping mechanism within the automatic induction apparatus, such as, e.g., using a gripping mechanism 300GM as shown in FIG. 23. As shown in FIGS. 19(B) and 23, in some preferred embodiments, the gripping element is generally T-shaped, such that a gripping mechanism can readily engage the T-shaped gripping element. The gripping mechanism shown in FIG. 23 is merely illustrative and any appropriate gripping mechanism components, such as, e.g., clamps, teeth, arms, wrench-like grippers, and/or the like can be employed in various embodiments. As shown, in some preferred embodiments, the gripping element 260GE is displaced a distance D from an upper end of the door 260D. Among other things, this displacement helps to inhibit rotational displacement of the door 260D during operation, such as, e.g., to maintain a desired angle of the door 260D. In some preferred embodiments, the pusher 300 is at an angle of about 75 to 85 degrees, or more preferably, about 80 degrees from vertical, with such orientation having been determined to advantageously facilitate separation at a destacker downstream of the pusher.

As best shown in FIGS. 19(B) and 23, the door 260D preferably includes an upper recess 260UR inside of which the gripping element 260GE is preferably located. In some preferred embodiments, a thin protective wall 260GEW is provided within at least a portion of the recess, such as, e.g., adjacent the gripping element 260GE such that the gripping mechanism 300GM can be shielded from the flats upon the carrier 260 so as to avoid inadvertently snagging, gripping and/or otherwise interfering with mail on the carrier.

d. Tapered Bottom

In some embodiments, the outside edges of the door 260D are slightly tapered to facilitate insertion within the carrier, such as, e.g., by including tapered lateral edges 260TLE as shown in FIG. 20(B).

e. Dog-Ear-Connection Tabs

In some preferred embodiments, the outside edges of the door 260D include Dog-Ear-Connection Tabs 260DET, such as, e.g., shown in FIG. 20(A). In the preferred embodiments, the Dog-Ear-Connection Tabs 260DET help to secure and maintain the door 260D on the carrier 260. Preferably, the Dog-Ear-Connection Tabs 260DET include a plurality of inclined or tapered surfaces that a) facilitate insertion of the Dog-Ear-Connection Tabs into respective receiving sockets 260RS (e.g., due to a wider entry opening upon initial insertion) and b) draw the side walls of the carrier 260 inward to the side edges of the door 260D (e.g., due to a wide entry opening and inclined edges on the receiving slot and/or Dog-Ear-Connection Tabs that draw the side walls inward in the direction of the arrow AA shown in FIG. 20(A)). For reference, FIG. 20(C) illustrates how the inclined surface 260DETi of the Dog-Ear-Connection Tab can interact with an inclined surface 260RSi of the receiving socket so as to cause the wall of the carrier to move in the direction of the arrow AA upon insertion of the tab into the socket.

f. Bottom Locating Teeth

As best shown in FIGS. 19(A) and 20(B), the carrier door 260D preferably includes a plurality of bottom locating teeth 260DT that are received within receiving holes in the floor of the carrier 260. Preferably, the locating teeth are tapered slightly or include a chamfer to facilitate insertion into the receiving holes.

g. Sensing Opening

As best shown in FIGS. 19(B) and 23, in some preferred embodiments, the carrier door 260D includes a sensing opening 260SO through which the position of the mail or the like contents thereon can be sensed. Specifically, in some embodiments, the carrier can be positioned with the rear wall of the carrier in a downward position, such that mail flats or the like rest against the rear wall, whereby in this state, a sensor can sense the distance to the top of the mail flats or the like through the sensing opening 260SO. In this manner, the amount of mail flats or the like located within the carrier 260 can be well determined, with the mail flats or the like laying closely adjacent one another due to the weight thereof.

Figure 10D:
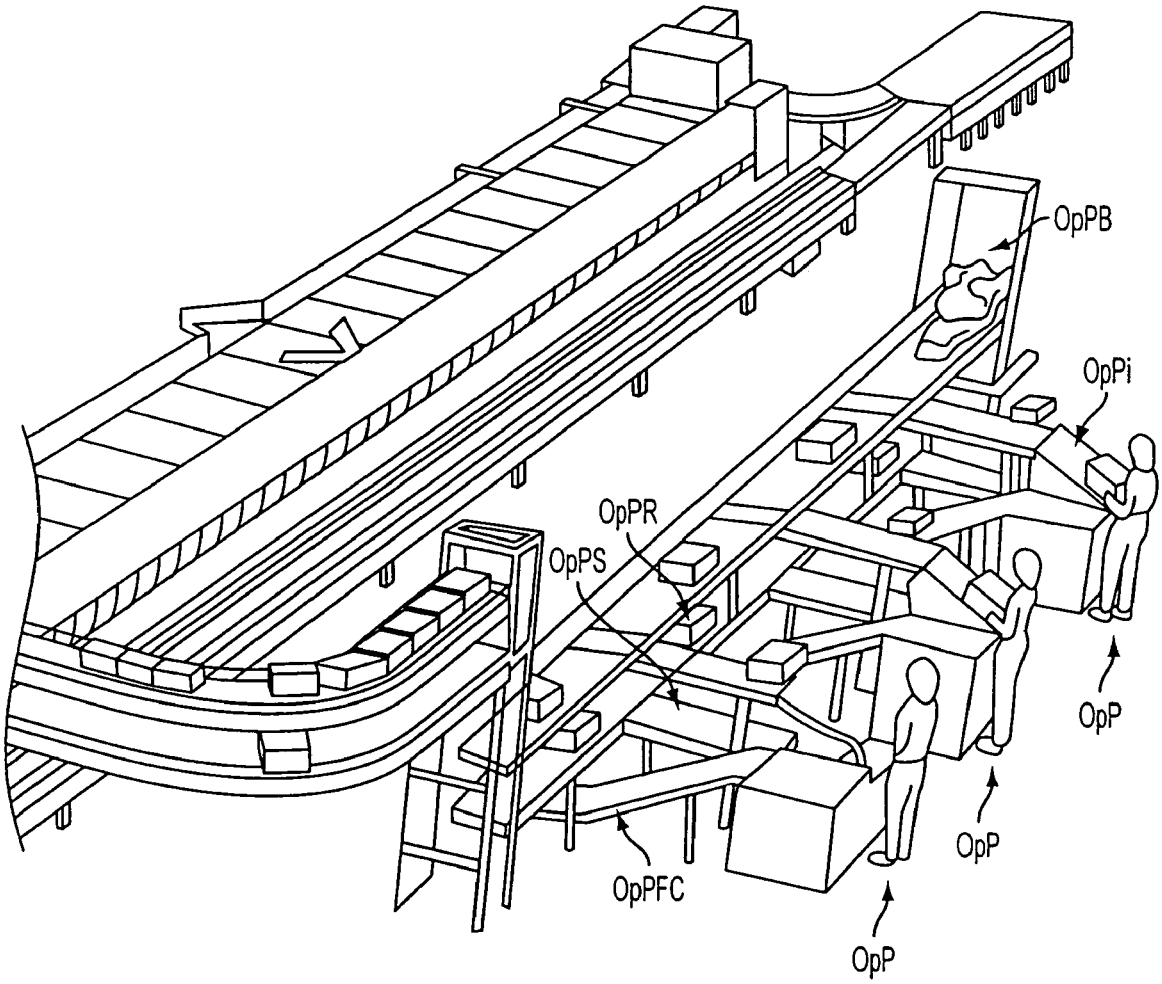
FIG. 10(D) is an enlarged view of the preparation operator section shown in FIG. 10(C)

With reference to FIG. 10(D), in some preferred embodiments, mail flats can be sensed at a point in time during the operation of a system when an carrier is positioned at an operator preparation station, such as, e.g., shown at OpP in FIG. 10(B). In this regard, FIG. 10(D) shows an operator preparation station OpP, including an empty carrier return conveyor OpPR, which can be used to direct carriers 260 to the inclined ramp OpPi. In some embodiments, the empty carrier located on the inclined ramp can be manually filled with mail flats or the like. In some embodiments, bundled or debundled mail flats can be delivered to a lower conveyor from a hamper or bin OpPB and conveyed up to a position adjacent the preparation operator via a flats conveyor OpPFC. After the preparation operator fills the empty carrier 260 with the flats, a sensor (such as, e.g., sensor 260S shown schematically in FIG. 23) can be used to sense the amount of flats on the carrier via the sensing opening 260SO. In this regard, the carrier is preferably located on the inclined ramp OpPi with the rear wall of the carrier in a downward position. In some embodiments, as shown in FIG. 10(D), when a full carrier is to be delivered from the preparation operator station, the inclined ramp OpPi can be pivoted so as to tilt downward such as to enable delivery of the full carrier to the supply conveyor OpPS (see, e.g., leftmost ramp OpPi shown in FIG. 10(D)). Then, the inclined ramp can be raised to receive another empty carrier to repeat the operation.

In various embodiments, the sensor(s) employed can include any appropriate sensor(s) as now or later known in the art, such as, e.g., any distance measuring sensor, including, e.g., ultrasonic sensors, laser sensors, pressure sensors and/or the like.

2. Floor Structure a. Grooves i. Friction Reduction and Tin Receiving

In the preferred embodiments, the floor of the carrier 260 includes a plurality of grooves configured to receive the ends of tines 300T of the pusher 300. Among other things, in this manner, the tines can surely extend to the bottom or below the bottom edge of the flats on the carrier so as to surely push the mail with respect to the carrier without mail slipping between the tines 300T and the carrier floor. In addition, the provision of such grooves also helps to reduce friction between the carrier floor and the flats thereon.

ii. Motion-Inhibiting Steps or Ridges

In the preferred embodiments, the floor of the carrier includes a plurality of stepped-up ridges 260RD extending in a fore-to-aft direction as best seen in FIG. 21. Preferably, the locations of the stepped-up ridges are selected to be at locations slightly farther from the mail alignment wall 260MAW than an outer edge of common-size mail (see, e.g., illustrative mail flats F shown in dashed lines in FIG. 21). In this manner, while mail is located on the carrier, during transport along the conveyors, etc., the mail or flats located thereon will be retained in a consistent position upon the carriers without sliding laterally within the carrier. In some illustrative embodiments, the ridges 260RD can extend upward a height of about ⅛ to ¼ of an inch, or, more preferably, about 3/16 of an inch.

iii. Insertion Facilitating Chamfers

In some preferred embodiments, the sides of the ridges between the floor grooves facing the right side wall 260R of the carrier 260 can include an incline or chamfer as shown in FIG. 21. Among other things, the inclusion of such inclines or chamfers can facilitate placement of the flats within the carrier by the operator. For example, upon locating flats within the carrier, such an incline or chamfer can help to inhibit snagging of a bottom corner of the flats or mail as the operator places the flats or mail on the carrier floor and slides it towards the mail alignment mall 260MAW (NB: in the illustrated and non-limiting exemplary embodiments, the mail alignment wall 2260MAW is the left wall 260L)

b. Viewing Holes

In some preferred embodiments, the bottom of the carrier can also include a plurality of through holes therein so as to enable operators and other persons to visually observe whether such a carrier is full or empty from a location beneath the carrier (such as, e.g., when the carrier is on an overhead conveyor or upon an elevator). By way of example, in some embodiments, a plurality of holes (such as, e.g., about four or so holes in some cases) could be distributed within the bottom, having diameters of about ½ to 1½ inches to enable visual observation. In some embodiments, rather than or in addition to visual observation, such holes could also be used to accommodate for automatically sensing the presence or absence of flats thereon, such as, e.g., using sensors.

c. Position Registration Mechanism

FIG. 19(C) illustrates another preferred embodiment of the carrier 260, wherein the carrier contains a position registration mechanism. As shown in the example of FIG. 19(C), the registration mechanism can be implemented by providing location holes 191, location slots 193, or any combination thereof, in the bottom surface of the carrier 260. The position registration mechanism is registered with a corresponding position registration mechanism on the carrier support bracket CS (see, e.g., FIGS. 3, 10(B) and 24(A)).

According to one preferred embodiment as shown, one hole 191 and one slot 193 are provided near an edge of the bottom surface of the carrier, with corresponding locating pins being provided on the carrier support bracket CS. However, the mechanisms could be placed at various locations on the carrier to achieve the desired attributes. One such attribute is to ensure proper alignment and positioning of the carrier on the carrier support CS (see FIGS. 3, 10(B) and 24(A)), so that the forked or tined paddle 30 (see FIGS. 11(C), 13 and 24(L)) may properly interface with the grooved and/or tined surface of the carrier 160/260 as shown in FIGS. 13 and 24(L). Another desired characteristic is to provide a positive engagement force between the carrier and the carrier support bracket to ensure that the force generated during the retraction step of the feeder load cycle (e.g., as shown in FIGS. 9 and 24(M)) is transferred to the carrier. In a preferred embodiment, the locating pins that mate to the position registration holes/slots are tapered. The taper facilitates proper location of the carrier on the carrier support bracket as the carrier is lowered or otherwise brought into contact with the carrier support bracket. The locating pins and vertical walls of the carrier support bracket act together to ensure proper positioning of the carrier in the x-y direction. Use of a slot allows the retracting force for the carrier to be more evenly distributed. According to one preferred embodiment as shown in, a hole/slot combination is provided as the slot allows for greater machine tolerance, and a second hole is not required for proper position registration of the carrier with respect to the paddle.

3. Rear Wall a. Tines 260T

The Tines 260T are preferably configured to support the mail therein, while at the same time allowing the pusher 300 to pass behind a stack of mail flats on the carrier 260. The Tines 260T distal from the mail-alignment wall 260MAW are, in some embodiments, substantially wider and longer than the times 260T adjacent the mail-alignment wall 260MAW. In this manner, smaller mail, such as, e.g., smaller letters, etc., located adjacent the mail alignment wall 260MAW (such as, e.g., by the prep operator OpP at preparation operator locations) may have a narrower spacing, and the size of the tines 300T of the pusher 300 at locations adjacent smaller mail can be commensurately reduced so as to enable the smaller mail to be well supported by a plurality of tines 300T during use. As shown in FIG. 19(B), in some embodiments, the height of the narrower tines 260T at the right side of FIG. 19(B) can be reduced slightly, such as, e.g., to reduce materials used, and to avoid creating handle-like projections that users may be compelled to improperly use to manually lift the carrier.

As shown in FIG. 19(B), the forward sides of the tines 260T along the rear wall are preferably inclined at an angle that is the same or substantially the same as the angle of the pusher 300 so as to support the mail in the carrier at the same or substantially the same angle as the pusher 300.

4. Side Walls a. Hand Holds

In preferred embodiments, the side walls 260L and 260R each include respective hand holds, such as, e.g., through holes 260HH shown in FIG. 19(A). Among other things, in preferred embodiments, operators will only or will substantially only carry or manipulate the containers via the hand holds so as to avoid inadvertently damaging other portions of the containers (NB: as described herein, the tines 260T are preferably either too wide [at the left side of FIG. 19(B)] and/or too short [e.g., at the right side of FIG. 19(B)] to be conducive to use as handles for average operators).

b. Nesting Tabs

In some preferred embodiments, the carrier 260 includes a plurality of nesting tabs 260NT on left and right lateral side walls 260L and 260R of the carrier. In some preferred embodiments, the nesting tabs 260NT of a first carrier can be nested with similar nesting tabs of a second carrier that is located thereover in an inverted state. As shown, e.g., in FIGS. 19(B) and 21, the two fore and aft nesting tabs are preferably oppositely inclined, such as to enable similar nesting tabs on another similar carrier to nest therewith. In this manner, the two carriers can together form a substantially cube-shape combined structure, which substantially cube-shaped structures can be readily stacked upon one another for storage. Notably, the irregular wall structures of the carrier 260 in the illustrated preferred embodiments may not facilitate having carriers nested in a bottom-on-top relationships (i.e., in which all carriers are nested in a similar orientation). Nevertheless, in some alternative embodiments, the carriers could be nested together in a bottom-on-top relationship (i.e., in which the tops of the carriers, or the nesting tabs of the carriers, are received within the bottoms of similar carriers).

Automatic Induction Apparatus

As described above, FIGS. 24(A) to 24(M) show a plurality of views of an illustrative automatic induction system configured to operate with a carrier 260 similar to that shown in FIG. 19(A) at various stages of operation. FIGS. 24(A) to 24(M) show some of the illustrative sequential steps during operation of the system.

Figure 24A:
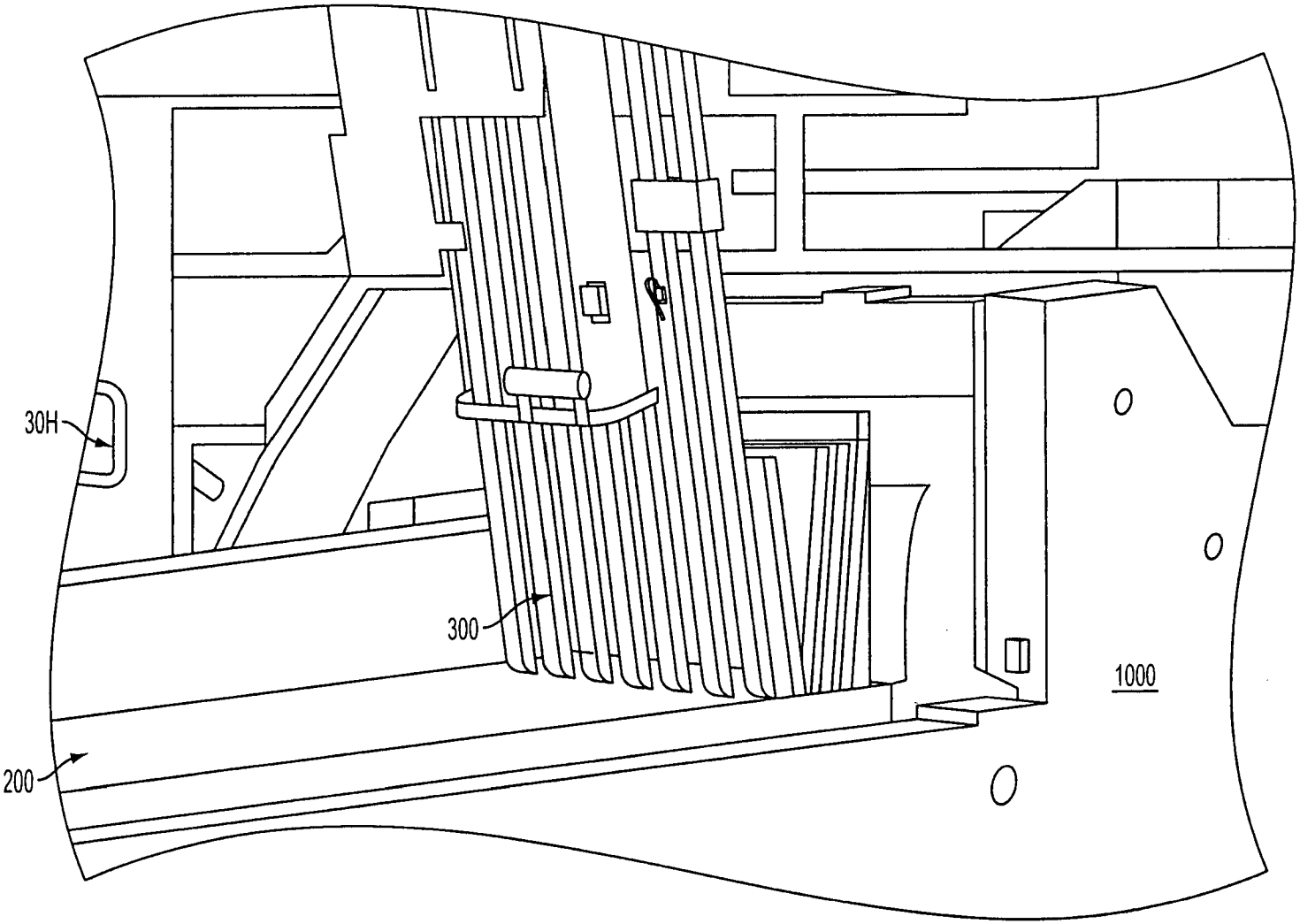
FIGS. 24(A)-24(M) are a plurality of views of an automatic induction system configured to operate with a carrier 260 similar to that shown in FIG. 19(A) at various stages of operation.

In this regard, FIG. 24(A) shows the automatic induction system with a pusher 300 located behind a stack of flats F upon a conveyor 200 of a feeder 1000.

Figure 24B:
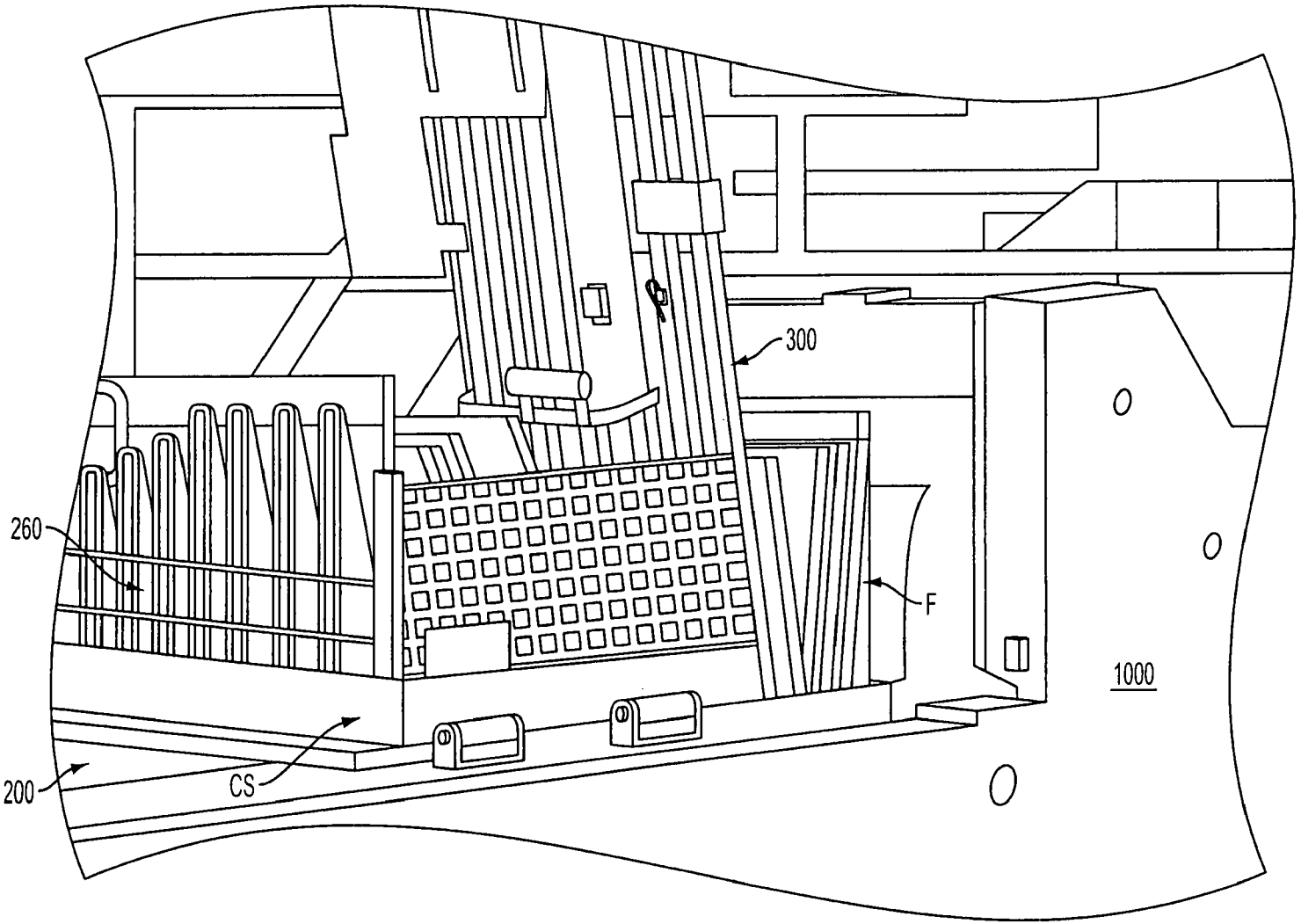

FIG. 24(B) shows a subsequent stage in operation, following that shown in FIG. 24(A), with a full carrier 260, supported on a carrier support CS is positioned adjacent the rear of the pusher 300.

Figure 24C:
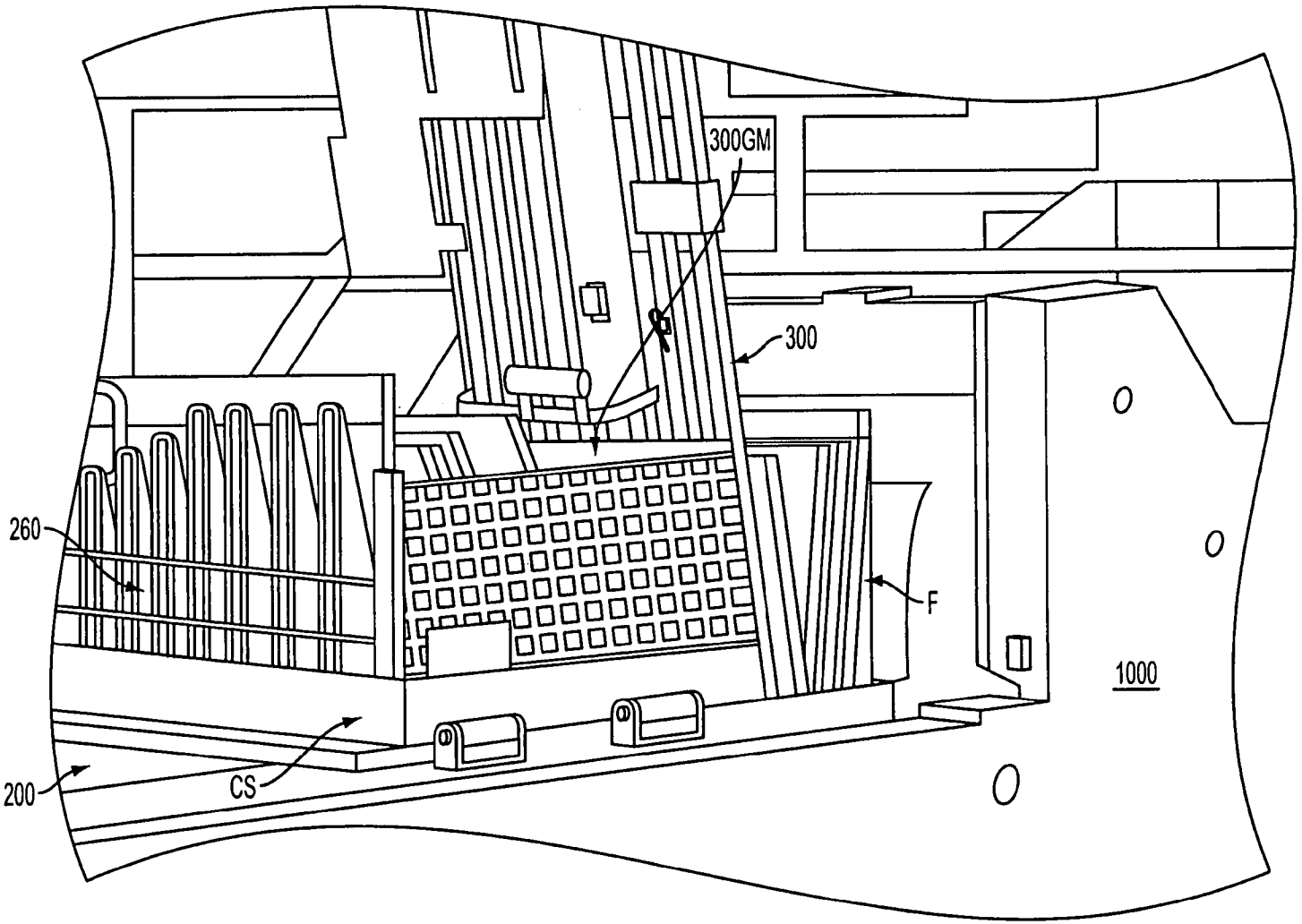

FIG. 24(C) shows a subsequent stage in operation in which the full carrier has been moved laterally by the carrier support CS over the conveyor 200 at substantially the same rate as the pusher 300 and the gripping mechanism 300GM has engaged a gripping element on the door 260D and has begun to retract the same, which retraction preferably occurs substantially parallel to the angle of incline of the pusher 300 and door 260D (NB: the rate of the pusher is preferably substantially equal to the rate of the conveyor 200 for the mostpart, with some variance as described herein).

Figure 24D:
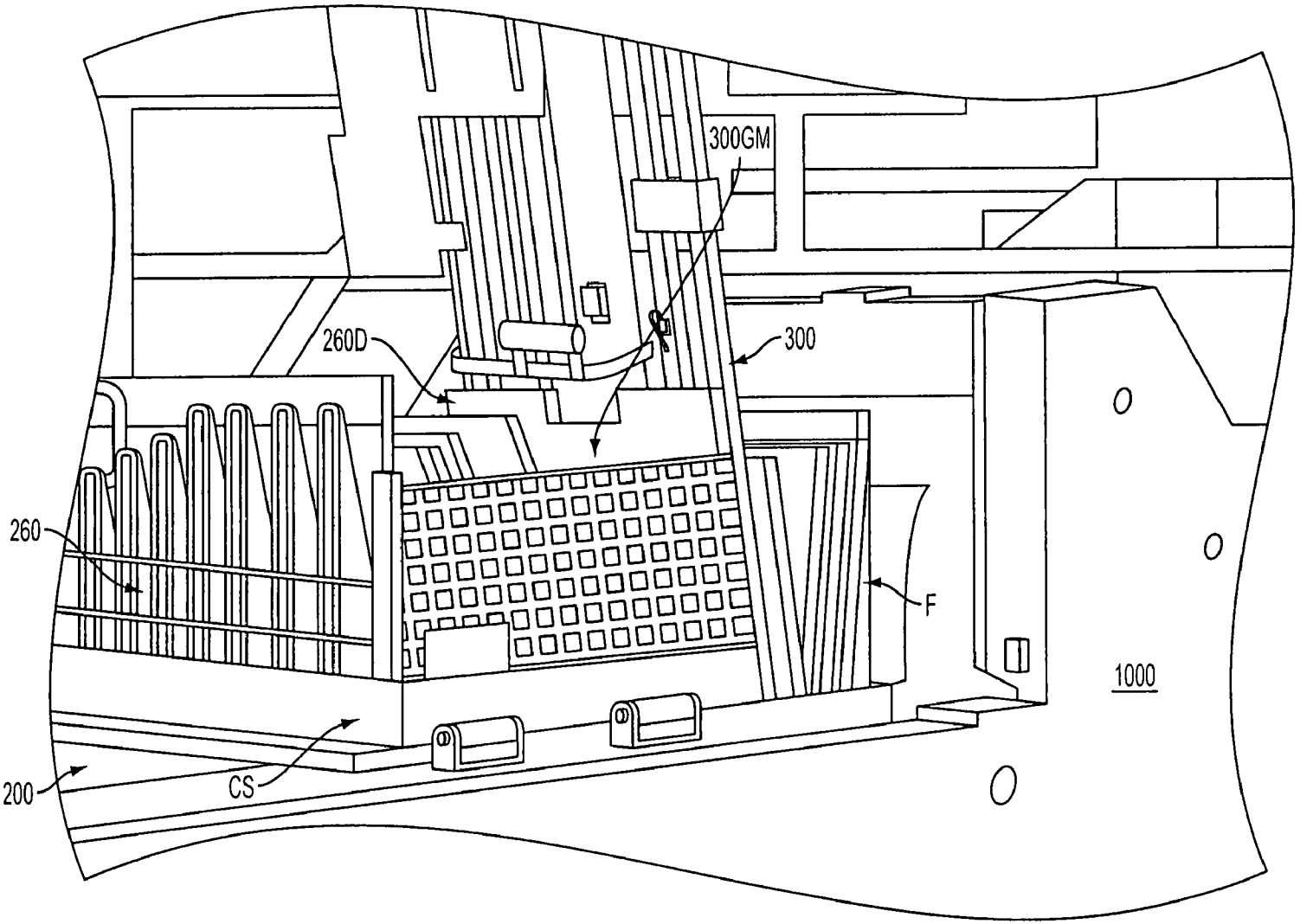

FIG. 24(D) shows a subsequent stage in operation in which the gripping mechanism 300GM has raised the door 260D a greater extent.

Figure 24E:
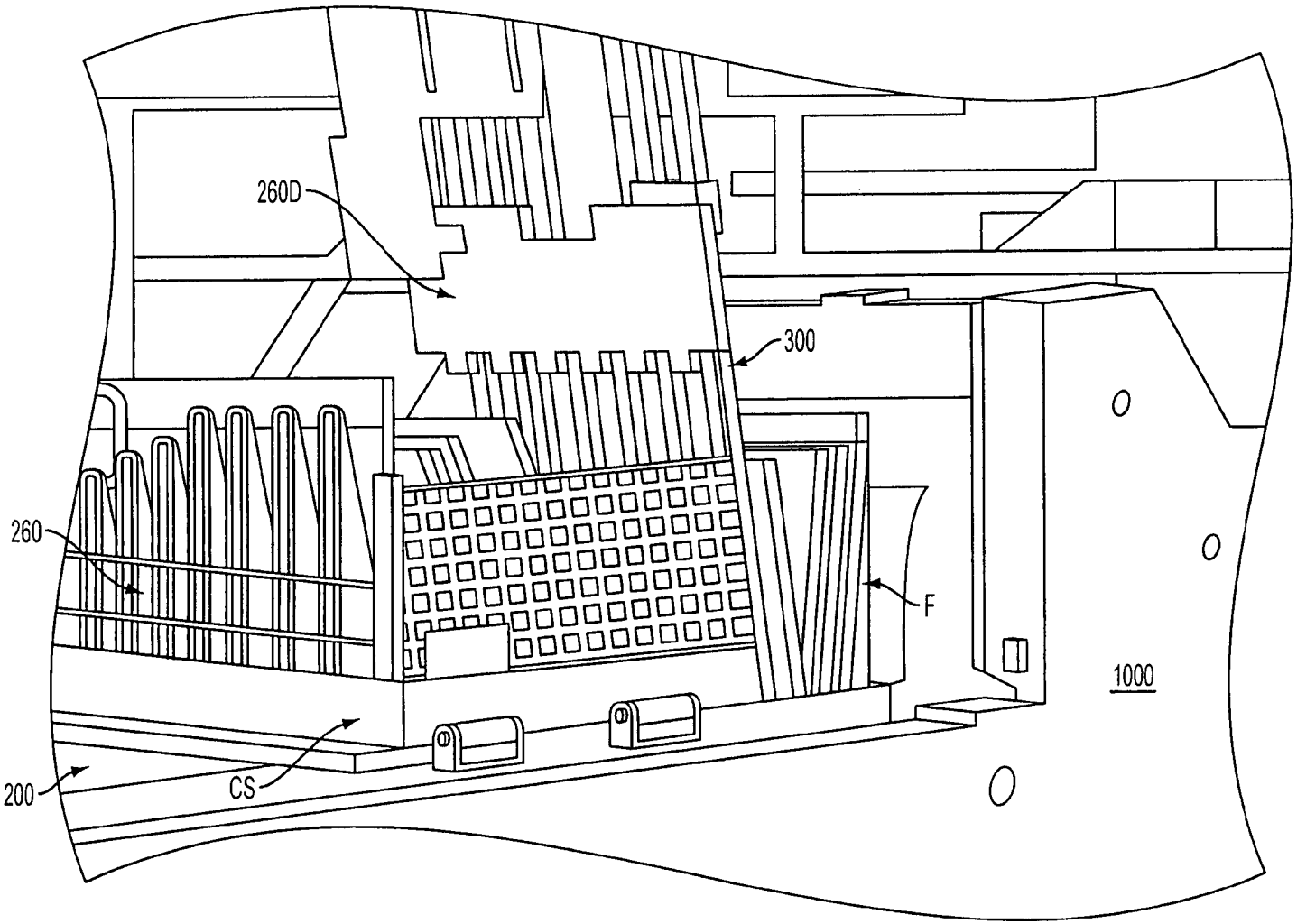

FIG. 24(E) shows a subsequent stage in operation in which the door 260D has been fully removed, but the pusher 300 still remains in front of the carrier.

Figure 24F:
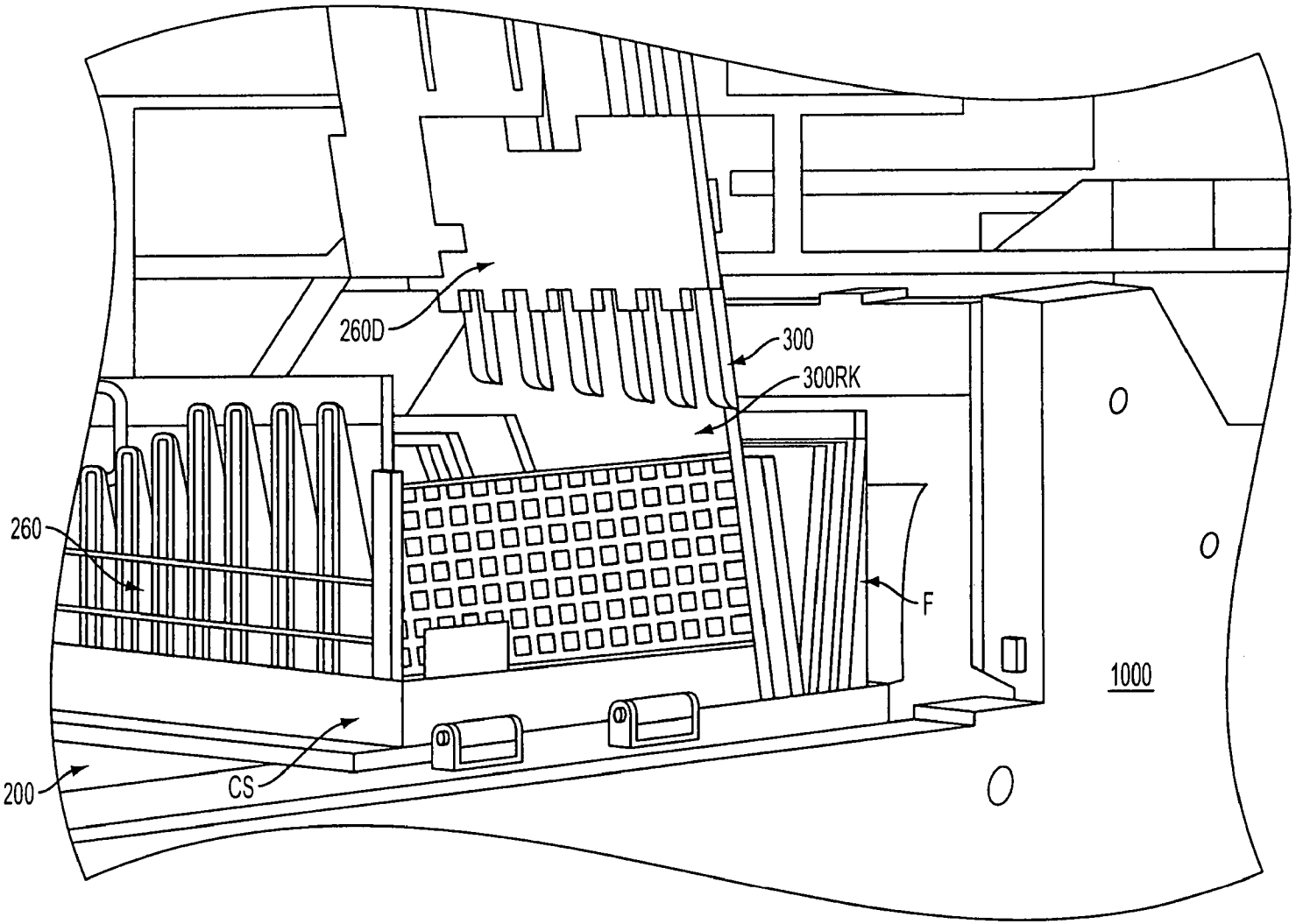

FIG. 24(F) shows a subsequent stage in operation in which the pusher 300 has been raised, while a rake member 300R extends downward to prevent flats from moving upward along with the pusher 300. Preferably, the rake 300R essentially operates to block or scrape the mail from following upward along with the pusher 300 (such as, e.g., if the material of the flats sticks to the pusher), and, in some embodiments, the rake can include projection fingers that extend in between the tines of the pusher to help inhibit movement of flats in between such tines.

Figure 24G:
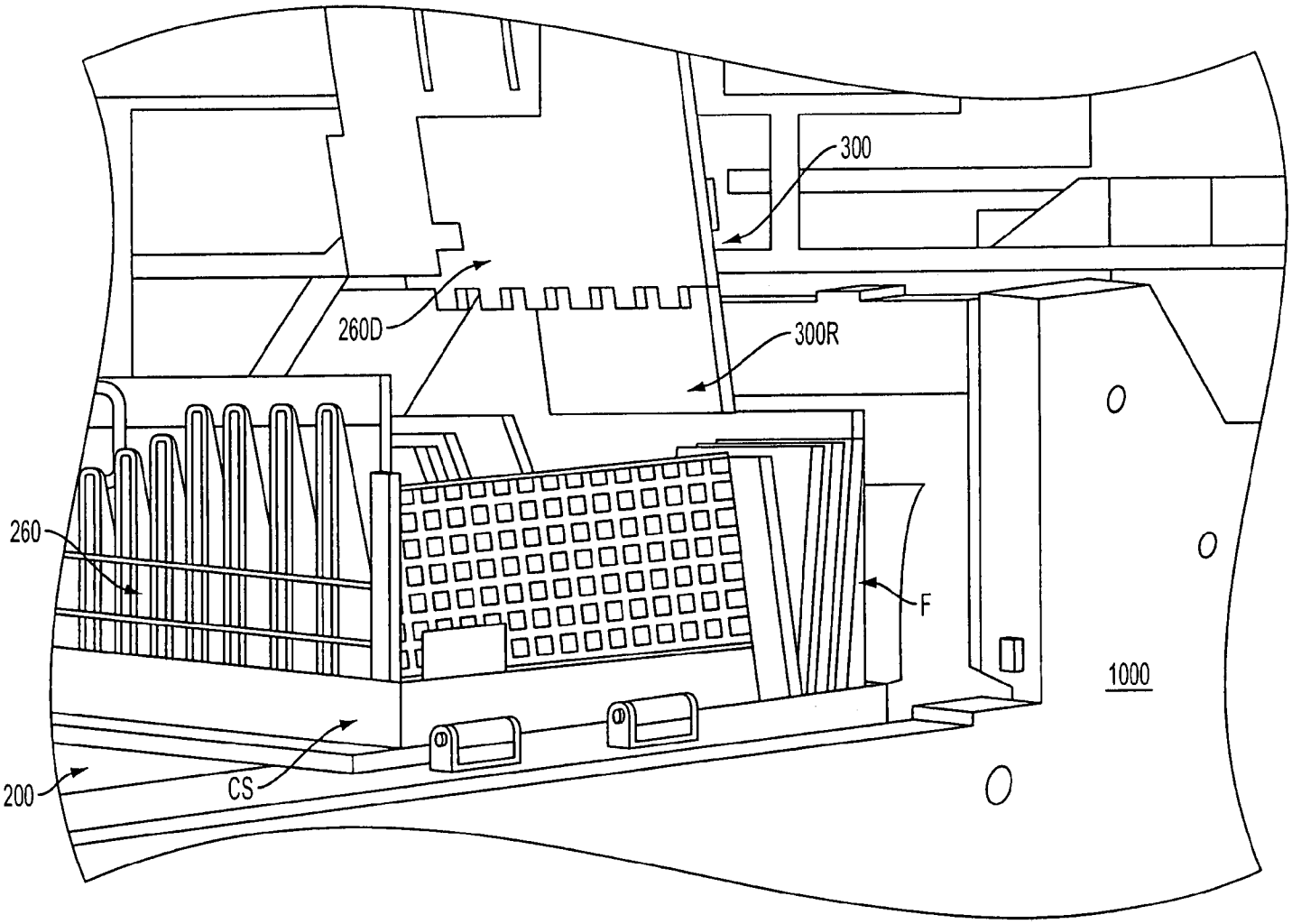

FIG. 24(G) is a subsequent stage in operation in which the rake 300R is in a position over the flats while the pusher 300 has been fully retracted. In some preferred embodiments, the rake 300R can be raised and/or lowered so as to position the rake over the flats prior to raising the pusher 300 and so as to move the rake out of the way at other times. However, in some preferred embodiments, the rake 300R can be located at a substantially fixed or fixed location over the flats sufficient to allow flats to fit thereunder while at the same time to inhibit flats from moving upward along with movement of the pusher.

Figure 24H:
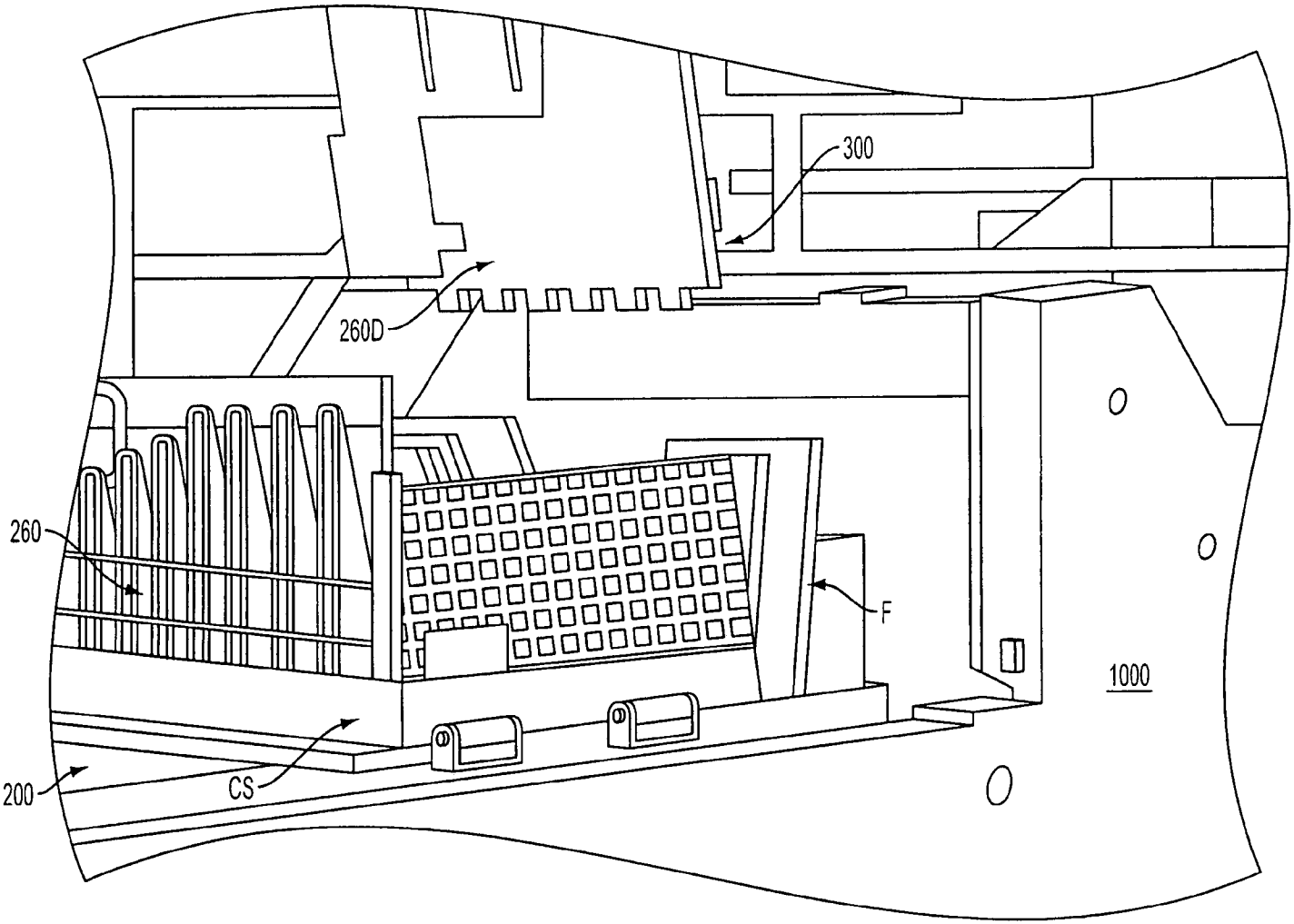

FIG. 24(H) is a subsequent stage in operation in which the rake 300R has been retracted.

Figure 24I:
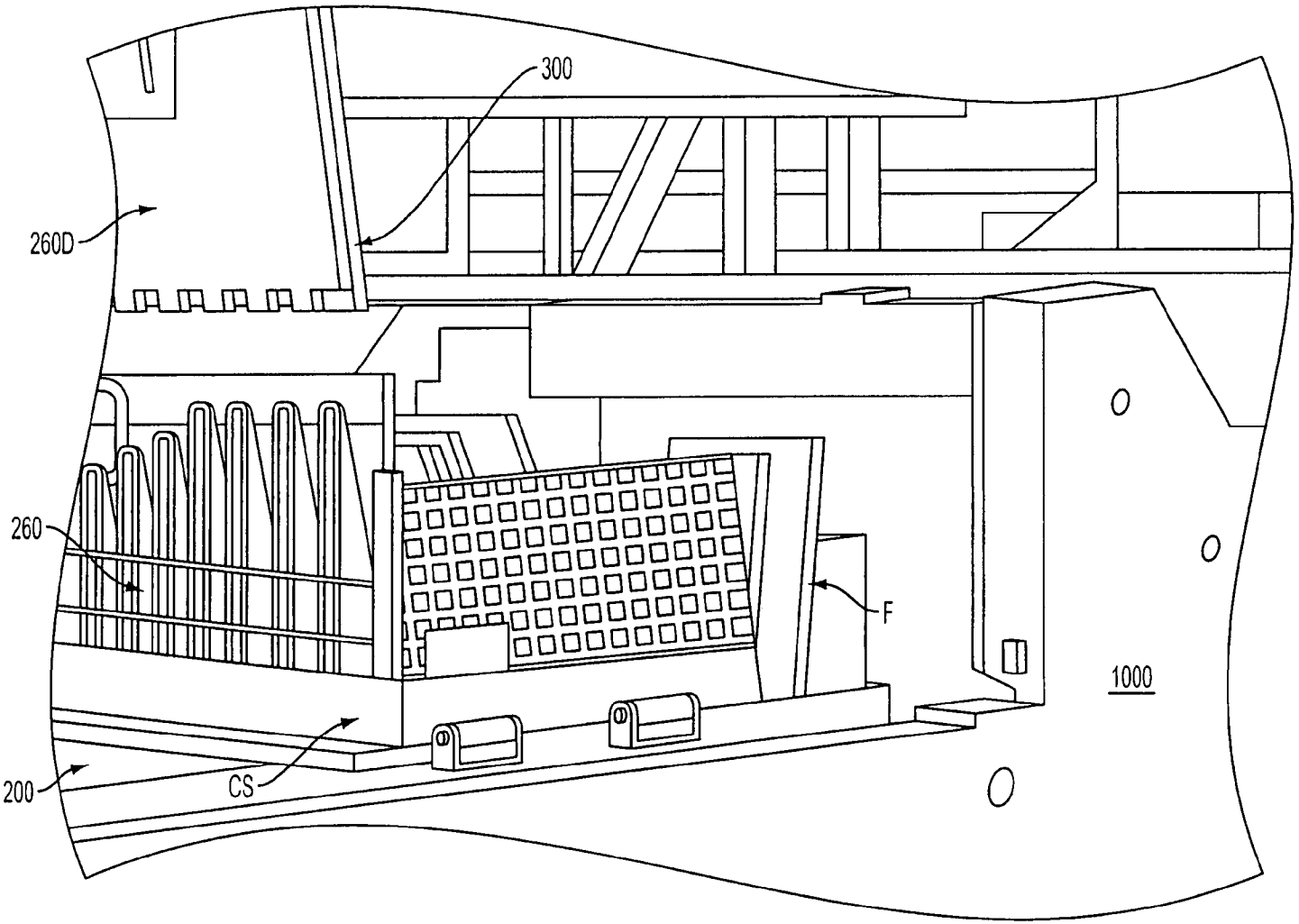

FIG. 24(I) is a subsequent stage in operation in which the pusher 300, the rake 300R, and the gripping mechanism 300GM have all moved reward (e.g., substantially in unison in some embodiments, such as, e.g., by being mounted upon the same support mechanism) to a position just behind the carrier.

Figure 24J:
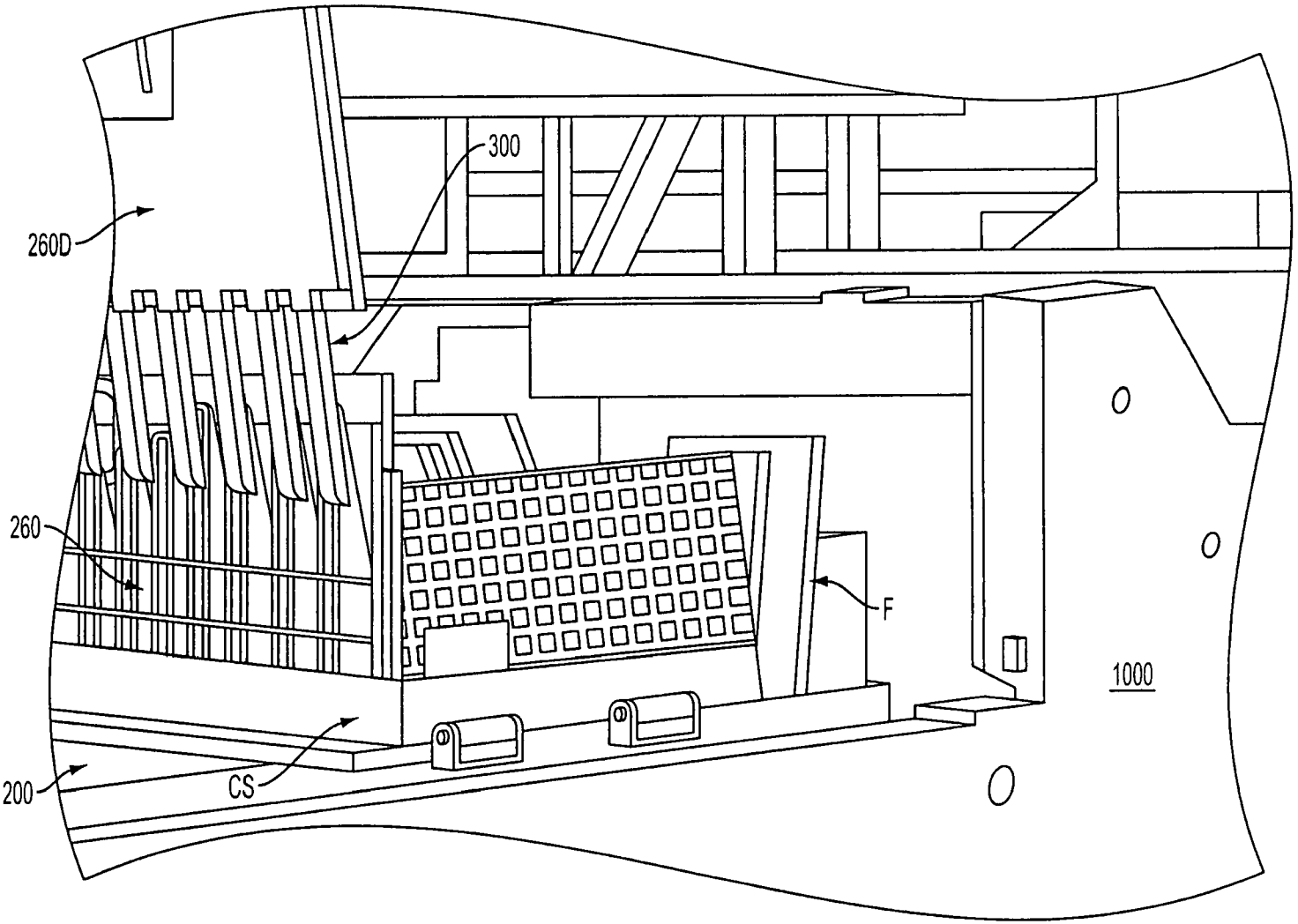

FIG. 24(J) is a subsequent stage in operation in which the pusher has been moved downward such that the tines 300T extend downward a distance substantially corresponding to a distance of the respective tines 260T of the carrier.

Figure 24K:
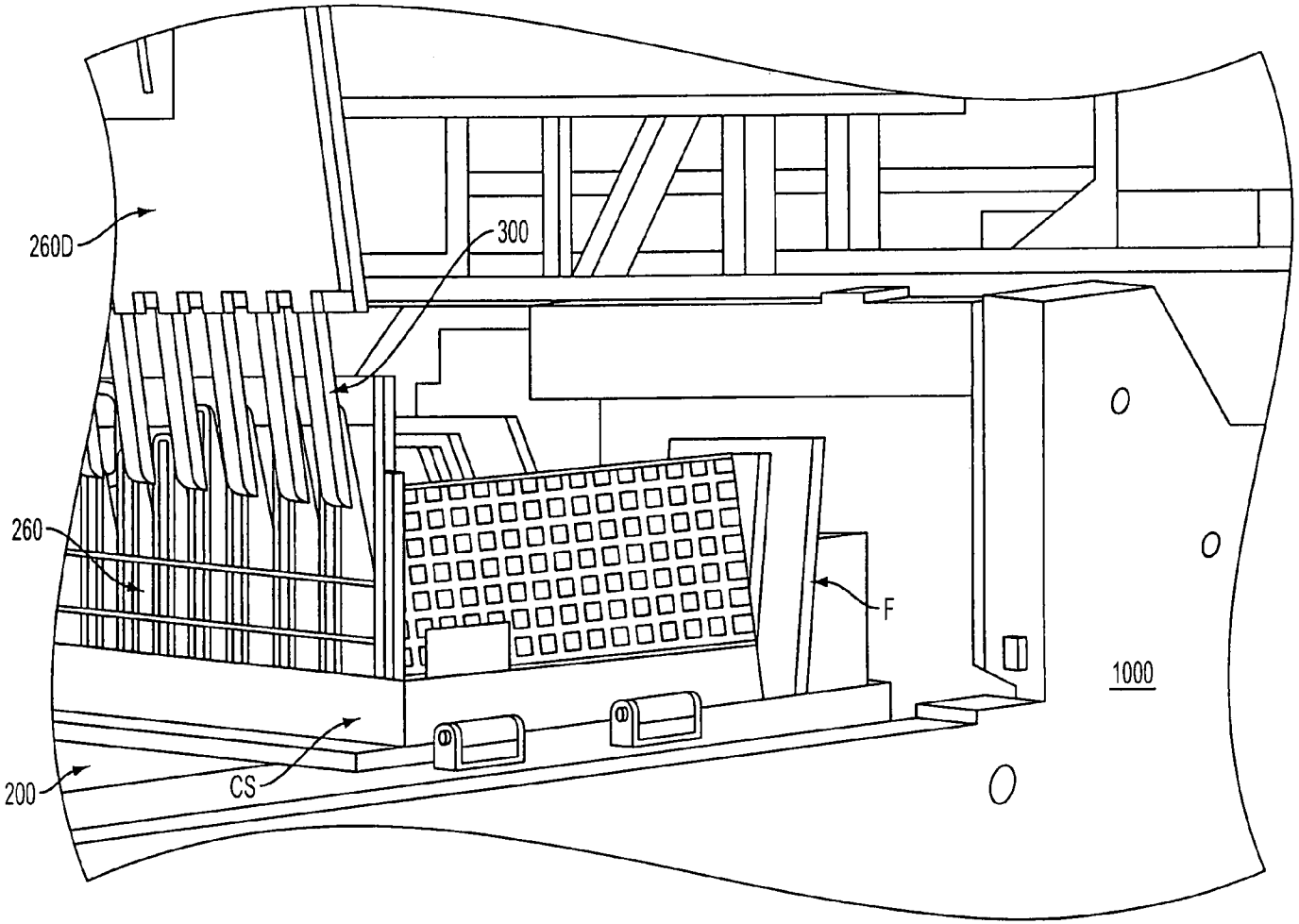
Figure 24L:
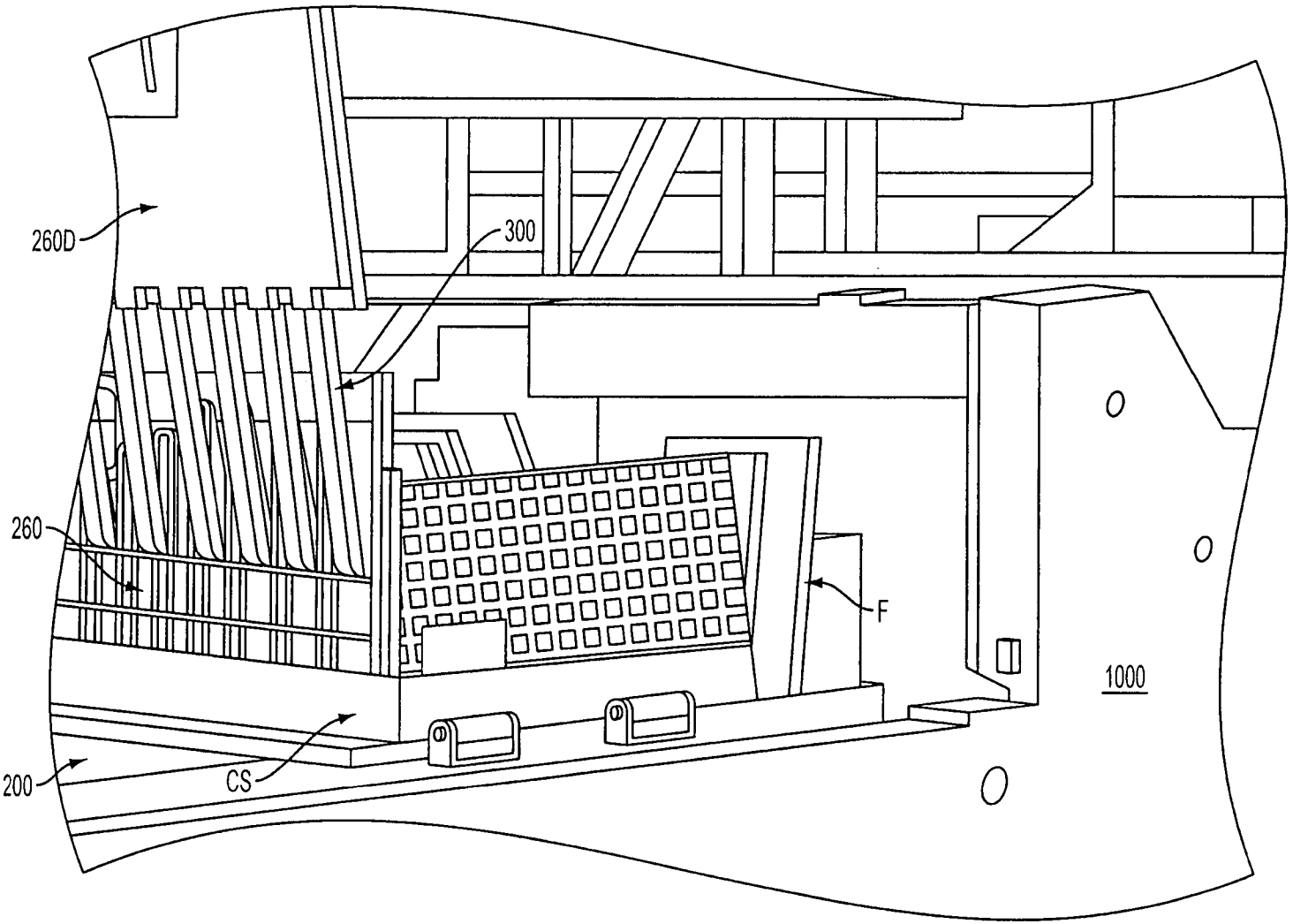
Figure 24M:
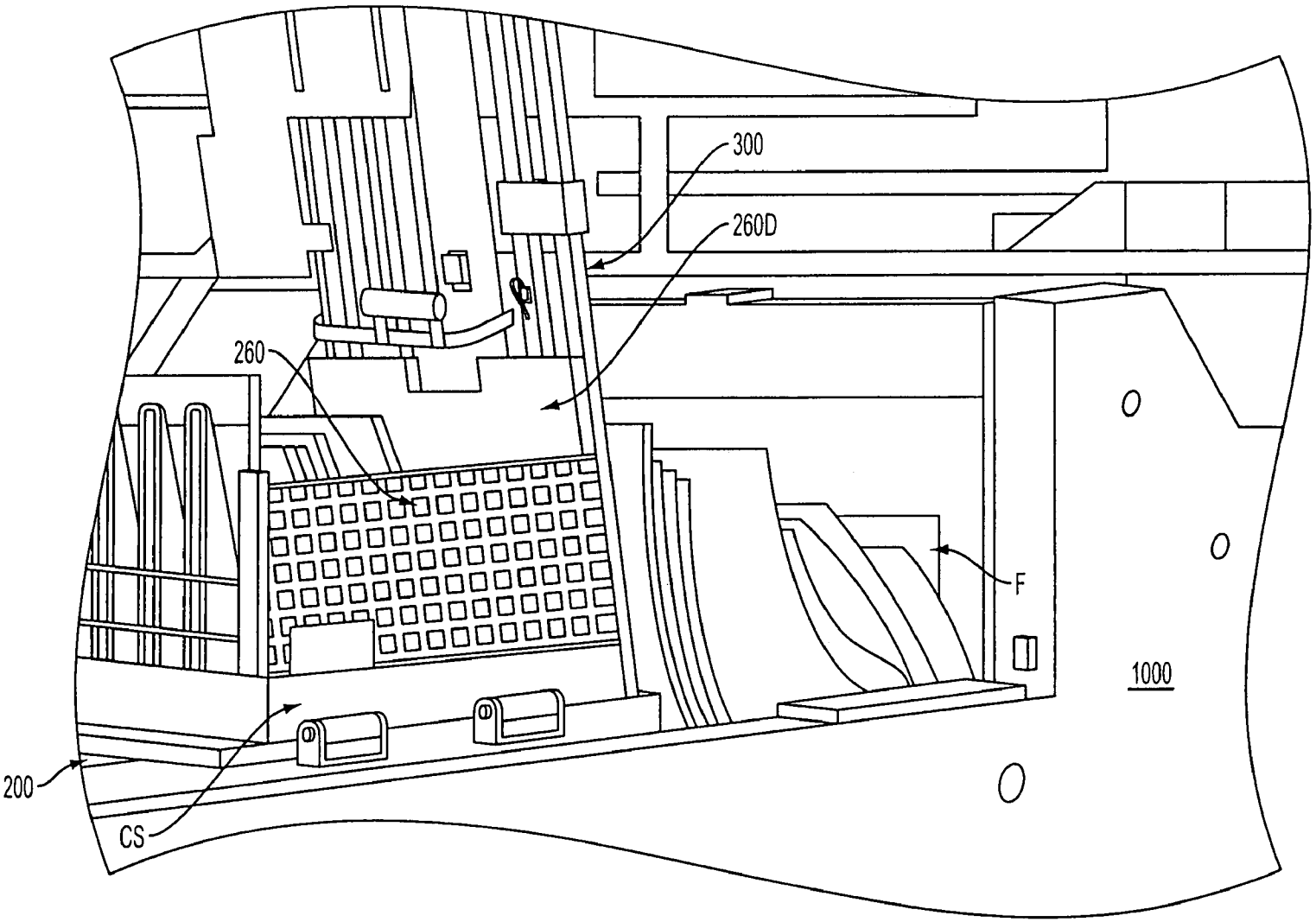

FIG. 24(K) is a subsequent stage in operation in which the pusher has been moved forward such that the tines of the pusher move toward the tines of the carrier.

FIG. 24(L) is a subsequent stage in operation in which the pusher has been moved forward such that the tines of the pusher move in between the tines of the carrier, and the pusher has begun to move downward within the carrier (NB: the pusher will preferably move downward in the carrier until the ends of the tines 300T extend into the respective grooves formed in the floor of the carrier).

FIG. 24(M) is a subsequent stage in operation in which the carrier has been moved forward, such that flats are slid off the carrier onto the conveyor, such that the front of the carrier has been aligned beneath the door 260D, and such that the door has been moved downward so as to begin to be re-attached upon the carrier 260D.

In some preferred implementations of a system similar to that shown in FIGS. 24(A) to 24(M), the mechanisms for lateral, upward and/or reciprocating movement of the pusher, the rake, the gripping mechanism, etc., can be implemented in a similar manner to that of other embodiments described herein above, such as, e.g., mechanisms shown in FIGS. 2(B) to 9. In some embodiments, however, the pusher, the rake and the gripping mechanism can include separate vertical and/or other drives which can be controlled independently. In various other embodiments, any appropriate moving mechanisms can be employed by those in the art as long as desired motions can be achieved.

1. Pusher Control Methods

In some embodiments, the pusher 300 can be controlled so as to adjust for stack discrepancies using methodologies described above. In addition, in some embodiments, the position of the pusher can be adjusted so as to accommodate for, inter alia, a) the amount of flats on the carrier (for example, the amount of flats on the carrier can be sensed using techniques described above, which sensing can be used to send a signal that can be used by a controller that drives the pusher so as to accommodate for empty space within the carrier)[such as, e.g., by promptly moving the pusher 300 forward so as to move flats within the carrier towards the door 260D and/or to otherwise make-up for extra space within the carrier before or after the door 260D is removed], b) the thickness of the door 260D [such as, e.g., by promptly moving the pusher 300 forward more quickly so as to make-up for the space created by the lifted door 260D], and/or other spaces or discrepancies that may result in various circumstances.

In some embodiments, control methods and/or components described in U.S. Published Application No. 2004/0052617 A1, entitled Flats Bundle Processing System, published Mar. 18, 2004, also of the present assignee, can be incorporated, the entire disclosure of which Published Application is incorporated herein by reference as though recited herein in full.

2. Moveable Manual Pusher

In the preferred embodiments, the system can be used, alternately, in either an automatic mode, such as, e.g., shown in FIGS. 24(A)-24(M) or a manual or semi-manual mode in which an operator can, inter alia, manually effect movement of a pusher. In this regard, in some embodiments, the pusher can be released from a drive source such as, e.g., to be manually movable by an operator.

As a first example, in some embodiments, the pusher can be de-coupled from a respective drive mechanism when manually lifted and can be counter-balanced to facilitate manual lifting to a rear of the stack on the conveyor 200. As a second example, in some more preferred embodiments, two pushers can be provided: a first pusher can be provided that operates substantially similar to the pusher 300 described in the later embodiments above; and a second pusher can be provided that operates substantially similar to the pusher 30 described above with respect to earlier embodiments. In this regard, the pusher 30 is preferably mounted so as to be pivotal between an operation orientation that is generally perpendicular to the conveyor 200 (such as, e.g., shown in FIG. 10(A), by way of example) and a non-use orientation that is substantially parallel to the direction of motion of the conveyor 200 and that is laterally to the side of the path of motion of the conveyor. By way of example, FIG. 24(A) shows an illustrative handle 30H that extends from such an illustrative pusher 30 (not shown) that has been pivoted out of the way to a non-use position. Preferably, the pusher 30 will include a latch mechanism to retain the pusher in a use position when desired and to enable the decoupling of the pusher from its associated drive mechanism when the pusher is moved (e.g., pivoted away) to a non-use position.

Figure 25:
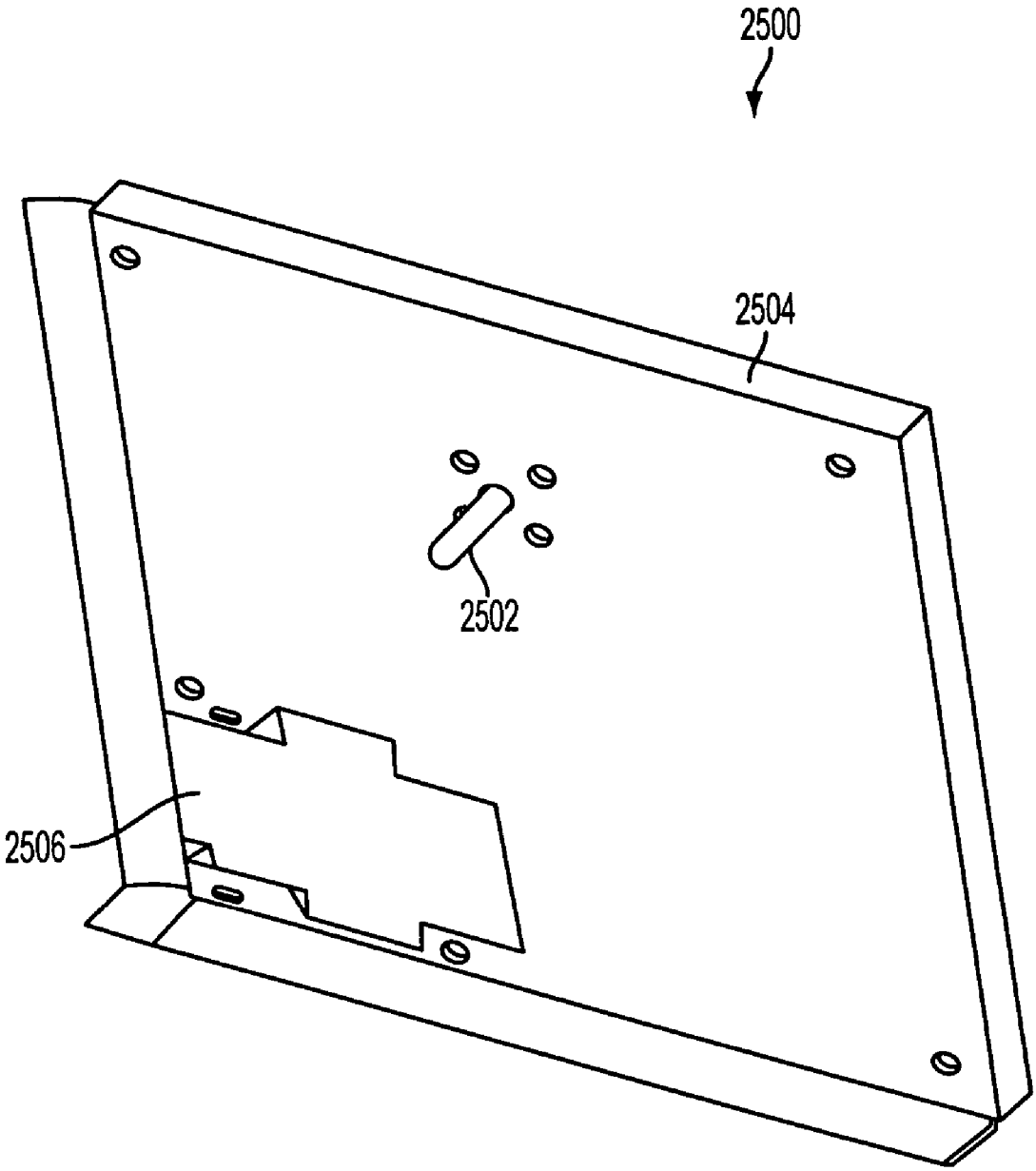
FIGS. 25-28 show illustrative anti-toppling devices according to some illustrative embodiments.
Figure 26:
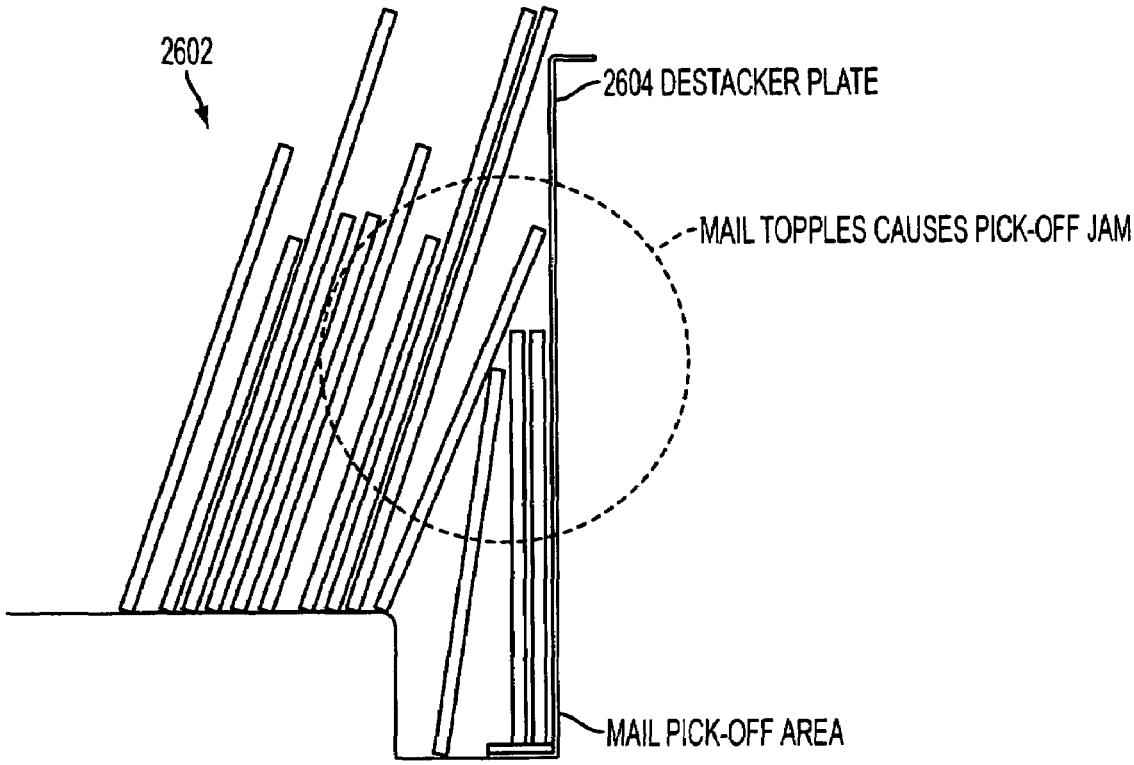

Anti-Toppling Devices:

Referring now to FIG. 25, FIG. 25 shows a perspective front view of some components of an anti-toppling mail destacker device 2500, which can be implemented, for example, at the input of a destacker, such as, e.g., at an input location similar to that shown in FIG. 18 and/or the like. As shown in this view, a retractable protrusion 2502 (e.g., a retractable pin or other retractable element) can extend outward from a destacker plate 2504 that operates as shown in the other drawings in some embodiments. In the figure, an opening 2506 at the lower left side of destacker plate 2504 can be used, in some illustrative examples, to allow conveyor belts or the like mechanisms (e.g., lateral conveyors D-C) to extend into contact with mail or the like adjacent thereto for feeding of the mail or the like (e.g., lateral movement). Destacker plate 2504 may include suction ports D-A (see FIG. 18) to apply intermittent suction to items (e.g., mail) to be singulated or destacked. FIG. 26 is a side view of a conventional destacker plate 2604, illustrating how, e.g., mail 2602 may topple and, thereby, cause pick-off jams and the like.

Figure 27A:
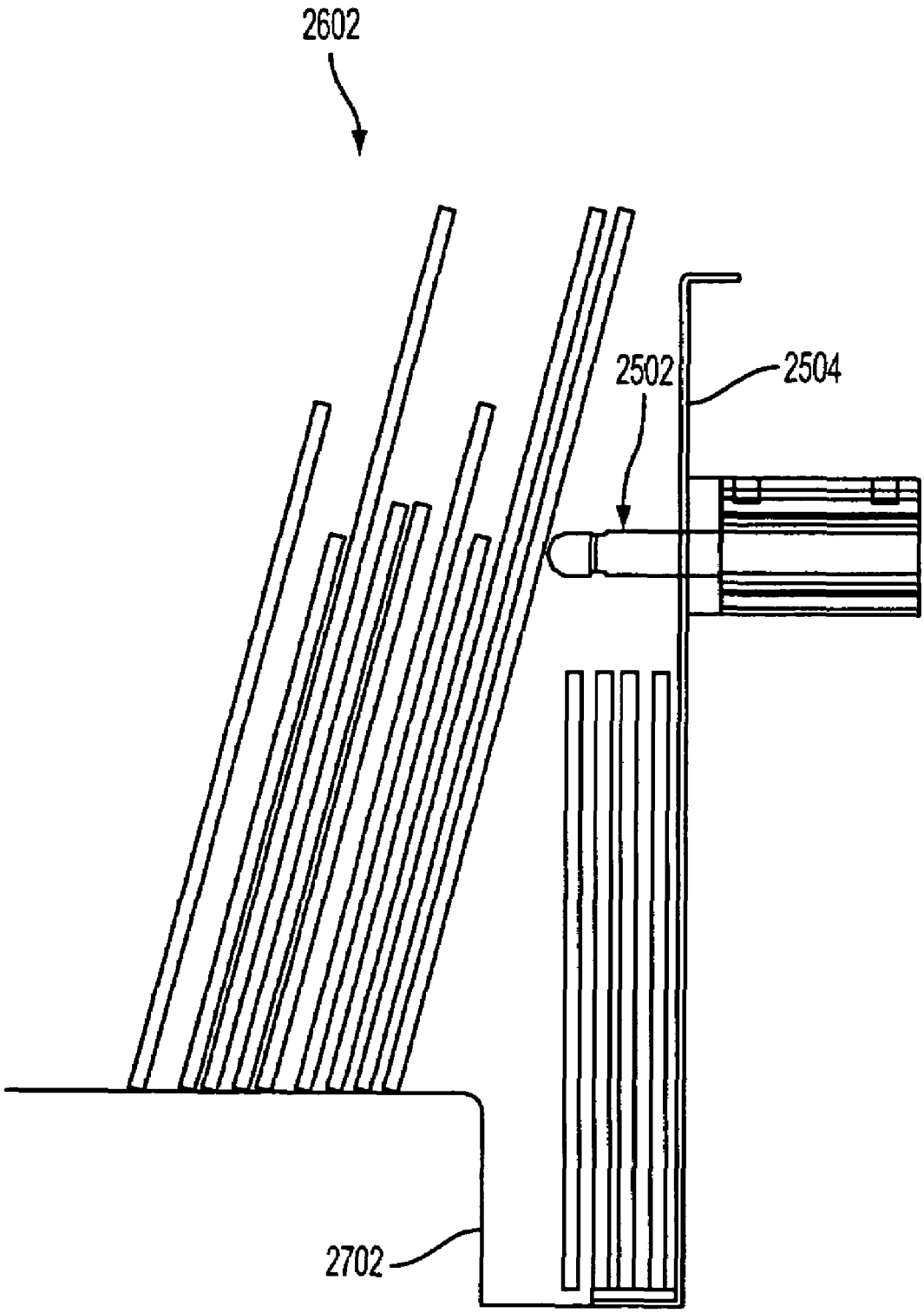
Figure 27B:
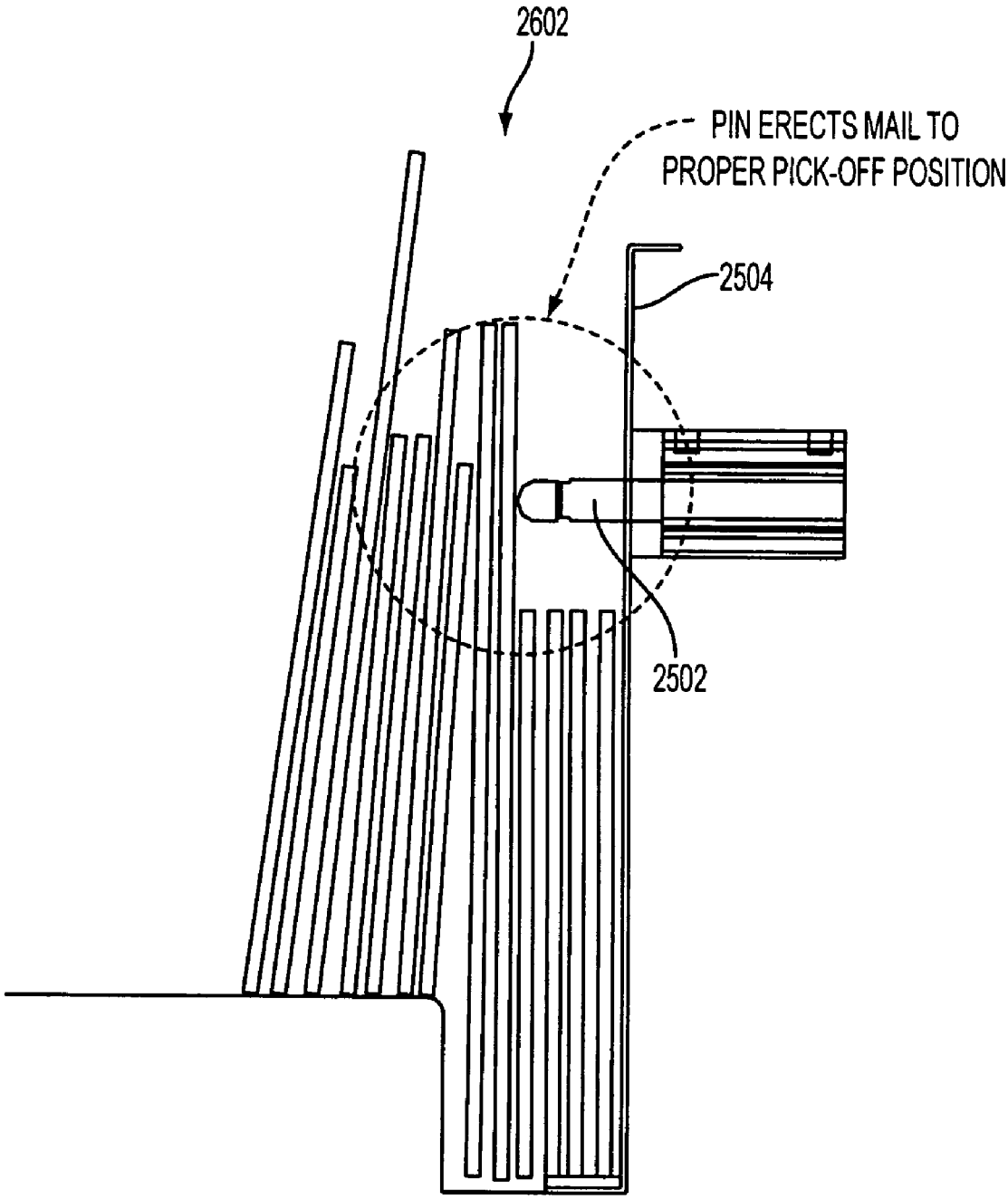
Figure 27C:
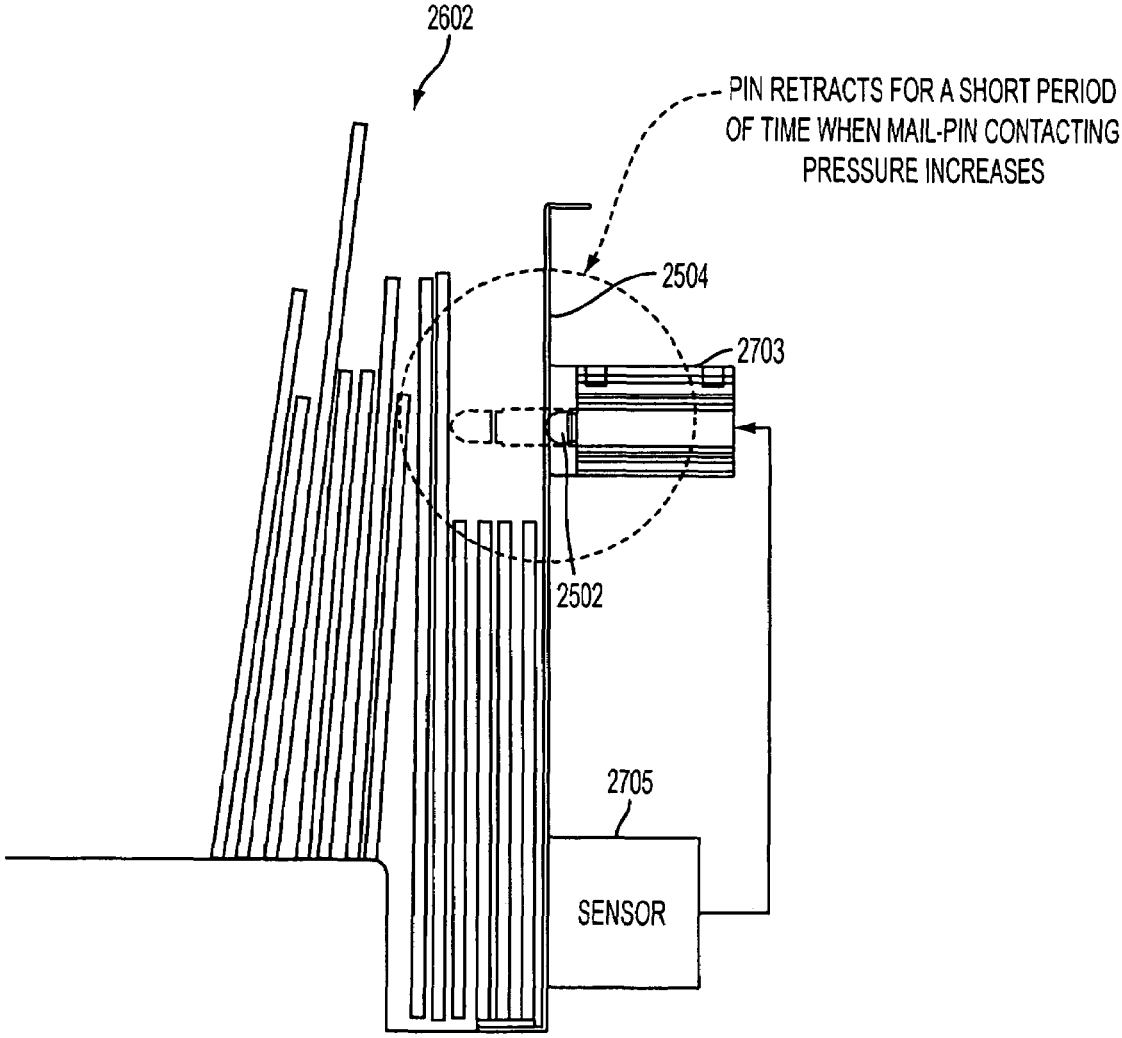
Figure 28A:
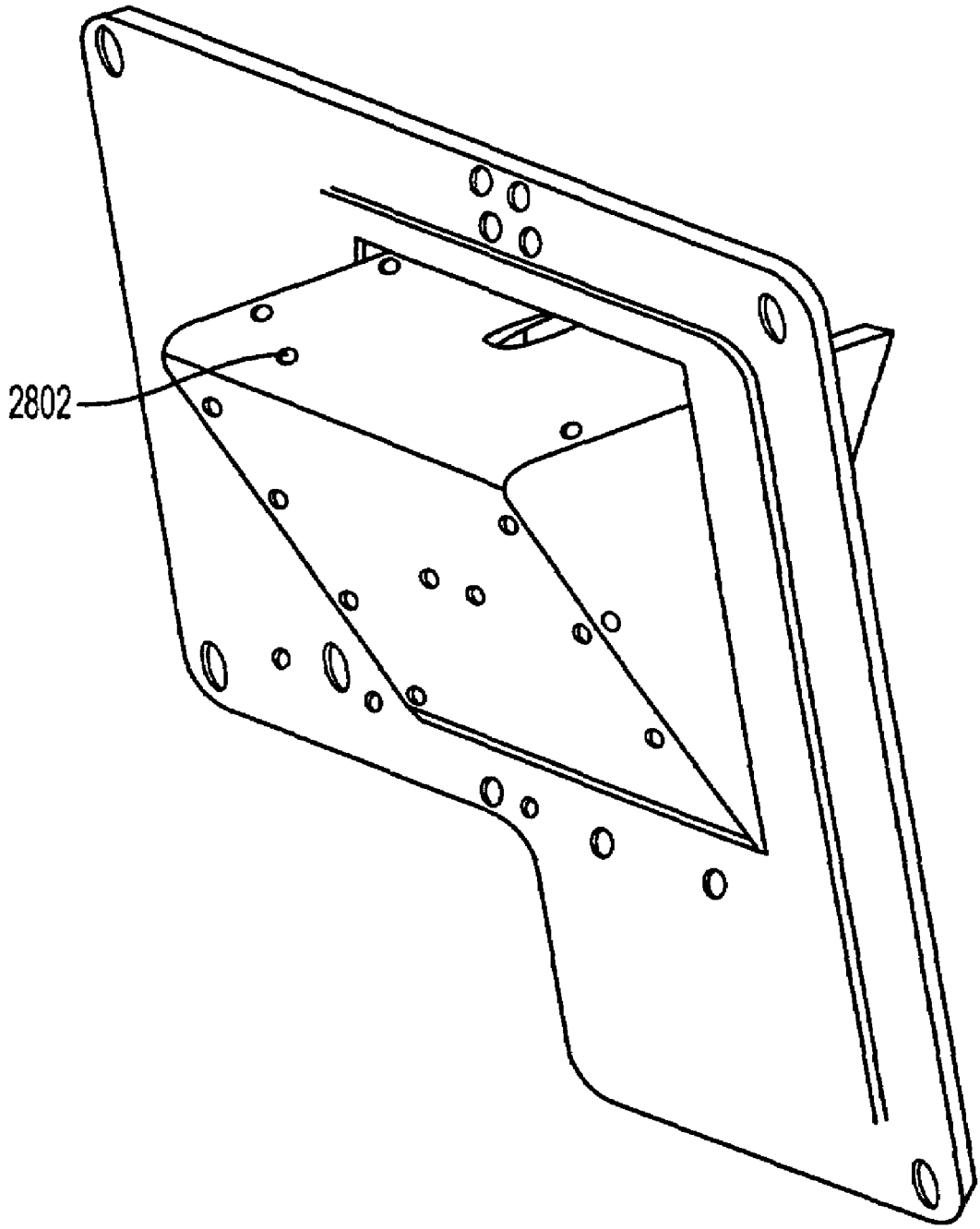
Figure 28B:
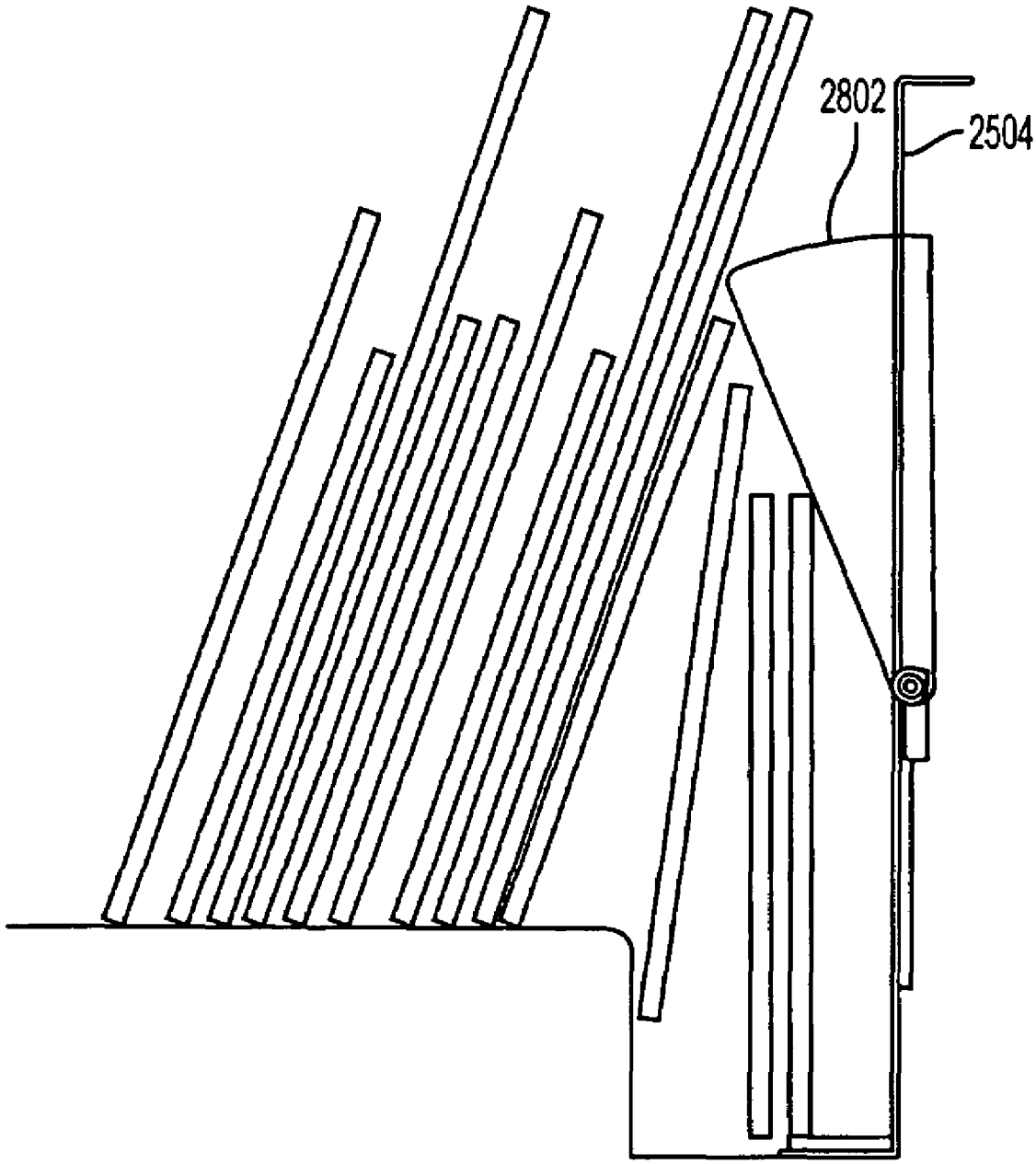
Figure 28C:
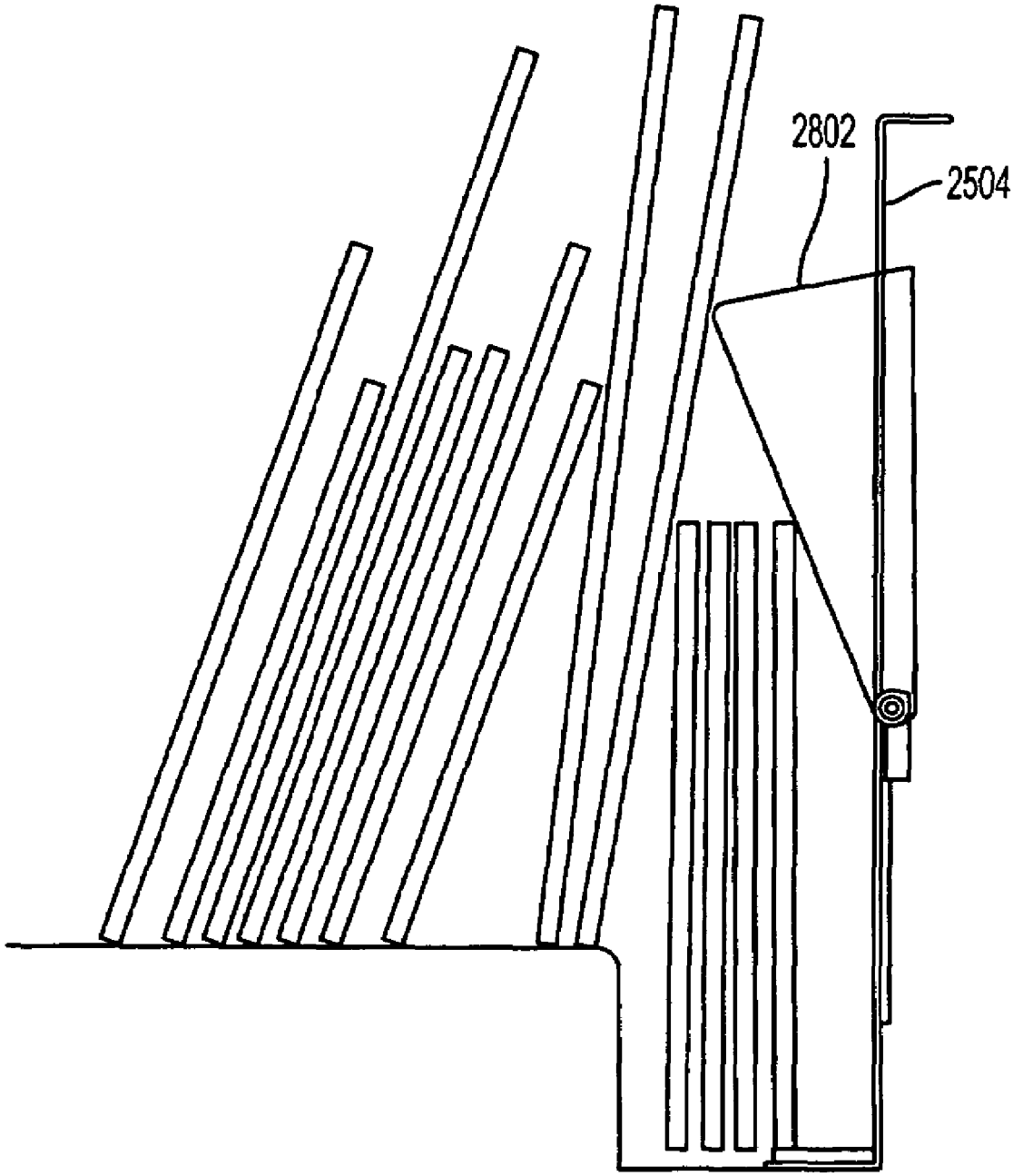
Figure 28D:
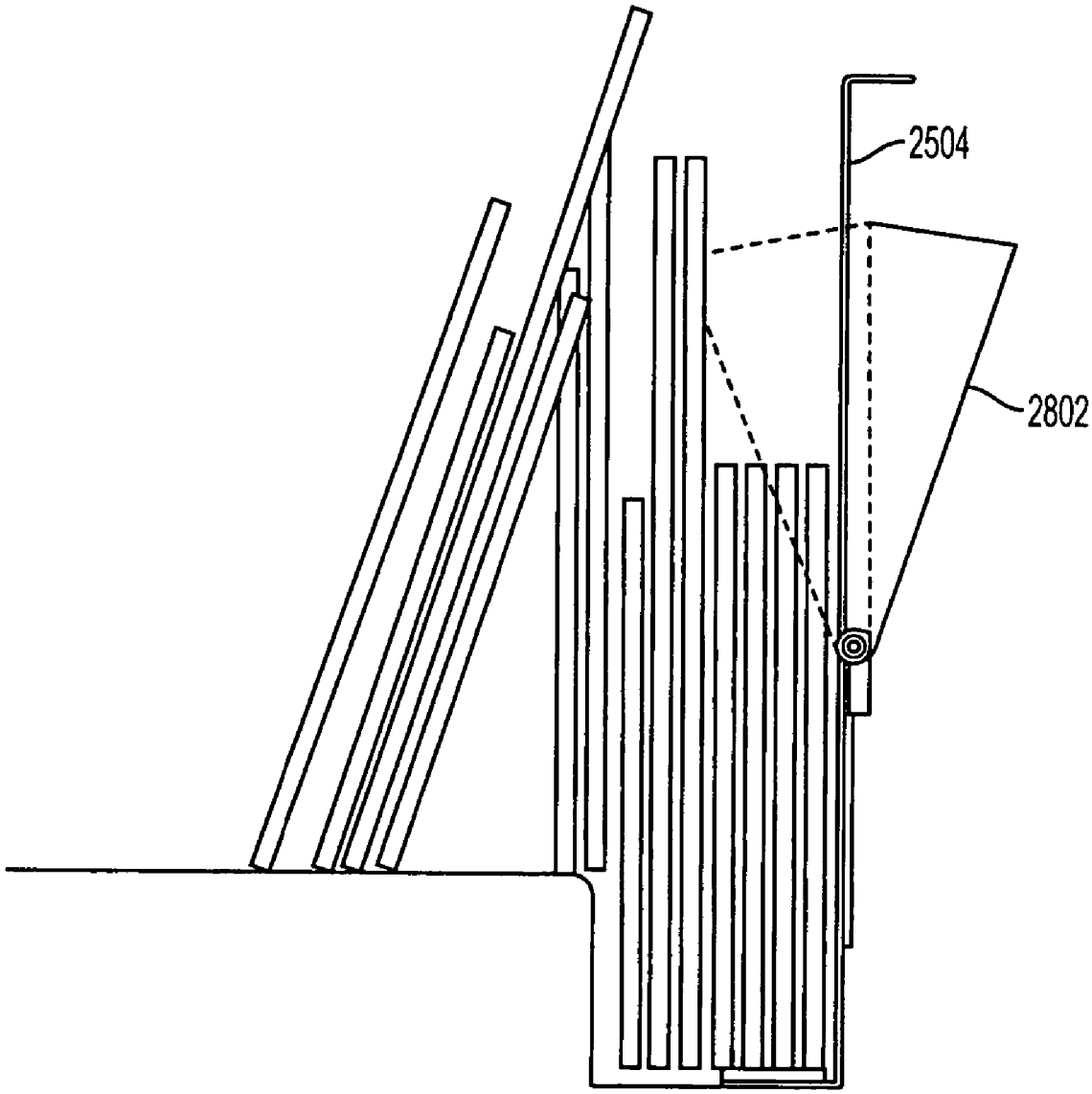

FIGS. 27A-C are side views of anti-toppling device 2500. FIGS. 27A-C illustrate how anti-toppling device 2500 prevents mail 2602 from toppling. As shown in FIG. 27, retractable protrusion 2502, which in this embodiment is the in the form of a pin, may project outwardly from the major surface of plate 2504 in a direction towards mail 2602. When in the protruding state (or article erecting position), protrusion 2502 may contact a mail piece, thereby limiting the amount by which the mail piece can lean towards plate 2504. This prevents the mail from toppling. As shown, two larger pieces of mail are erected into a proper position once such mail enters the lower region 2702 during movement from the leftmost view to the center view.

As shown in FIG. 27C, the protrusion 2502 preferably retracts for a period of time when a mail jam condition is detected. For example, in some embodiments a sensor 2705 (e.g., photo-eye sensors, pressure sensor and/or other sensors) for detecting a mail jam condition may be disposed next to cutout area 2506 of destacker plate 2504. If a photo-eye sensor is used, a mail jam my be detected by detecting the absence of mail moving past the sensor for a set period of time. For example, if the sensor 2705 determines that x seconds (e.g., 2 seconds or more) has elapsed since the last piece of mail passed by the sensor 2705, the sensor may send a signal, which sending of the signal indicates a jam condition. If a pressure sensor is used, a mail jam my be detected by determining whether the pressure on protrusion 2502 is greater or less than a predetermined threshold. Appropriate means 2703 to effect the retraction of protrustion 2502 (e.g., motors, pneumatic actuators, electric actuators or other means to produce or imparts motion) in response to sensing a mail jam condition can be employed in various embodiments. In various embodiments, immediately after or shortly after a jam condition is detected, the protrusion will retract for a set period of time or until the jam condition is no longer exists. For example, if sensor 2705 detects a jam condition, sensor 2705 may send to means 2703 a signal that causes means 2703 to retract protrusion 2502 for a set period of time or until the jam condition is no longer detected.

FIGS. 28A-D show another illustrative embodiment in which the retractable protrusion is a retractable plate member 2802. In some embodiments, the retractable plate member 2802 can pivot between an article erecting position, such as, e.g., shown in FIGS. 28B and 28C and a retracted position in which the face of the plate member 2802 is, for example, generally flush or within the major surface of the destacker plate 2504, such as, e.g., shown with small-dotted lines at the rightmost small view in FIG. 28D. In some embodiments, the plate 2802 can be mounted so as to pivot between such positions, such as, e.g,. about a pivot shaft at a lower end of the plate member.

In various other embodiments, the configuration of the anti-toppling device can vary widely based on circumstances.

In the preferred embodiments, such an anti-toppling features can be implemented in a feeder such as, e.g., shown at 100 in various figures described herein. However, such an anti-toppling feature can be advantageous in other applications. Among other things, such an anti-toppling device can help to feed such items consistently and smoothly, and at a proper angle of presentation, into such a feeder.

While the preferred embodiments pertain to systems for handling mail and the most preferred embodiments pertain to systems for handling mail flats, various embodiments can be used for handling all types of thin objects. The terminology "thin objects" includes all types of generally thin articles that are capable of being aligned in a side-by-side manner or stacked (i.e., the terminology "stacked" herein includes, among other things, a side-by-side relationship). In certain preferred embodiments, a given system may handle a multitude of thin objects with different sizes, compositions, flexibilities (such as, e.g., substantially rigid, substantially flexible, etc.) and/or shapes at a given time. However, in the most preferred embodiments, the thin objects preferably fall within a predetermined range of characteristics. For example, in certain preferred embodiments, the system can be adapted to handle mail flats having one or more of the characteristics described in the above-referenced co-pending applications, the entire disclosures of which have been incorporated herein by reference. While some preferred embodiments involve the handling of flats having characteristics as detailed above, numerous other embodiments can be employed having various other flat configurations or specifications, such as, e.g., that disclosed in the '311 patent. The foregoing illustrative embodiments do not limit the broad applicability of the invention to various objects having other characteristics, which may vary widely depending on the particular circumstances.

While illustrative embodiments of the invention have been described herein, the present invention is not limited to the various preferred embodiments described herein, but includes any and all embodiments having modifications, omissions, combinations (e.g., of aspects across various embodiments), adaptations and/or alterations as would be appreciated by those in the art based on the present disclosure. The limitations in the claims are to be interpreted broadly based the language employed in the claims and not limited to examples described in the present specification or during the prosecution of the application, which examples are to be construed as non-exclusive. For example, in the present disclosure, the term "preferably" is non-exclusive and means "preferably, but not limited to." Means-plus-function or step-plus-function limitations will only be employed where for a specific claim limitation all of the following conditions are present in that limitation: a) "means for" or "step for" is expressly recited; b) a corresponding function is expressly recited; and c) structure, material or acts that support that structure or step are not recited.

What is claimed is:

1. A mail feeding apparatus, comprising:

a mail destacker; and a mail transporter for transporting mail towards the mail destacker, wherein the mail destacker comprises:

(1) a destacker plate having a major surface facing the mail transporter;

(2) a retractable protrusion that can move between a article erecting position and a retracted position, wherein in the article erecting position the retractable protrusion projects outwardly from the major surface of the destacker plate in the direction of the mail transporter and in the retracted position the retractable protrusion does not substantially project outwardly from the major surface of the destacker plate;

(3) a positioner operable to move the retractable protrusion between the article erecting position and the retracted position; and (4) a sensor for detecting a mail jam condition, wherein the sensor is configured to send a signal to the positioner in response to detecting a mail jam condition, and the positioner is configured to move the retractable protrusion into the retracted position in response to receiving the signal, wherein the retractable protrusion is in the form of a retractable pin or retractable plate member.

2. The mail feeding apparatus of claim 1, wherein the retractable plate member is configured to pivot between the article erecting position and the retracted position.

3. The mail feeding apparatus of claim 2, wherein a front face of the plate member is generally flush with the major surface of the destacker plate when the plate member is in the retracted position.

4. The mail feeding apparatus of claim 1, wherein the destacker plate further includes one or more suction ports to apply suction to mail.

5. A mail destacker for destacking mail, comprising:

a destacker plate having a major surface that, when in operation, faces a stack of mail;

a retractable protrusion that can move between a article erecting position and a retracted position, wherein in the article erecting position the retractable protrusion projects outwardly from the major surface of the destacker plate in the direction of the stack of mail and in the retracted position the retractable protrusion does not substantially project outwardly from the major surface of the destacker plate;

a conveyor belt for moving mail out of the mail stack a positioner for moving the retractable protrusion between the article erecting position and the retracted position; and a sensor configured to detect the presence of a mail jam condition, wherein the sensor is configured to send a signal to the positioner in response to detecting a mail jam condition, and the positioner is configured to move the retractable protrusion into the retracted position in response to receiving the signal, wherein the retractable protrusion is in the form of a retractable pin or retractable plate member.

6. The mail destacker of claim 5, wherein the retractable plate member is configured to pivot between the article erecting position and the retracted position.

7. The mail destacker of claim 6, wherein a front face of the plate member is generally flush with the major surface of the destacker plate when the plate member is in the retracted position.

8. The mail destacker of claim 5, wherein the destacker plate further includes one or more suction ports to apply suction to mail.

* * * * *